US006138651A

United States Patent [19]

Mori et al.

[11] Patent Number: 6,138,651

[45] Date of Patent: Oct. 31, 2000

[54] EXHAUST GAS RECIRCULATION SYSTEM FOR ENGINE

[75] Inventors: Kouji Mori; Kodai Yoshizawa, both of Kanagawa; Satoshi Takeyama, Yokohama; Junichi Kawashima; Yutaka Matayoshi, both of Kanagawa, all of Japan

[73] Assignee: Nissan Motor Co., Ltd., Yokohama, Japan

[21] Appl. No.: 09/228,957

[22] Filed: Jan. 12, 1999

Related U.S. Application Data

[63] Continuation-in-part of application No. 09/076,489, May 13, 1998, abandoned.

[30] Foreign Application Priority Data

| | | | |
|---|---|---|---|
| May 30, 1997 | [JP] | Japan | 9-142381 |
| Jan. 20, 1998 | [JP] | Japan | 10-008966 |
| Jan. 26, 1998 | [JP] | Japan | 10-012430 |
| Jan. 26, 1998 | [JP] | Japan | 10-012431 |
| Mar. 30, 1998 | [JP] | Japan | 10-084301 |
| Nov. 16, 1998 | [JP] | Japan | 10-324974 |

[51] Int. Cl.[7] ..... F02M 25/07

[52] U.S. Cl. ..... 123/568.17

[58] Field of Search ..... 123/568.11, 568.17, 123/568.18, 184.38, 184.42

[56] References Cited

U.S. PATENT DOCUMENTS

| | | | |
|---|---|---|---|
| 4,119,071 | 10/1978 | Hattori | 123/568.17 |
| 4,135,481 | 1/1979 | Resler, Jr. | 123/568.17 |
| 4,327,698 | 5/1982 | Hamai et al. | 123/568.17 |
| 4,453,502 | 6/1984 | Resler, Jr. | 123/430 |
| 4,461,150 | 7/1984 | Grohn | 60/605.2 |
| 4,697,569 | 10/1987 | Hertweck et al. | 123/568.17 |
| 4,741,295 | 5/1988 | Hosoya et al. | 123/568.17 |
| 4,867,109 | 9/1989 | Tezuka et al. | 123/184.38 |
| 5,535,717 | 7/1996 | Rygiel | 123/568.17 |
| 5,572,979 | 11/1996 | Czadzeck | 123/568.17 |
| 5,666,930 | 9/1997 | Elder | 123/568.17 |
| 5,884,612 | 3/1999 | Takeyama et al. | 123/568.17 |
| 5,960,759 | 10/1999 | Ohsuga et al. | 123/568.17 |
| 5,970,960 | 10/1999 | Azuma | 123/568.17 |

FOREIGN PATENT DOCUMENTS

| | | |
|---|---|---|
| 35 11 094 | 10/1986 | Germany . |
| 60-171952 | 11/1985 | Japan . |
| 3-114563 | 11/1991 | Japan . |
| 3-114564 | 11/1991 | Japan . |
| 8-218949 | 8/1996 | Japan . |

*Primary Examiner*—Willis R. Wolfe
*Attorney, Agent, or Firm*—Foley & Lardner

[57] ABSTRACT

An exhaust gas recirculation system for returning part of exhaust gas of an engine to an intake system has at least one EGR gas introduction port for directing the EGR gas into an intake air passage downstream of a throttle valve. The EGR introduction port opens, into the intake passage, in a tangential direction to produce a circumferential flow along an inside curved surface of the intake air passage around a central back flow region behind the throttle valve to mix the EGR gas efficiently with the fresh intake air and to prevent deposits on the throttle valve.

44 Claims, 56 Drawing Sheets

EXHAUST GAS RECIRCULATION SYSTEM FOR ENGINE

RELATED APPLICATION

This application is a continuation-in-part of U.S. Ser. No. 09/076,489 filed on May 13, 1998, now abandoned.

BACKGROUND OF THE INVENTION

The present invention relates to an exhaust gas recirculation (EGR) system for returning part of exhaust gas of an engine to an intake system to improve the fuel efficiency and exhaust performance.

In order to improve fuel consumption for less $CO_2$ and to lower the combustion temperature for less NOx in compliance with growing environmental concerns, there have been proposed a variety of EGR systems for recirculating a controlled amount of exhaust gas to the intake system in a normal operation not requiring higher output power.

Japanese Utility Model Kokai Publication No. 3(1991)-114563 shows a first conventional EGR system having a horizontally confronting pair of openings for introducing EGR gas into an intake pipe. Japanese Utility Model Kokai Publication No. 3(1991)-114564 shows a second conventional EGR system having an annular EGR gas passage around an intake pipe and a plurality of holes for introducing the EGR gas from the annular passage into the intake pipe. Both systems are aimed to reduce the cylinder to cylinder nonuniformity in the EGR rate.

Japanese Patent Kokai Publication No. 8(1996)-218949 discloses a third conventional EGR system having an EGR passage opening to a second surge tank provided downstream of a first surge tank in an intake passage. This system introduces the EGR gas at a remote position from a throttle valve, to prevent adhesion to the throttle valve, of harmful components (deposits) of the exhaust gas mixture.

Japanese Utility Model Kokai Publication No. 60-171952 discloses a fourth conventional EGR system having an EGR pipe connected, through an EGR valve, to a surge tank of an intake manifold.

SUMMARY OF THE INVENTION

However, the conventional EGR systems are not completely sufficient for mixing the EGR gas with the intake air and for uniformly distributing the EGR gas to the engine cylinders. In the second system, conditions of fresh intake air streams through the throttle valve exert large influence on the mixing of the EGR gas and adhesion of deposits to the throttle valve. Insufficient blend of the EGR gas with the intake air is causative of uneven distribution of the EGR rate among the cylinders, unstable engine performance, increase of emission and poor fuel economy. Deposits on a throttle valve may decrease the accuracy of intake air quantity control, and may make the throttle valve immovable. In the fourth example, the EGR gas is swept downstream by a fresh main intake stream, and the EGR gas can hardly enter the most upstream branch of the intake manifold.

It is therefore an object of the present invention to provide an exhaust gas recirculation type engine system for uniformizing the EGR distribution and protect a throttle valve against deposits.

According to the present invention, an engine system comprises an engine, an exhaust system, an intake system comprising a throttle valve in an intake passage, and an EGR system. The EGR system comprises at least one EGR introduction opening for introducing EGR gas into a downstream intake passage section on a downstream side of the throttle valve. The EGR introduction opening is opened in a predetermined EGR introducing direction to direct an inflow EGR gas stream circumferentially along a curved inside wall surface of the downstream passage section around a central region of the downstream intake passage section. The intake system may comprise a pipe arrangement or pipe system and a throttle valve. The pipe arrangement is a single member or an assembly (such as an assembly of an intake manifold and a throttle body) for defining passages for distributing intake air to cylinders of the engine. The pipe arrangement comprises a collector section, a plurality of branches leading from the collector section, respectively, to the cylinders of the engine, and a section defining an intake passage for introducing the intake air into the collector section. The throttle valve is disposed in the intake passage at an intermediate position so that the intake passage is divided into an upstream intake passage section on an upstream side of the throttle valve and the downstream intake passage section extending from the throttle valve to the collector section.

The EGR system is arranged to return part of the exhaust gas as EGR gas from the exhaust system into the downstream passage section of the intake system. The EGR system may comprise at least one EGR gas introduction port having an EGR gas introduction opening for directing an inflow EGR gas stream into the downstream passage section. The EGR gas introduction opening is located downstream of a first free end of the throttle valve in a closed position. The EGR gas introduction port extends along a tangential direction tangential to a curved inside wall surface of the downstream passage subsection. An inflow direction of the EGR gas introduction port may be parallel to a cross sectional plane of the downstream intake passage section or may be inclined downstream so as to form a predetermined angle with respect to a direction of a fresh intake air stream in the downstream intake passage subsection.

The EGR port is thus directed to produce a screw-like spiral flow advancing downstream along the inside surface of the intake passage subsection. An intake air stream is induced into the spiral flow and well mixed with the EGR gas. The spiral flow promotes mixing of the EGR gas with the intake air, and prevents deposits by keeping the EGR gas outside a central back flow region behind the throttle valve.

DETAILED DESCRIPTION OF THE INVENTION

1st Embodiment

Figure 1:
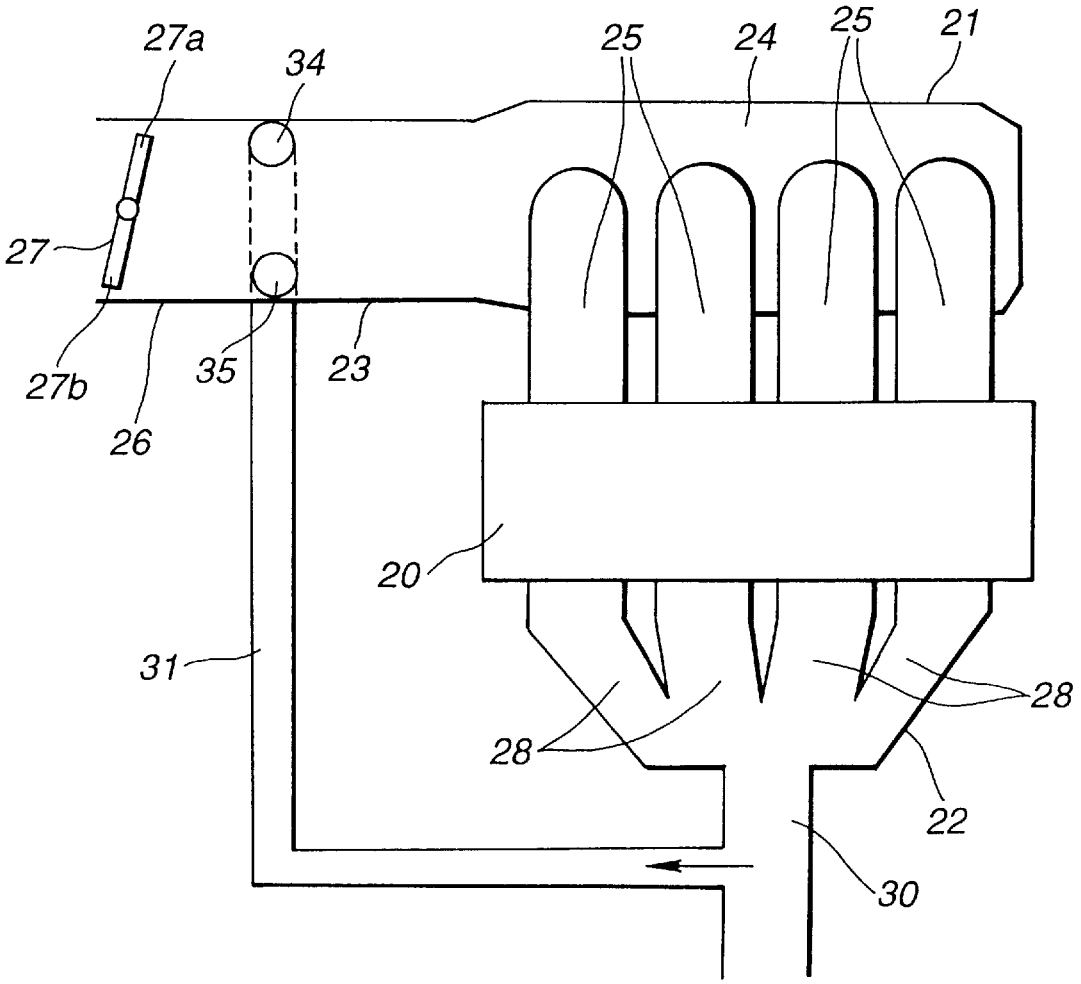
FIG. 1 is a schematic view showing an engine system having EGR introduction ports according to a first embodiment of the present invention.
Figure 2:
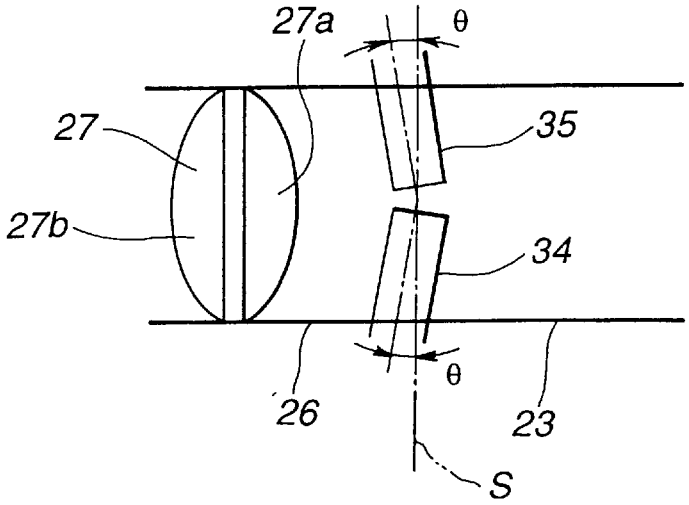
FIG. 2 is a view showing an arrangement of the EGR ports according to the first embodiment.
Figure 3:
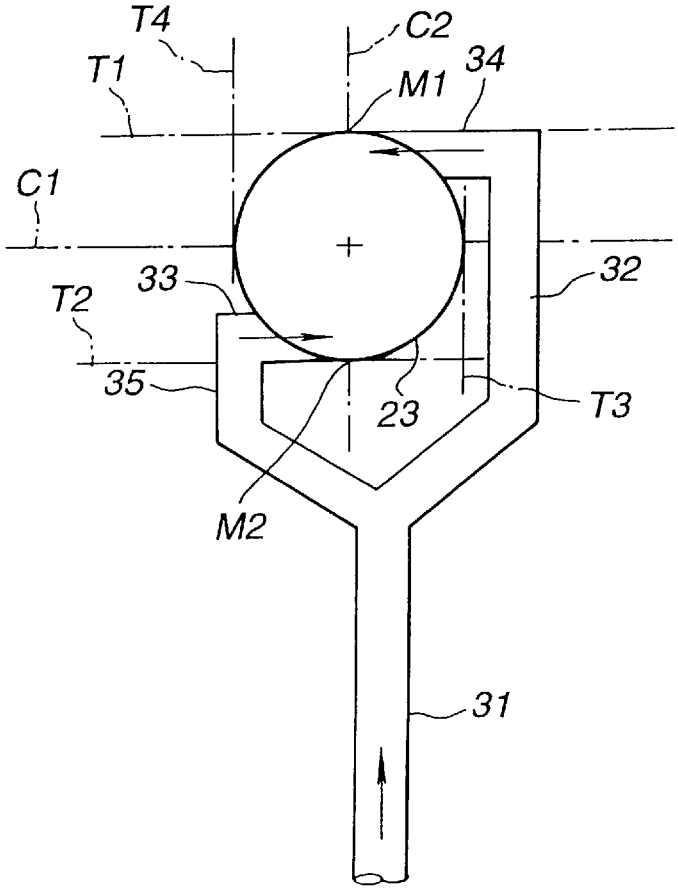
FIG. 3 is a view showing the arrangement of the EGR ports according to the first embodiment.

FIGS. 1~3 show an engine system according to a first embodiment of the present invention.

The engine system shown in FIG. 1 comprises an engine 20, an intake system, an exhaust system, and an EGR system for returning part of the exhaust gas as EGR gas from the exhaust system to the intake system.

The intake system comprises a piping (or pipe arrangement or pipe system) for distributing intake air to cylinders of the engine 20. The intake piping of this example includes an intake manifold 21 and a throttle body (throttle chamber) 26 for defining an intake passage system for distributing the intake air to the engine cylinders. The exhaust system comprises an exhaust manifold 22 for carrying exhaust gas away from the cylinders of the engine 20.

The intake manifold 21 of this example includes an inlet pipe section 23, a collector section 24 of a predetermined volume extending from the inlet pipe section 23, and a set of branches 25 extending from the collector section 24 to the cylinders of the engine 20, respectively.

The throttle body 26 is connected with the intake manifold 21 on the upstream side of the inlet pipe section 23. The throttle body 26 and the inlet section 23 define an intake air passage for introducing the intake air to the collector section 24 of the intake manifold 21. The throttle body 26 has a throttle valve 27 therein. The throttle valve 27 is disposed in the intake air passage. On the downstream side of the throttle valve 27, a downstream passage section of the intake passage extends to the collector section 24.

The exhaust manifold 22 comprises a set of branches 28 extending respectively from the engine cylinders, and an exhaust pipe section 30 to which the branches 28 converge.

The EGR system comprises an EGR passage (external recirculation passage) 31 for exhaust gas recirculation. The EGR passage 31 branches off from the exhaust pipe section 30. As shown in FIG. 3, the EGR passage 31 of this example bifurcates into first and second branch passages 32 and 33 leading to the inlet pipe section 23 of the intake manifold 21 between the throttle valve 27 and the collector section 24. The EGR gas from the exhaust system flows into the intake flow in the intake air passage at a confluence point located in the downstream passage section downstream of the throttle valve 27 and upstream of the collector section 24.

The first branch passage 32 has a first introduction port 34 having a first EGR gas introduction opening which opens into the inlet pipe section 23 at a first EGR introduction position located in the rear of a downstream side free end 27*a* of the throttle valve 27 in a closed position. The second branch passage 33 has a second introduction port 35 having a second EGR gas introduction opening which opens in the intake pipe section 23 at a second EGR introduction position located in the rear of the position of an upstream side free end 27*b* of the throttle valve 27 in the closed position.

The inlet pipe section 23 of this example has a circular cross section as shown in FIG. 3. As viewed in FIG. 3, each of the first and second introduction ports 34 and 35 extends along a line tangent to the circle of the cross section of the inlet pipe section 23. The first and second introduction ports 34 and 35 are so arranged that the two inflow directions of the first and second introduction ports 34 and 35 are opposite to each other as shown in FIG. 3. The first and second introduction ports 34 and 35 are opened in a cross-flow manner (or counter flow manner) in the opposite directions. As shown in FIG. 2, each of the introduction ports 34 and 35 is inclined downstream so as to form a predetermined angle θ (lead angle) with respect to a fresh intake air flow direction in the inlet pipe section 23.

It is optional to arrange the introduction ports 34 and 35 so that the ports 34 and 35 extend from the opposite directions, respectively. In this case, the introduction port 34 extends from the left side of FIG. 3, and the introduction port 35 extends from the right.

Figure 4:
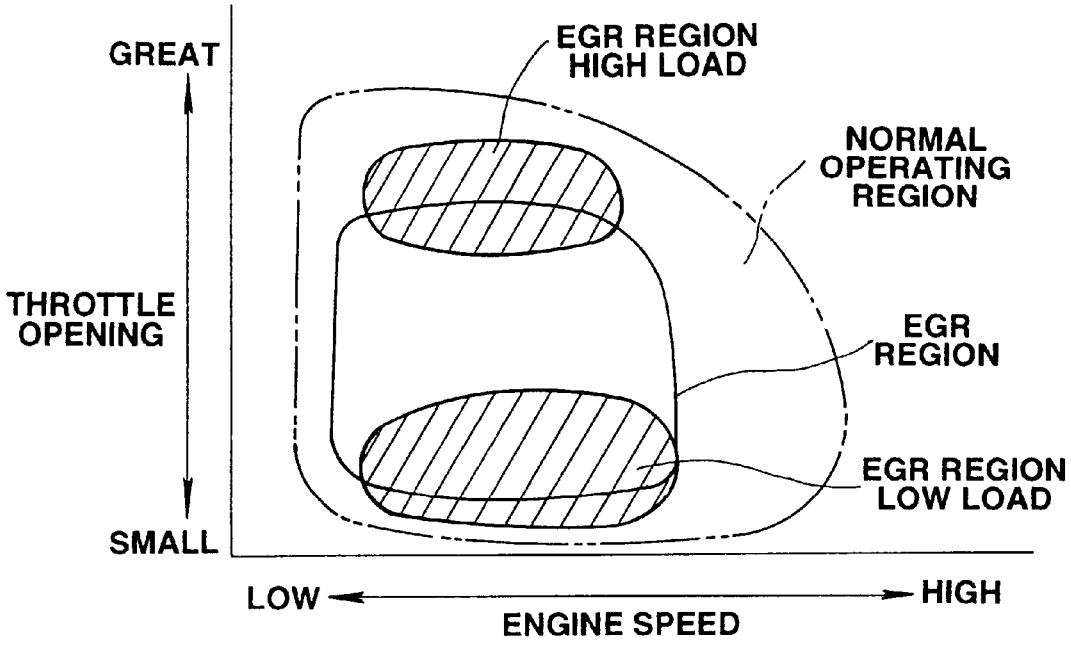
FIG. 4 is a graph showing an EGR region.

FIG. 4 shows a normal engine operating region and an EGR region in terms of the engine speed and the throttle opening degree. In the normal operating region, the region in which EGR is utilized is a region formed by excluding a high load region near full throttle and a low load region near idle condition.

Figure 5:
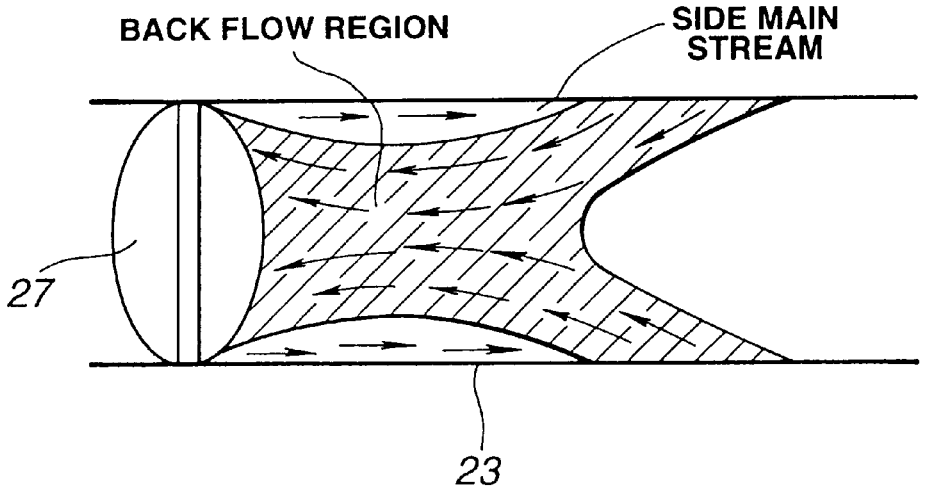
FIGS. 5 and 6 are views for illustrating streams on the downstream side of a throttle valve.
Figure 6:
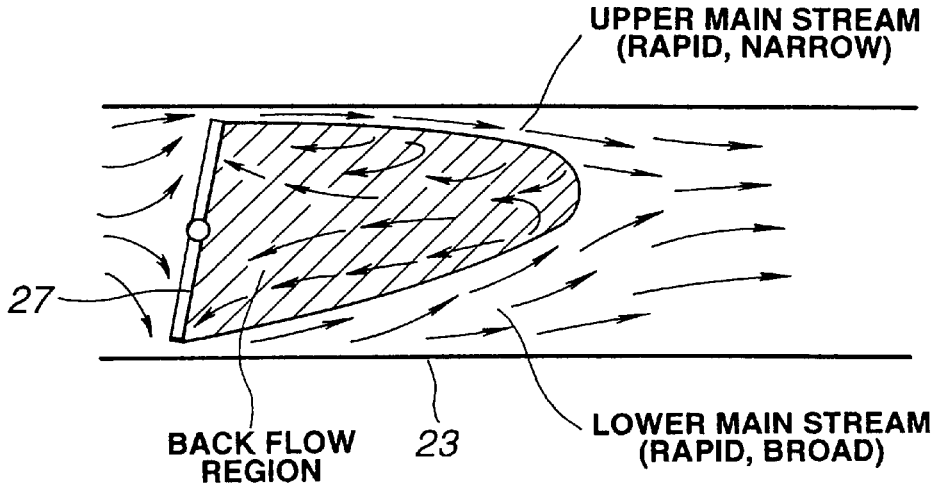
Figure 7:
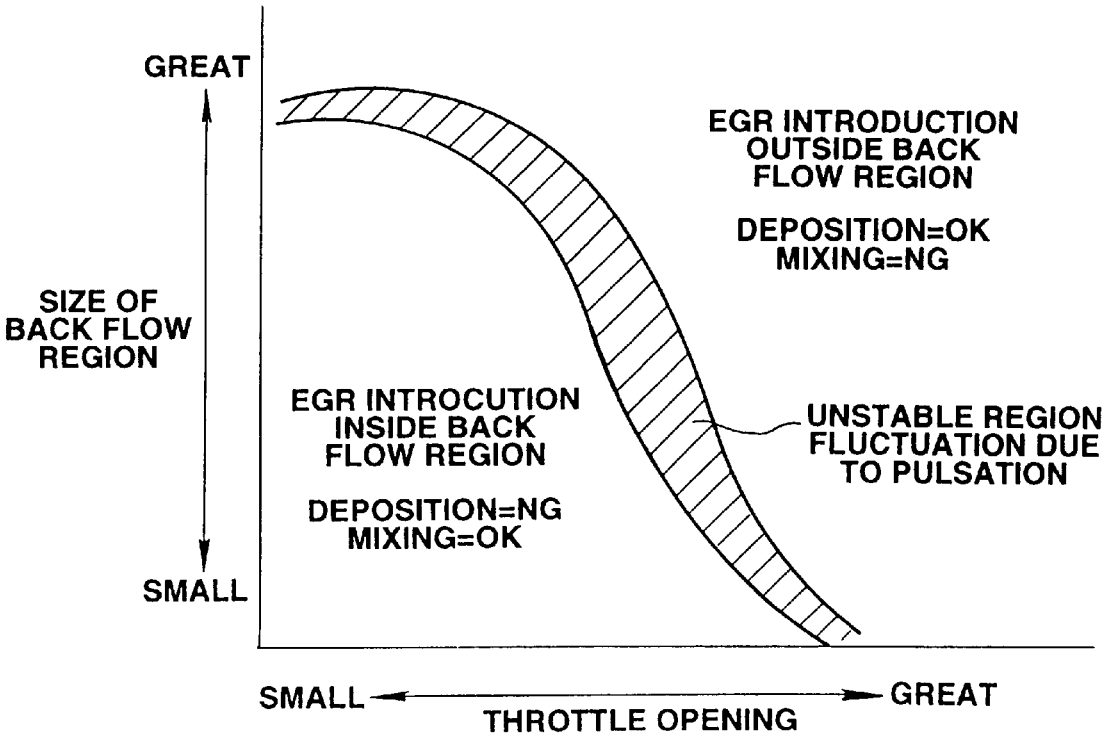
FIG. 7 is a graph showing a relation between a throttle opening and a back flow region.
Figure 8:
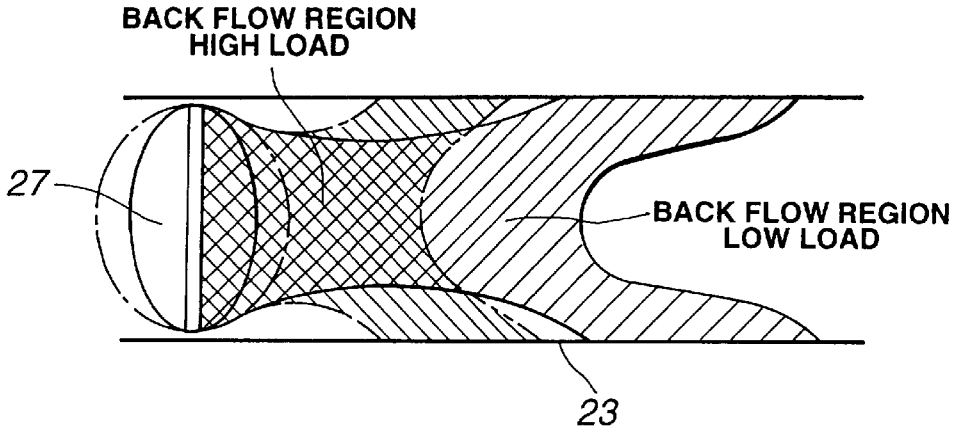
FIGS. 8 and 9 are views for illustrating extents of a back flow region under low load condition and high load condition.
Figure 9:
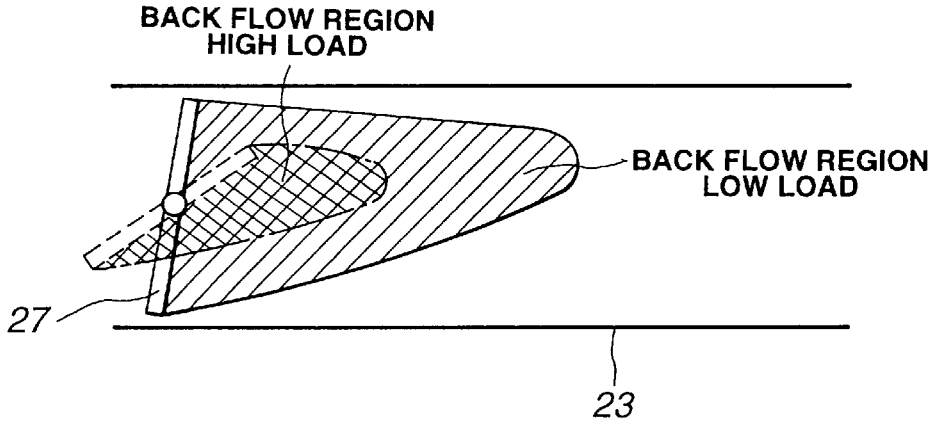

FIGS. 5 and 6 schematically show streams in the inlet pipe section 23 on the downstream side of the throttle valve 27, as viewed from a direction perpendicular to the axis of the throttle valve 27 and a direction parallel to the axis of the throttle valve 27. Through an open area between the throttle valve 27 and the inside wall surface of the intake air passage, main streams flow downstream toward the collector section 24. Behind the throttle valve 27, there appears a back flow region. The size of the back flow region varies in dependence on the opening degree of the throttle valve 27, as shown in FIG. 7. FIGS. 8 and 9 show forms of back flow streams in the high load operating region and the low load region. The back flow region grows larger when the opening degree of the throttle valve 27 is small.

The position of the EGR gas introduction point A exerts influence on streams in the inlet pipe section 23 as shown in FIGS. 10~14.

Figure 10:
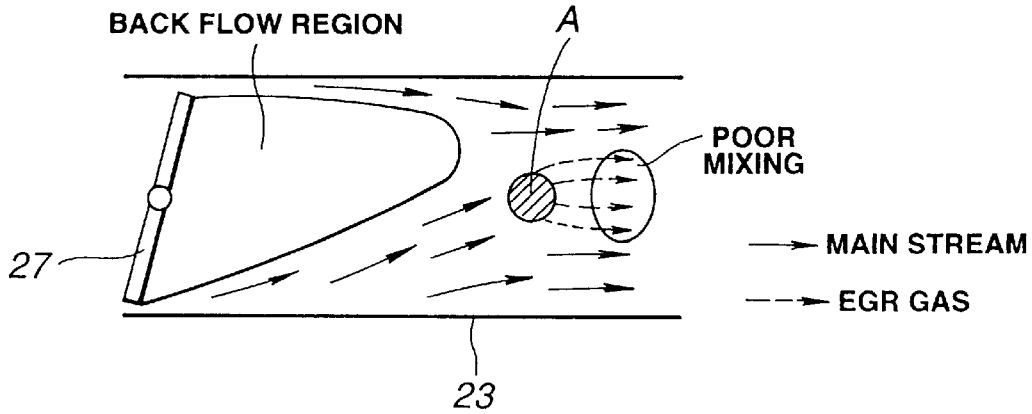
FIGS. 10~14 are views for illustrating EGR gas diffusion from various introduction positions.

In the example of FIG. 10, the EGR gas is introduced horizontally at a position downstream of the back flow region behind the throttle valve 27. In this case, the EGR gas is caught between upper main stream and lower main stream, respectively, from the free ends 27*a* and 27*b* of the throttle valve 27. Therefore, the EGR gas is carried away toward the collector section 24 quickly before diffusing enough. The EGR confluence position of FIG. 10 is advantageous to prevention of deposit but disadvantageous to mixing with fresh intake air.

Figure 11:
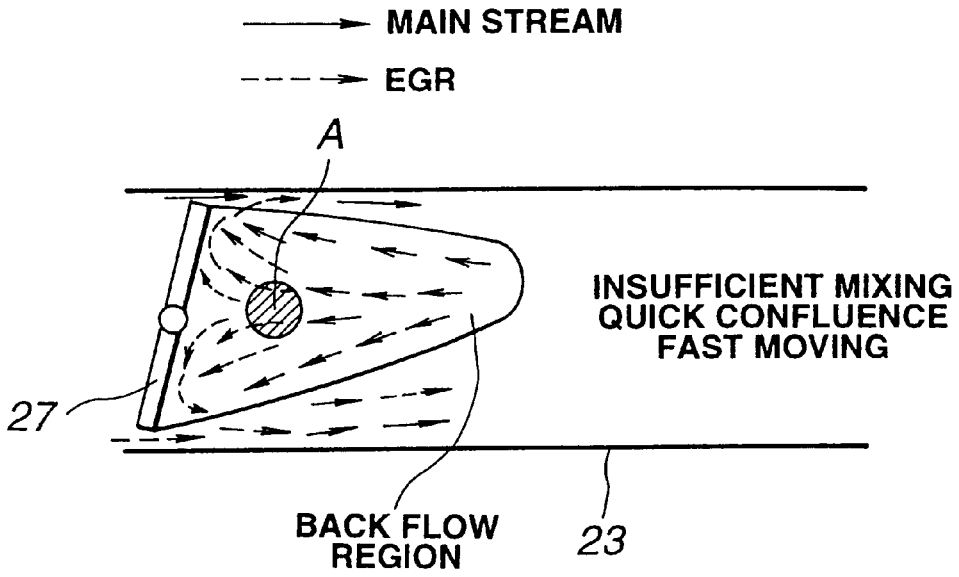

In the example of FIG. 11, the EGR gas is introduced horizontally into the back flow region near the throttle valve 27. The EGR gas is pushed backward by back flow streams and strikes directly against the throttle valve 27, causing undesired deposition.

Figure 12:
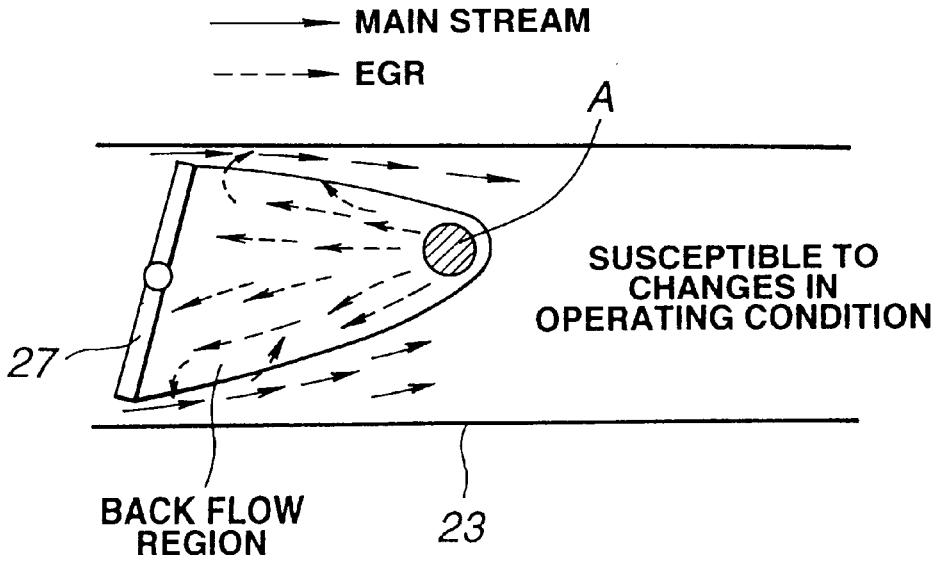

In the example of FIG. 12, the EGR gas is introduced horizontally at a position near the downstream end of the back flow region. Variation in the engine load condition caused by variation in the throttle opening exerts strong influence, and the mixing of the EGR gas with the fresh intake air and prevention of deposit can be both unstable. The instability is increased especially when the amount of EGR is increased.

Figure 13:
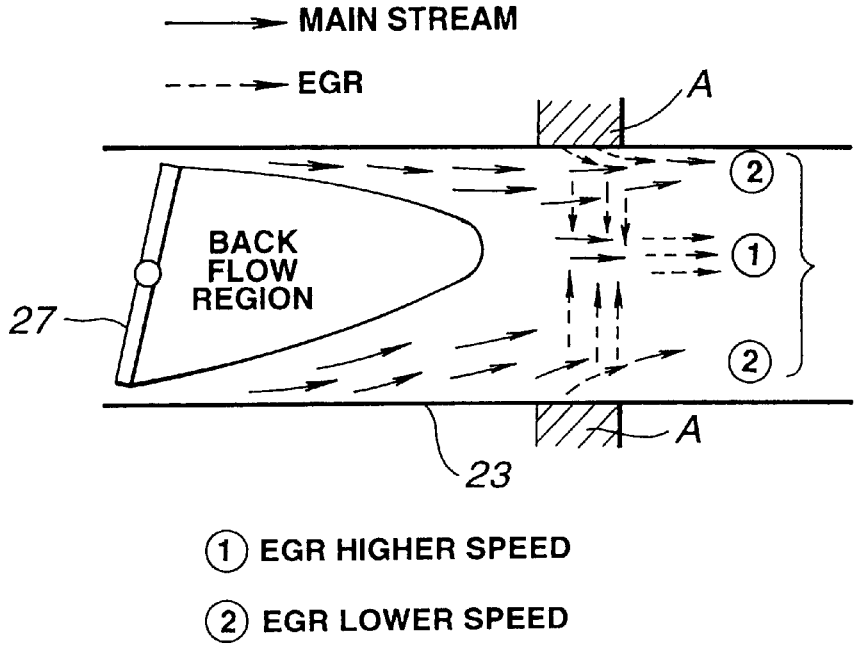
Figure 14:
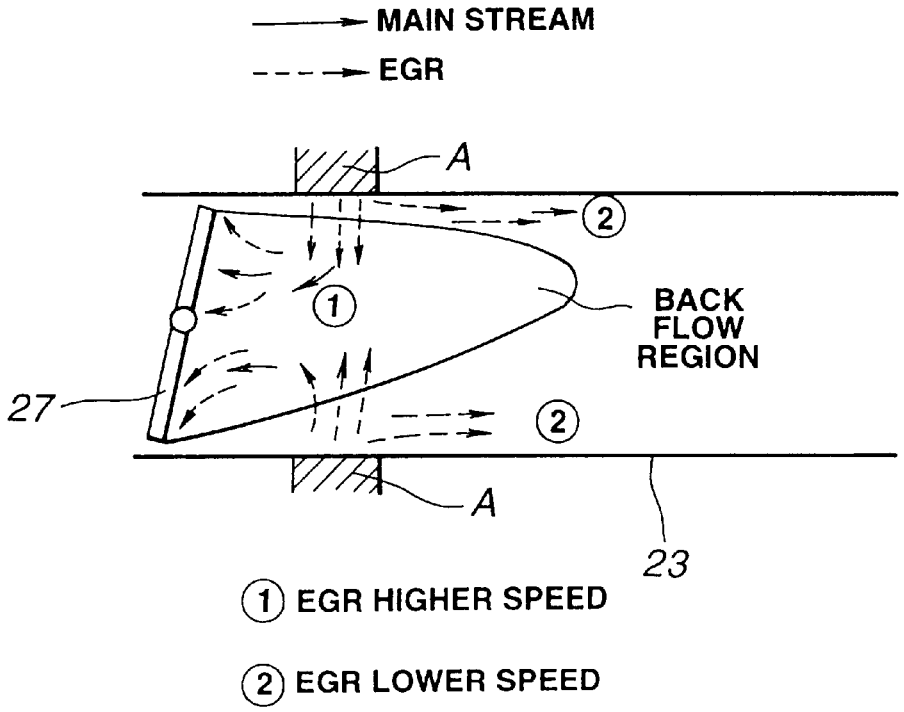

In the examples of FIGS. 13 and 14, the EGR gas is introduced vertically. The back flow region influences the performance in mixing of the EGR gas with the fresh intake air and the prevention of deposit in the same manner as in the examples of FIGS. 10 and 11. In the example of FIG. 13, the EGR gas forms a drift stream segregated from fresh intake air streams coming from the free ends of the throttle valve 27, without mingling with the fresh air streams. In the example of FIG. 14, the performance is affected by the flow speed of the EGR gas. When the EGR gas streams are fast and strong, the EGR streams vertically traverse the main streams, and increase undesired deposition. When the EGR gas streams are weak, the EGR gas forms segregated streams detrimental to the gas mixing.

FIG. 7 shows how the back flow region affects the mixing of the EGR gas with the fresh intake air and the formation of deposit.

From the above, the requirements for promoting the mixing of the EGR gas with the fresh intake air and preventing deposit are: i) to avoid the back flow region, ii) to increase a stay time of the EGR gas, iii) to mix the EGR gas into main streams of the fresh intake air from both free ends of the throttle valve 27.

To meet these requirements, the EGR system according to the present invention employs at least one EGR gas introduction port designed to produce a spiral flow mixing with fresh main streams (upper main stream and lower main stream) from the free ends 27*a* and 27*b* of the throttle valve 27.

Figure 15:
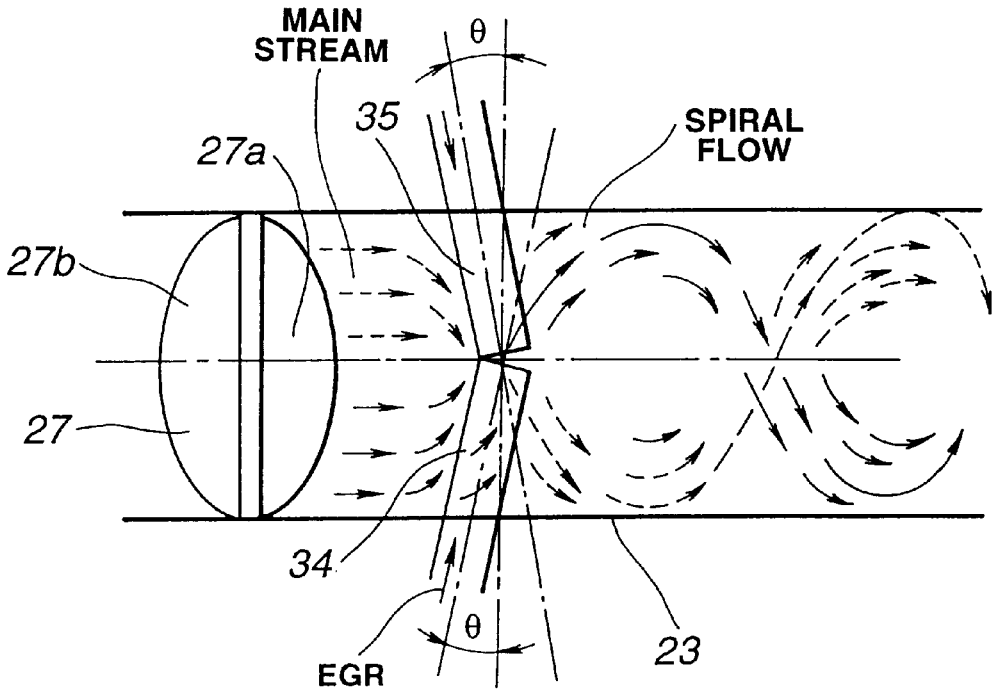
FIGS. 15, 16 and 17 are views for illustrating a spiral flow produced by the EGR introduction ports according to the first embodiment of the invention.
Figure 16:
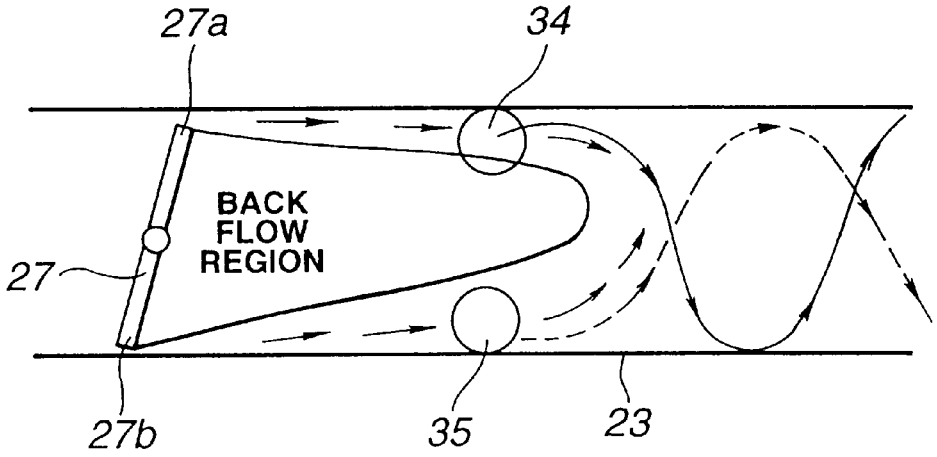
Figure 17:
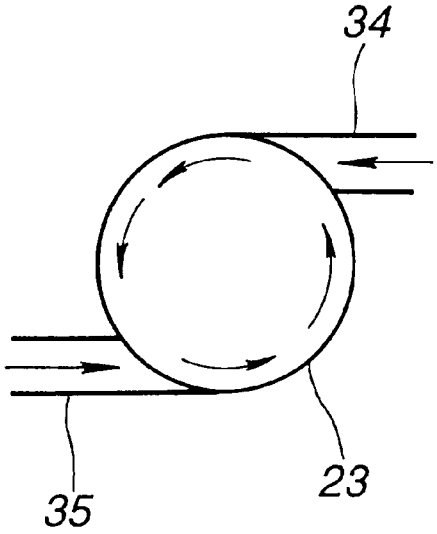

In the illustrated example, the first EGR gas confluence of the first introduction port 34 is located just in the rear of the downstream side free end 27*a* of the throttle valve 27 in the closed valve position, and the second EGR gas confluence of the second introduction port 35 is located just in the rear of the upstream side free end 27*b* of the throttle valve 27 in the closed valve position. Each introduction port 34 or 35 extends along a line tangent to the circular cross section of the inlet pipe section 23, and each introduction port 34 or 35 is inclined downstream so as to form a predetermined angle θ (lead angle) with respect to a fresh intake air flow direction in the inlet pipe section 23. Furthermore, the first and second introduction ports 34 and 35 are opened in a cross-flow manner (or counter flow manner) in the opposite directions. Therefore, the EGR gas is mixed with the fresh intake air outside the back flow region at a mixing position where the velocity of the fresh main stream is highest, and the EGR gas and the intake air form a spiral flow flowing helically on and near the cylindrical inside wall surface of the inlet pipe section 23 toward the collector section 24, as shown in FIGS. 15, 16 and 17.

Therefore, the EGR gas stays very long as compared with the conventional design. The main fresh intake air streams are involved into the spiral flow of the EGR gas, and the EGR gas diffuses from the outside toward the center of the inlet pipe section 23 in the process of the spiral flow. The EGR gas stays outside the back flow region, without causing deposit. The EGR system of this embodiment can mix the EGR gas with the intake air sufficiently, distribute the EGR gas uniformly among the cylinders, and prevent deposits efficiently.

Figure 18:
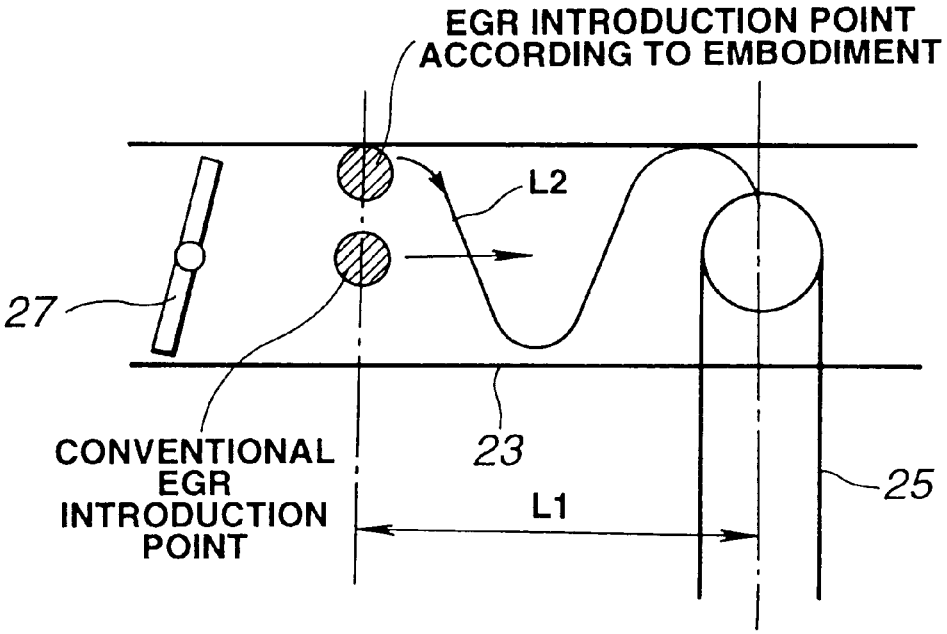
FIG. 18 is a view showing a travel distance of the EGR gas along a spiral path according to the first embodiment of the invention.
Figure 19:
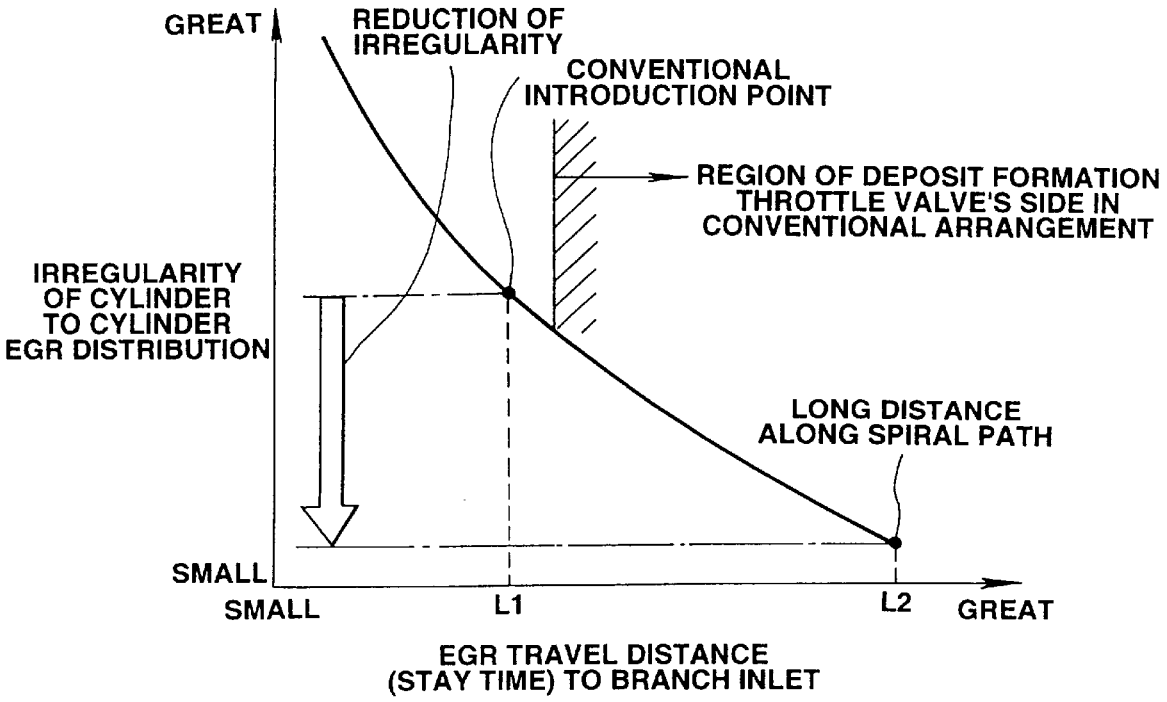
FIG. 19 is a graph for illustrating improvement in cylinder to cylinder EGR distribution by the spiral EGR path shown in FIG. 18.

As shown in FIG. 18, the distance L2 traveled by the EGR gas along the spiral flow path (corresponding to the stay time) to the inlet of the most upstream branch 25 is much longer than the distance L1 of the conventional straight path. As shown in FIG. 19, the degree of nonuniformity or irregularity in the EGR gas distribution among the cylinders is decreased by the increase in the EGR gas travel distance.

Figure 20A:
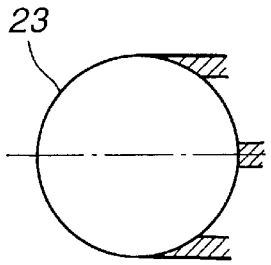
FIGS. 20A and 20B are schematic views for illustrating the EGR introductions positions according to the first embodiment.
Figure 20B:
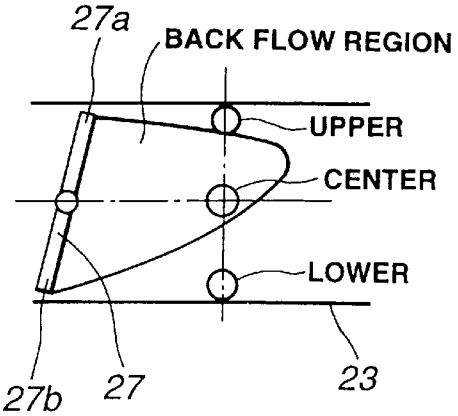
Figure 21:
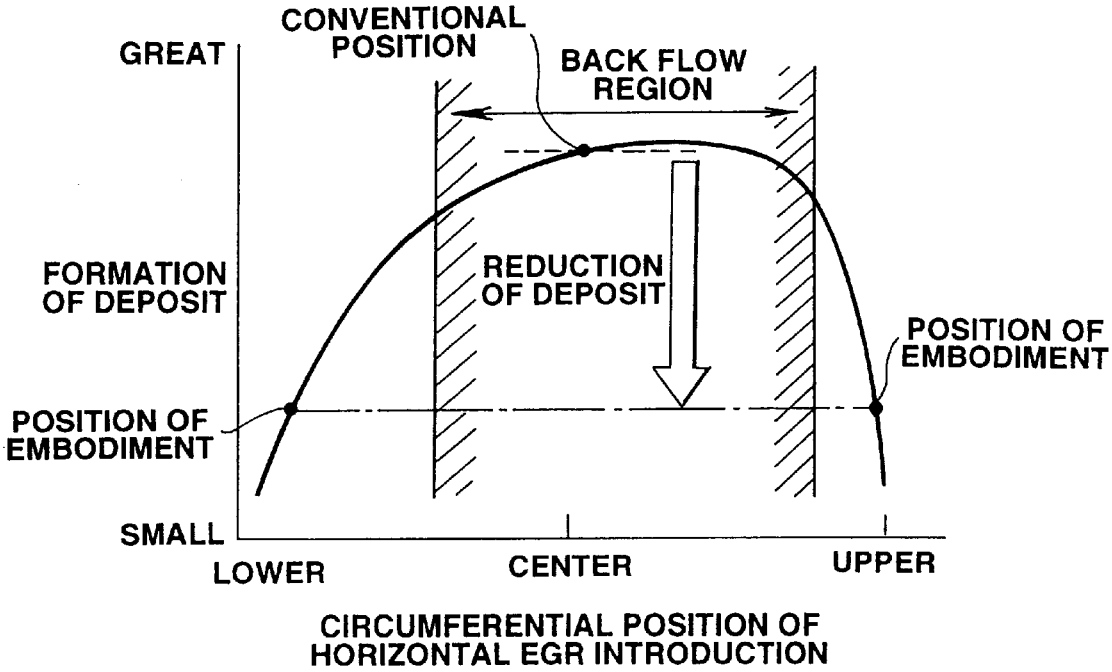
FIG. 21 is a graph for illustrating improvement in deposit prevention by the EGR introduction positions according to the first embodiment.

As shown in FIGS. 20A, 20B and 21, the upper and lower EGR introduction positions according to this embodiment can prevent the formation of deposits sufficiently as compared with the center EGR introduction position.

The engine system according to the first embodiment of the present invention can make the EGR rates of the cylinders uniform even when the amount of EGR is great, and thereby improve the fuel consumption and exhaust performance. Furthermore, the engine system according to this embodiment can ensure the accurate control of the intake air quantity by preventing deposits.

2nd Embodiment

Figure 22:
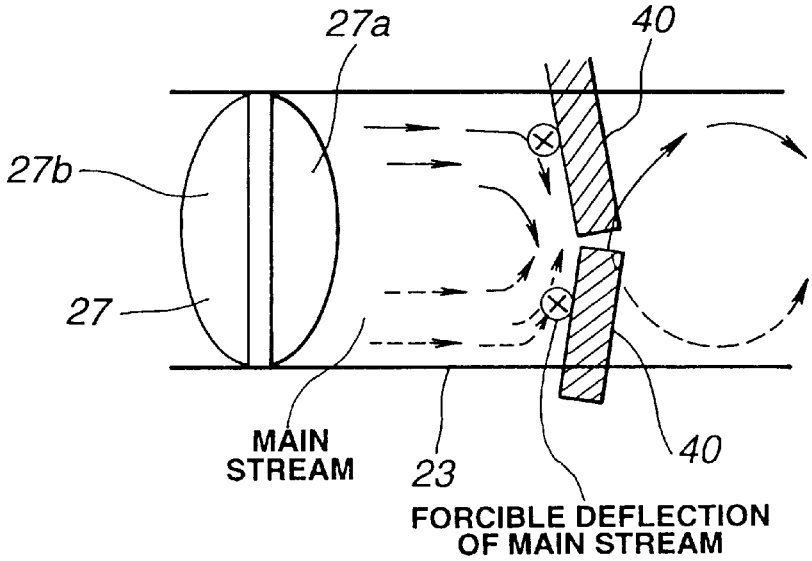
FIG. 22 is a schematic view showing gas introduction ports of an EGR system according to a second embodiment of the present invention.
Figure 23:
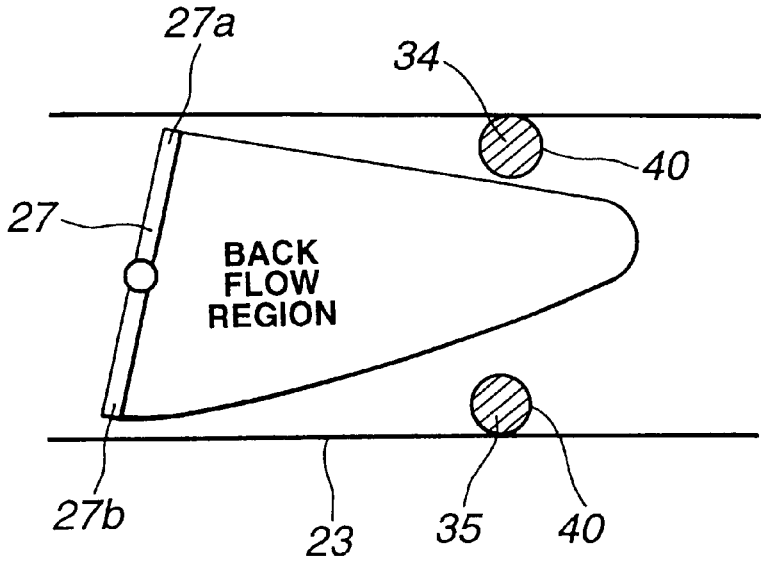
FIG. 23 is a schematic view showing the arrangement of the introduction ports according to the second embodiment.
Figure 24:
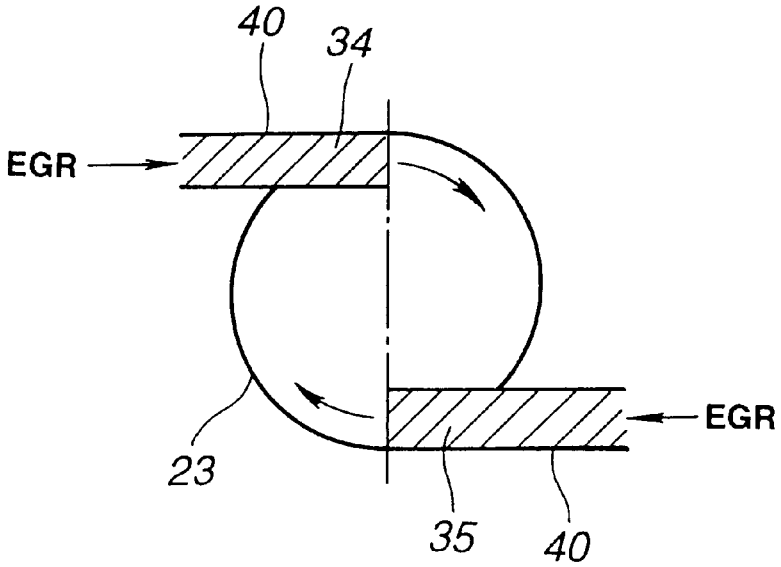
FIG. 24 is a schematic view showing the arrangement of the introduction ports according to the second embodiment.

FIGS. 22~24 show an EGR system according to a second embodiment of the present invention. Each of the EGR introduction ports 34 and 35 comprises a guide case 40 defining the EGR introduction opening. In this example, the guide case 40 of each introduction port is cylindrical, and projects into the inlet pipe section 23. In the example shown in FIG. 24, each introduction port has the EGR introduction opening in an imaginary plane containing the axis of the inlet pipe section 23. The axis of the throttle valve 27 is perpendicular to this plane.

The guide case 40 of each introduction port 34 or 35 is oriented to produce a spiral flow advancing downstream as in the first embodiment, and opened at the position to drag the upper or lower main intake stream into the spiral flow. The outside cylindrical surface of each guide case 40 exposed in the inside of the inlet pipe section 23 serves as a deflector for inducing and guiding the fresh intake air stream (upper main stream or lower main stream) to the direction of the spiral flow.

By using the inside and outside wall surfaces of the guide cases 40 for strengthening the spiral flow, the EGR system of the second embodiment can mix the EGR gas with the intake air sufficiently, distribute the EGR gas uniformly among the cylinders, and prevent deposits by causing the EGR gas to stay away from the back flow region.

3rd Embodiment

Figure 25:
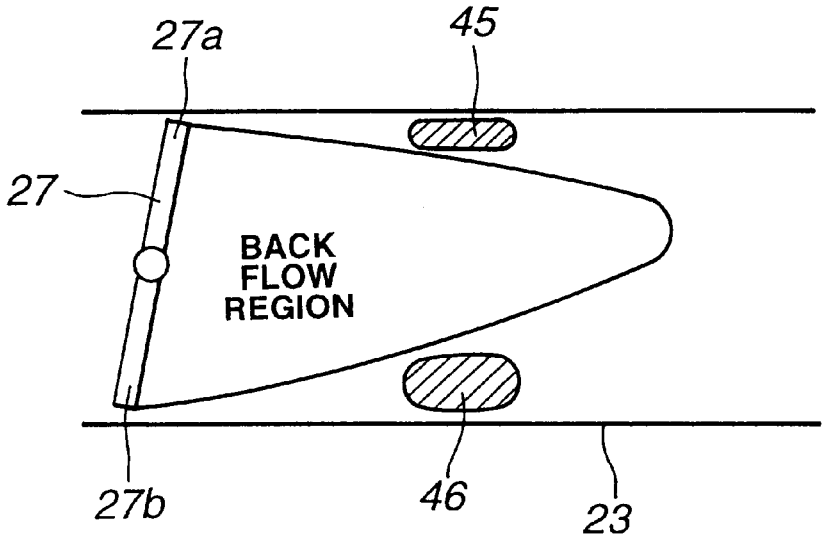
FIG. 25 is a schematic view showing gas introduction ports of an EGR system according to a third embodiment of the present invention.
Figure 26:
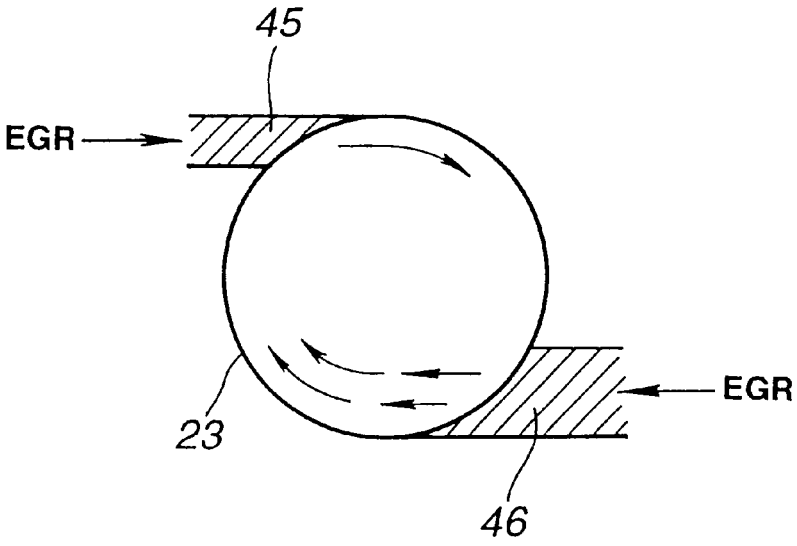
FIG. 26 is a schematic view showing the arrangement of the introduction ports according to the third embodiment.

FIGS. 25 and 26 show an EGR system according to a third embodiment of the present invention. In this embodiment, the gas introduction opening of each of introduction ports 45 and 46 is in the form of an elongated circle. The cross sectional shape of each of the introduction ports 45 and 46 is elongated along the longitudinal direction of the inlet pipe section 23, as shown in FIG. 25. In this example, the cross sectional size of the opening of the second introduction port 46 in the rear of the upstream side end 27*b* of the throttle valve 27 is greater than the cross sectional opening size of the first introduction port 45 in the rear of the downstream side valve end 27*a*.

The elongated openings of the first and second introduction ports 45 and 46 make it possible to decrease the distance between the throttle valve 27 and the EGR gas introduction position, and to increase the distance to the collector section 24 to the advantage of mixing of the EGR gas with the fresh intake air. The first EGR gas introduction port 45 is located on the side on which the region of the main fresh intake air stream is relatively narrow, and the second EGR gas introduction port 46 is located on the side on which the region of the main fresh intake air stream is relatively large. Therefore, the smaller introduction port 45 and the larger introduction port 46 can introduce the EGR gas efficiently, and keep the EGR gas outside of the back flow region.

4th Embodiment

Figure 27:
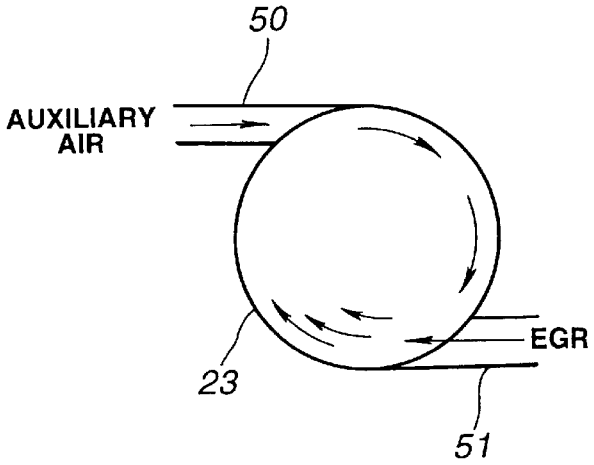
FIG. 27 is a schematic view showing gas introduction ports of an EGR system according to a fourth embodiment of the present invention.

FIG. 27 shows an EGR system according to a fourth embodiment of the present invention. In this embodiment, the EGR gas is introduced from an introduction port 51 located downstream of the upstream end 27*b* of the throttle valve 27 whereas an auxiliary air is introduced from an introduction port 50 downstream of the downstream end 27*a* of the throttle valve 27. The introduction ports 50 and 51 are directed and opened as in the preceding embodiments. In this embodiment, therefore, the introduction port 51 is connected with the exhaust system, and the introduction port 50 is connected with the intake system at a position upstream of the throttle valve 27. In this example, the introduction port 50 is connected with an air cleaner on the upstream side of the throttle valve 27.

The EGR system of this example can increase the strength of the spiral flow and mix the EGR gas uniformly. In this example, the introduction port 50 for the auxiliary air is located on the side on which the region of the main intake air stream is narrow. Therefore, this EGR system can prevent the EGR gas from entering the back flow region more efficiently, and prevent deposits from being produced.

5th Embodiment

Figure 28:
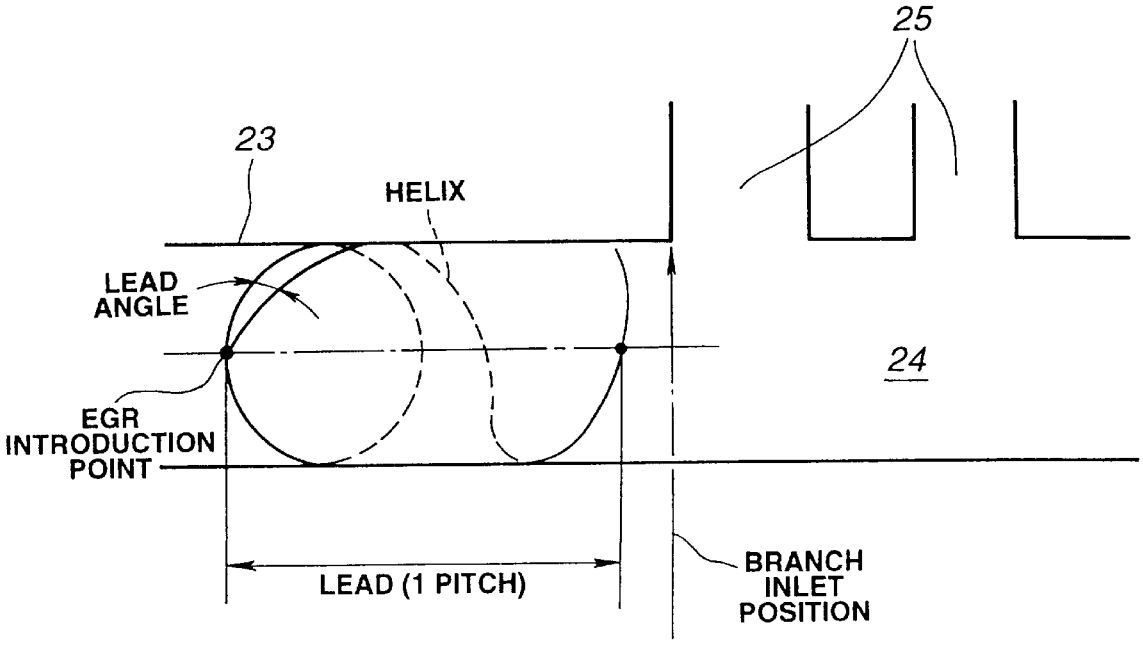
FIG. 28 is a schematic view showing an EGR introduction point according to a fifth embodiment of the present invention.

FIG. 28 shows an EGR system according to a fifth embodiment. The downstream inclination angle θ (lead angle) (as shown in FIG. 2) of each EGR gas introduction port is so determined that the distance from the EGR gas introduction position to the inlet of the most upstream branch 25 of the intake manifold 21 along the longitudinal center line of the inlet pipe section 23 is longer than one pitch (lead) of a helix defined by the angle θ, on the inside cylindrical surface of the inlet pipe section 23.

Therefore, this design makes sufficiently long the travel distance of the EGR gas along the spiral path from the EGR gas confluence to the inlet of the most upstream branch 25, and ensures the proper mixing of the EGR gas with the intake air.

6th Embodiment

Figure 29:
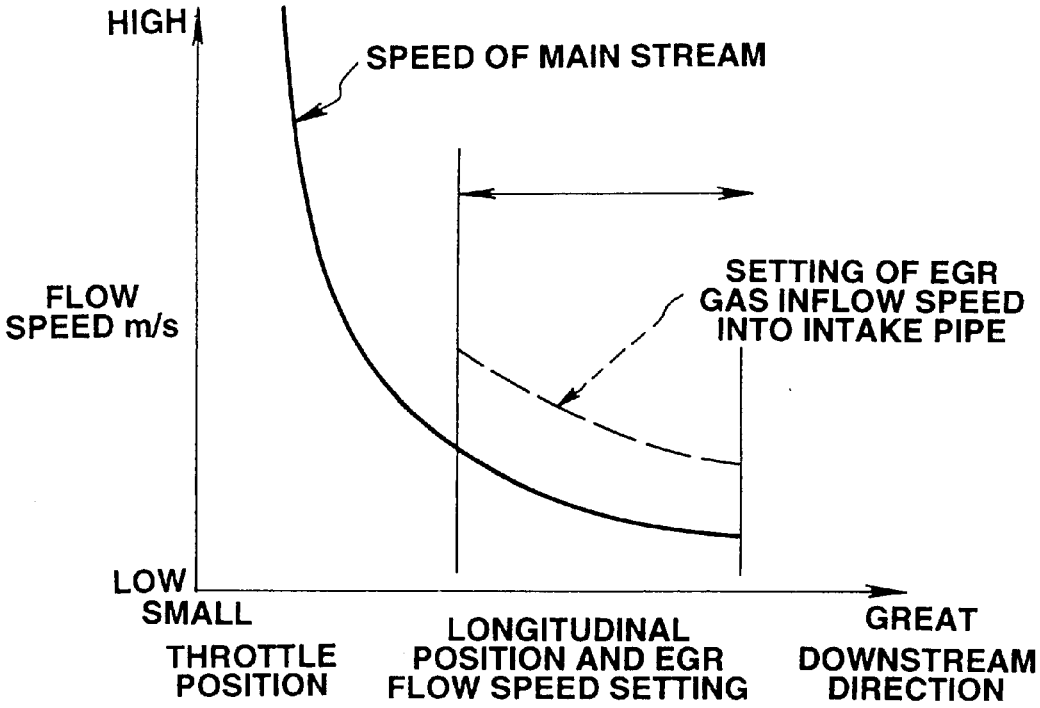
FIG. 29 is a graph showing factors to determine gas introduction ports of an EGR system according to a sixth embodiment of the present invention.

FIG. 29 is a graph for illustrating a sixth embodiment of the present invention. In this embodiment, the opening size (or opening area) of each of first and second EGR introduction ports 55 and 56 is determined in accordance with the maximum speed of the fresh intake air passing through the throttle valve 27, the distance between the axis of the throttle valve 27 and the openings of the gas introduction ports 55 and 56, and the EGR gas discharge speed (the speed of the EGR gas flowing into the inlet pipe section 23) modified by the shapes of the openings of the introduction ports 55 and 56.

As shown in FIG. 29, the speed of a fresh main stream decreases as the distance from the throttle valve 27 in the downstream direction increases. The opening sizes and shapes of the introduction ports 55 and 56 are so determined as to hold the discharge speed of the EGR gas from each introduction port 55 or 56 always high as compared with the speed of the main stream near the opening of the introduction port. The setting of the EGR inflow speed is higher than the fresh main stream speed, as shown in FIG. 29.

Figure 30:
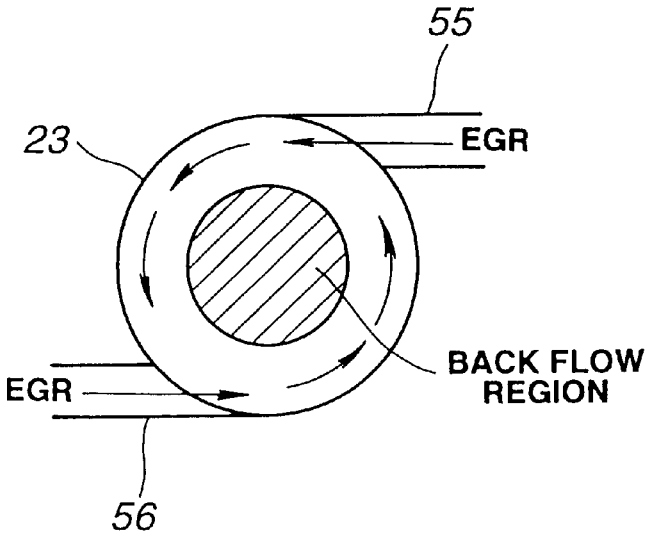
FIGS. 30 and 31 are views for illustrating effect of the gas introduction ports according to the sixth embodiment.
Figure 31:
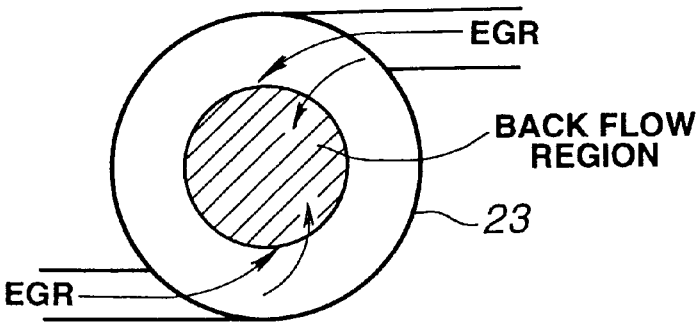

Therefore, each of the introduction ports 55 and 56 flows the EGR gas into the inlet pipe section 23 at such a sufficient velocity to produce a strong spiral flow as shown in FIG. 30, instead of losing its speed by collision with the main stream as shown in FIG. 31. The EGR gas flows along the spiral path without turning inside toward the center of the inlet pipe section 23, and stays away from the back flow region without causing deposits. The higher speed EGR flow of FIG. 30 can prevent deposits and mix the EGR gas efficiently.

7th Embodiment

Figure 32:
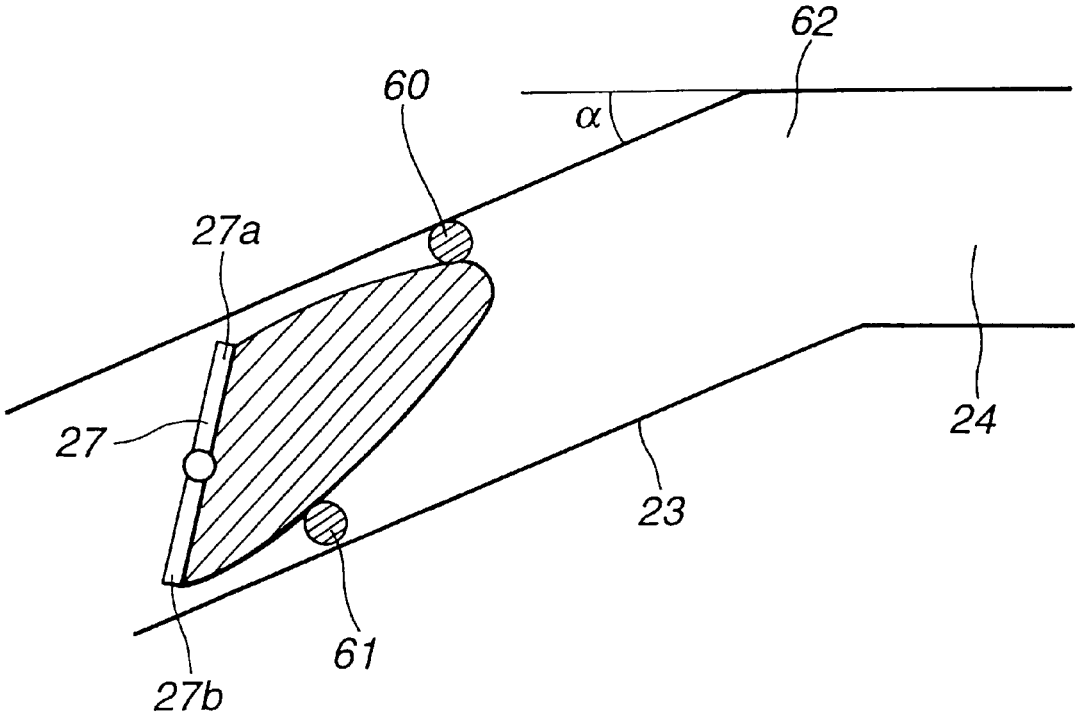
FIG. 32 is a schematic view showing introduction ports of an EGR system according to a seventh embodiment of the present invention.

FIG. 32 shows a part of an engine system according to a seventh embodiment of the present invention. The intake passage defined by the inlet pipe section 23 and the throttle body 26 is inclined with respect to the longitudinal direction of the collector section 24 to form a bend 62 of an angle $\alpha$ in an imaginary plane to which the axis of the throttle valve 27 is perpendicular. In this embodiment, the positions of the openings of first and second introduction ports 60 and 61 are adjusted in accordance with the bend angle $\alpha$.

In the example shown in FIG. 32, the longitudinal center line of the intake air passage is bend downward with respect to the longitudinal direction of the collector section 24, so that the upstream side end 27*b* of the throttle valve 27 is located on the inner side of the bend 62. In this case, the gas introduction position of the introduction port 61 located downstream of the upstream free end 27*b* of the throttle valve on the inner side of the bend 62 is shifted downstream slightly, and the gas introduction position of the introduction port 60 located downstream of the downstream free end 27*a* of the throttle valve on the outer side of the bend 62 is shifted downstream to a greater extent in accordance with the downward bend angle. As a result, the longitudinal distance along the longitudinal direction of the inlet pipe section 23 from the axis of the throttle valve 27 to the confluence point of the port 60 on the outer side of the bend 62 is greater than the longitudinal distance from the axis of the throttle valve 27 to the confluence point of the port 61 on the inner side of the bend 62.

Figure 33:
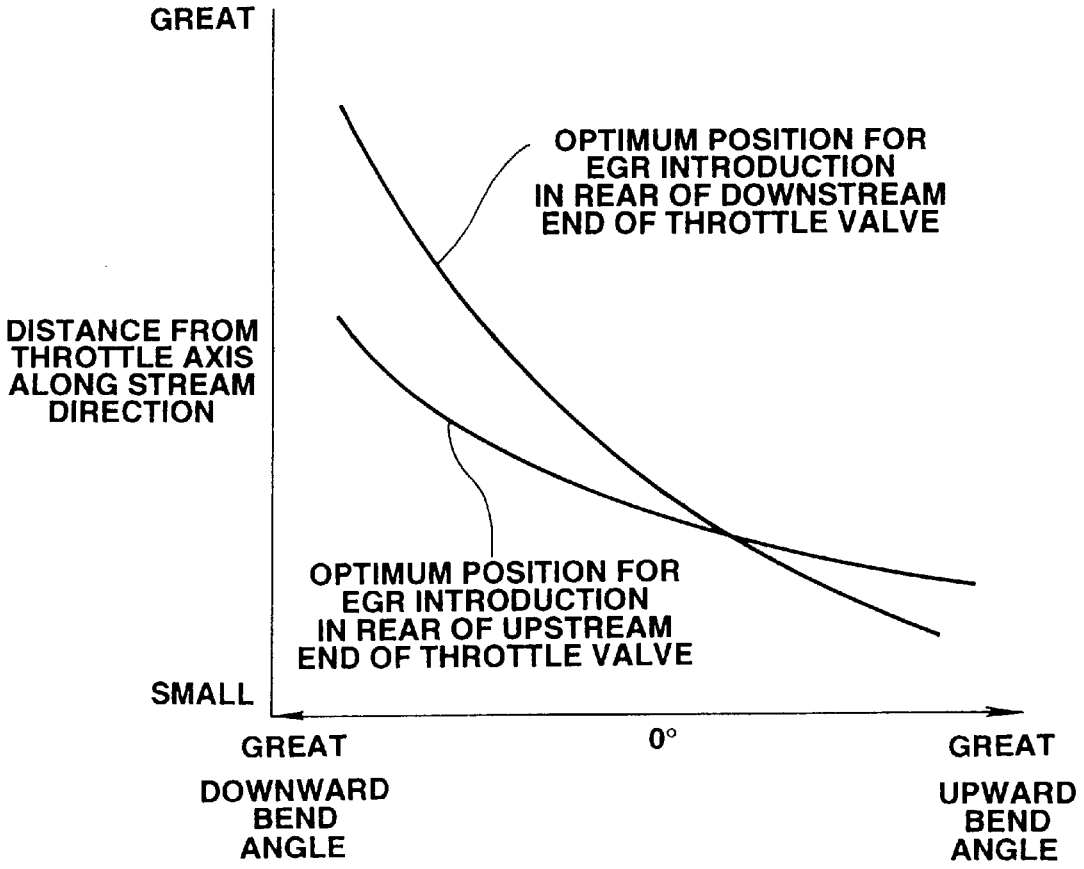
FIG. 33 is a graph for illustrating EGR introduction points according to the seventh embodiment.

When the longitudinal center line of the intake air passage is bend upward with respect to the longitudinal direction along which the collector section 24 extends, so that the downstream side end 27*a* of the throttle valve 27 is located on the inner side of a bend, then the EGR introduction confluence position of the introduction port 60 located downstream of the downstream free end 27*a* of the throttle valve on the inner side of the bend is shifted upstream in accordance with the upward bend angle, and the confluence position of the introduction port 61 located downstream of the upstream free end 27*b* of the throttle valve 27 on the outer side of the bend 62 is shifted upstream to a smaller extent as shown in FIG. 33.

When the inlet pipe section 32 has a downward bend as shown in FIG. 32, the back flow region tends to shift toward the outer side of the bend. Therefore, the EGR introduction confluence positions of the ports 60 and 61 are shifted downstream so that the confluence point of the port 60 is shifted away from the back flow region. When the inlet pipe section has an upward bend, the back flow region shifts toward the center of the inlet pipe section 23. In this case, the confluence positions of the ports 60 and 61 are shifted upstream to increase the travel distance of the EGR gas.

The introduction ports 60 and 61 are thus opened at optimum positions in conformity with the form of the back flow region. Therefore, the design of this embodiment can mix the EGR gas efficiently, and prevent deposits.

As shown in FIG. 3, the swing axis of the throttle valve 27 according to each of the preceding embodiments of the present invention extends in an imaginary first center plane C1. An imaginary second center plane C2 intersects the first center plane C1 at right angles along the center line of the cylindrical inlet pipe section 23. The inlet pipe section 23 in the illustrated examples is straight, and in the form of a hollow right circular cylinder. First and second imaginary tangent planes T1 and T2 are parallel to the first center plane C1, and tangent to the cylindrical inside wall surface of the inlet pipe section 23 on opposite sides of the first center plane C1. Third and fourth imaginary tangent planes T3 and T4 are parallel to the second center plane C2, and tangent to the cylindrical inside wall surface of the inlet pipe section 23 on opposite sides of the second center plane C2. In FIG. 2, an imaginary cross sectional plane S is a plane to which the center line of the inlet pipe section 23 is perpendicular, and the axis of the throttle valve 27 is parallel.

In the example shown in FIGS. 2 and 3, the first introduction port 34 extends alongside the first tangent plane T1 from a first side (right side) of the second center plane C2, and opens toward the fourth tangent plane T4. The second introduction port 33 extends alongside the second tangent plane T2 from a second side (left side) of the second center plane C2, and opens toward the third tangent plane T3.

Each of the first and second introduction ports 34 and 35 of this example is circular in cross section. The cylindrical inside wall surface of the first introduction port 34 contains one straight line which lies on the first tangent plane T1 and which is tangent to the cylindrical inside wall surface of the inlet pipe section 23 at a point shown at M1 in FIG. 3. The cylindrical inside wall surface of the second introduction port 35 contains one straight line which lies on the second tangent plane T2 and which is tangent to the cylindrical inside wall surface of the inlet pipe section 23 at a point shown at M2 in FIG. 3. The longitudinal direction of each introduction port 34 and 35 forms the angle $\theta$ with the cross sectional plane S as shown in FIG. 2. The first and second introduction ports 34 and 35 are inclined from the cross sectional plane S in a such a direction as to produce a spiral flow advancing downstream toward the collector section 24. The spiral flow direction produced by the first introduction port 34 is the same as that of the second introduction port 35. In the example of FIG. 3, the spiral flow is in the counterclockwise direction.

8th Embodiment

Figure 34:
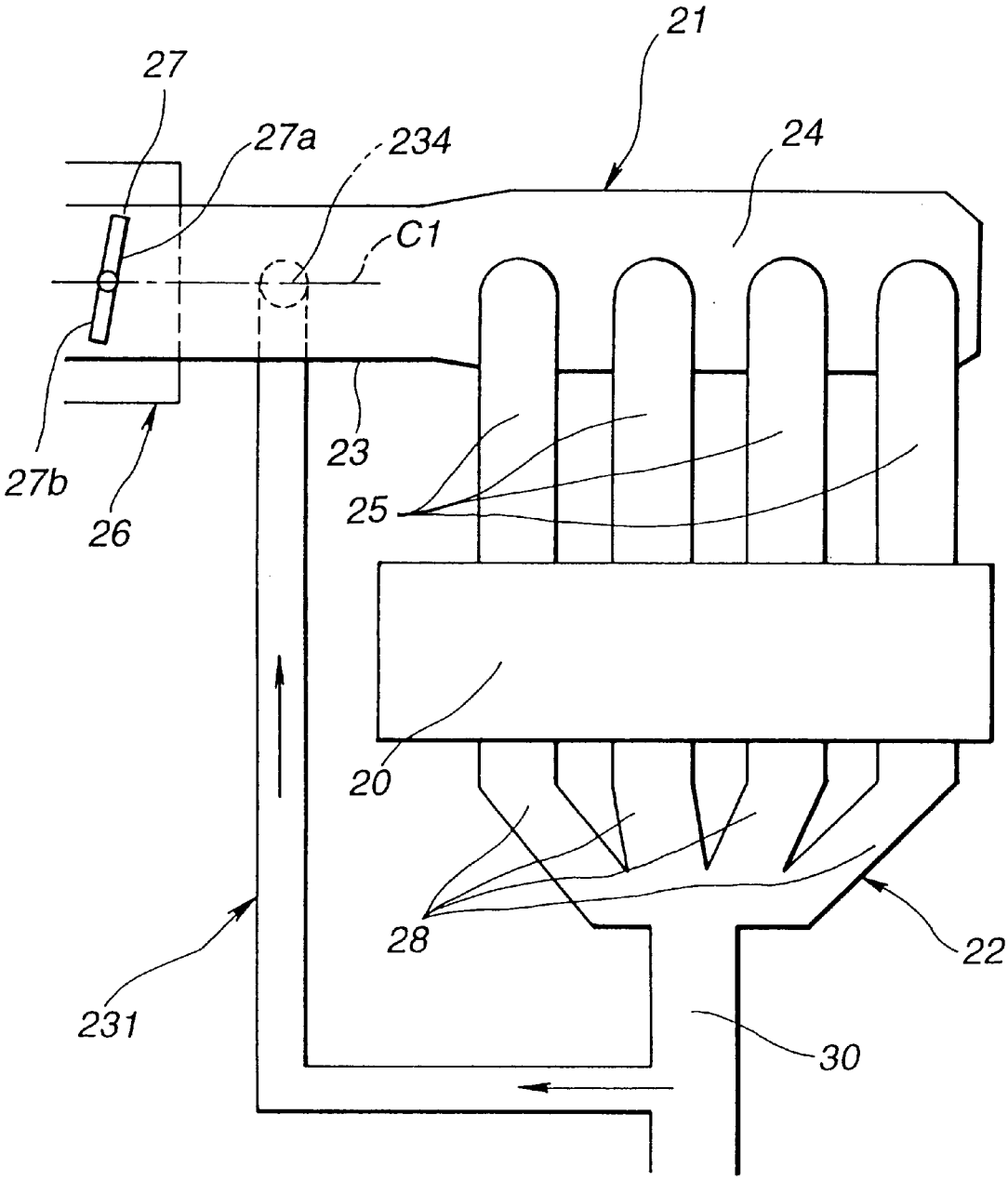
FIG. 34 is a schematic view showing an engine system according to an eighth embodiment.
Figure 35:
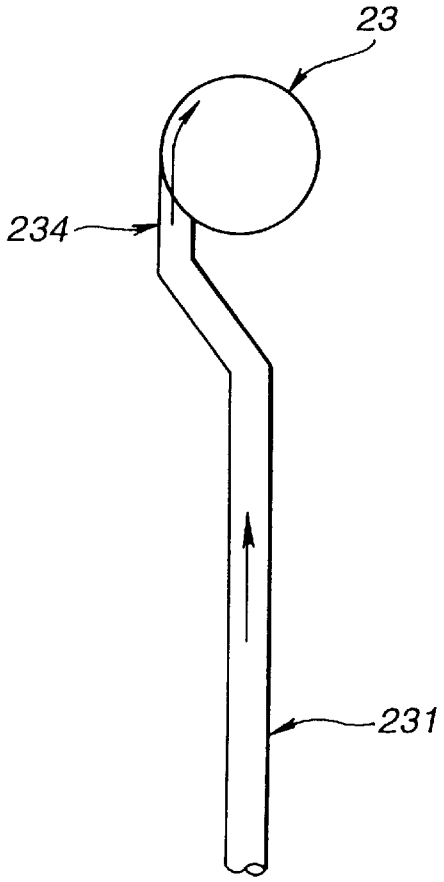
FIG. 35 is a view showing an arrangement of an EGR introduction opening of the engine system of FIG. 34.

FIGS. 34 and 35 show an engine system according to an eighth embodiment of the present invention. The intake and exhaust systems for an internal combustion engine 20 shown in FIG. 34 are substantially identical to the systems shown in FIG. 1.

The EGR system comprises an EGR passage (external recirculation passage) 231 for exhaust gas recirculation. The EGR passage 231 branches off from the exhaust pipe section 30. As shown in FIG. 35, the EGR passage 31 of this example extends, without bifurcation (as distinct from the EGR passage 31 of FIG. 1), to the inlet pipe section 23 of the intake manifold 21 between the throttle valve 27 and the collector section 24. The EGR gas from the exhaust system flows into the intake flow in the intake air passage at a confluence point located in the rear of the throttle valve 27 in the downstream passage section downstream of the throttle valve 27 and upstream of the collector section 24.

Figure 36:
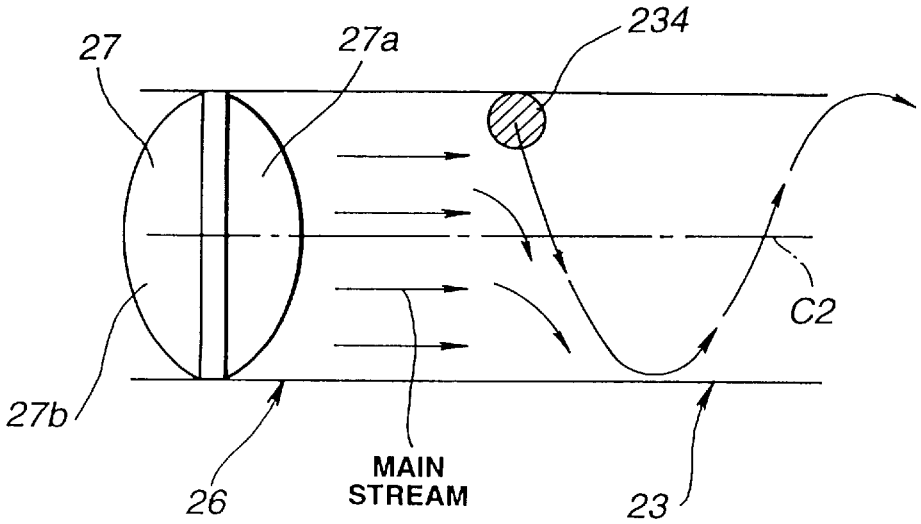
FIG. 36 is a schematic longitudinal sectional view for illustrating an EGR stream from the EGR introduction opening of FIG. 35.

The EGR passage 231 has a single EGR introduction port 234 having an EGR gas introduction opening which opens into the inlet pipe section 23 at a single EGR introduction point. The EGR introduction port 234 opens from a tangential direction of a section of the inlet pipe section 23. In this embodiment, no limitation is imposed on the circumferential position of the opening of the EGR introduction port 234 along the circumferential direction of the inlet pipe section 23. The opening of the EGR introduction port 234 may be located in the rear of one bearing point for swingably supporting the throttle valve 27 as shown in FIG. 36.

Figure 37:
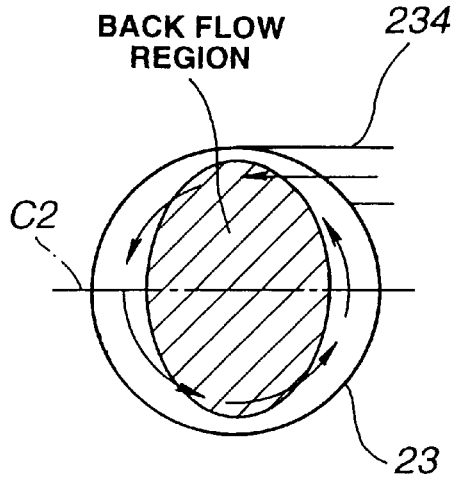
FIG. 37 is a schematic cross sectional view for illustrating the EGR stream from the EGR introduction opening of FIG. 35.

To meet the before-mentioned three requirements, i.e. i) to avoid the back flow region, ii) to increase a stay time of the EGR gas, iii) to mix the EGR gas into main streams of the fresh intake air from the free swing ends of the throttle valve 27, the EGR system according to the eighth embodiment employs the single EGR gas introduction port 234 directed to introduce the EGR gas concentratedly along such a tangential direction as to produce a circumferential stream flowing circumferentially on and along the inside cylindrical surface of the inlet pipe section 23 around a central back flow region in the inlet pipe section 23, as shown in FIG. 37. The EGR gas stream thus introduced into the inlet pipe section 23 is pushed downstream by the fresh (upper and lower) main streams flowing from the free swing ends 27*a* and 27*b* of the throttle valve 27. Therefore, the EGR gas stream produces a spiral flow flowing helically around the central zone, on and along the inside cylindrical surface of the inlet pipe section 23 toward the collector section 24, as shown in FIG. 36, so that the EGR gas mixes with the fresh intake air effectively.

The spiral path prolongs the stay time of the EGR gas. The EGR gas diffuses from the circumferential annular region gradually into the central region in the process of the spiral flow advancing downstream. The EGR system according to the eighth embodiment can also mix the EGR gas with the fresh intake air sufficiently, and distribute the EGR gas uniformly among the cylinders with no or little segregation.

The tangential introduction of the EGR gas reduces the deposit formation on the throttle valve 27 by minimizing an amount of the EGR gas flowing directly into the central back flow region.

Figure 38:
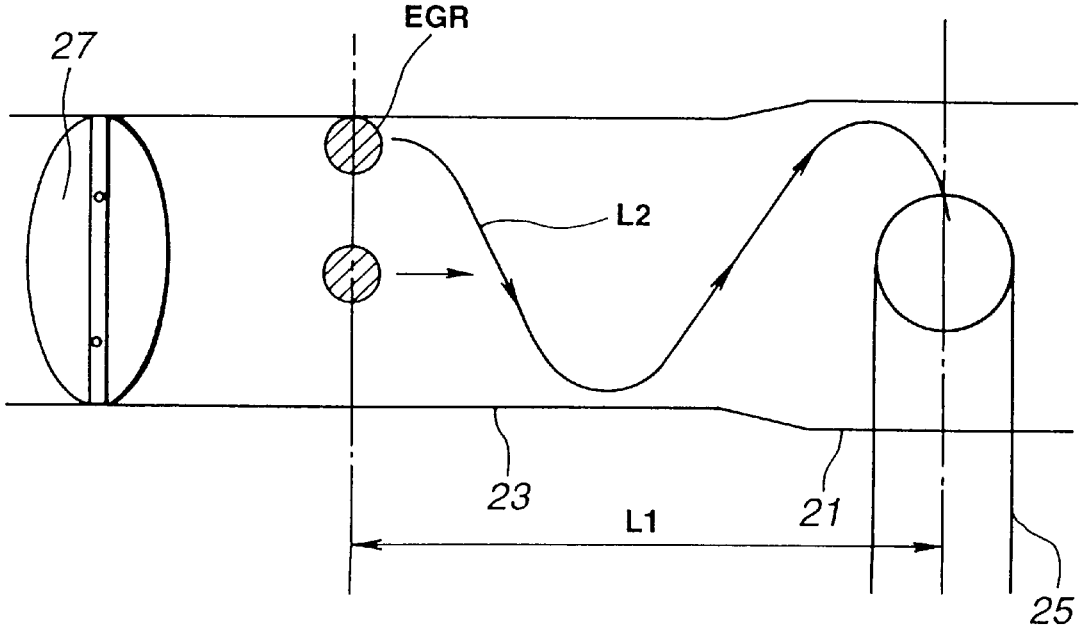
FIG. 38 is a schematic horizontal longitudinal sectional view for illustrating a travel distance of the EGR gas discharged from the EGR introduction opening of FIG. 35. (The term "horizontal" means that the section is parallel to, or coincident with, the swing axis of the throttle valve.)

As shown in FIG. 38, the distance L2 traveled by the EGR gas along the spiral flow path (corresponding to the stay time) to the inlet of the most upstream branch 25 is much longer than the distance L1 of the conventional straight path. The remarkable prolongation of the traveled distance of the EGR gas helps the mixing of the EGR gas with the fresh intake air, and sufficiently reduces the degree of nonuniformity or irregularity in the EGR gas distribution among the cylinders in the same manner as shown in FIG. 19.

Figure 39A:
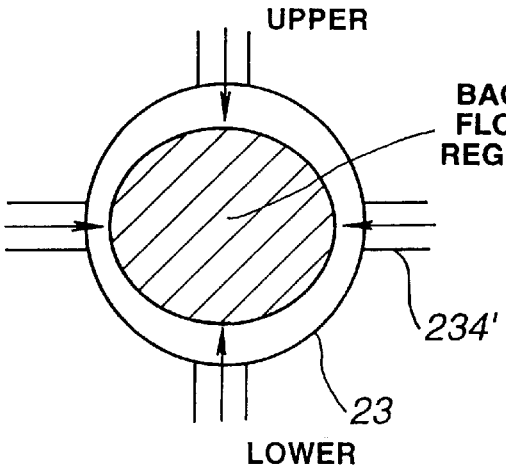
FIGS. 39A and 39B are schematic cross sectional views for showing a radial (or centripetal) EGR introduction mode and a tangential EGR introduction mode for comparison.
Figure 39B:
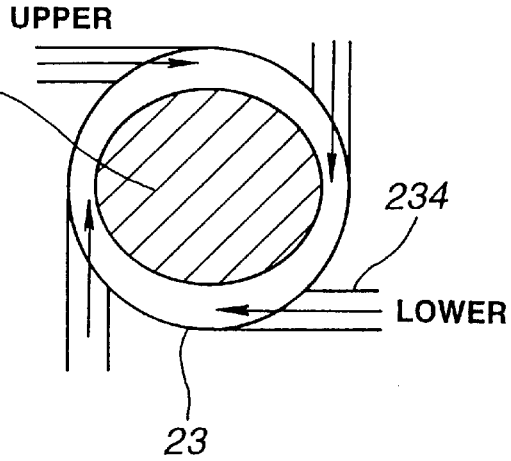
Figure 40:
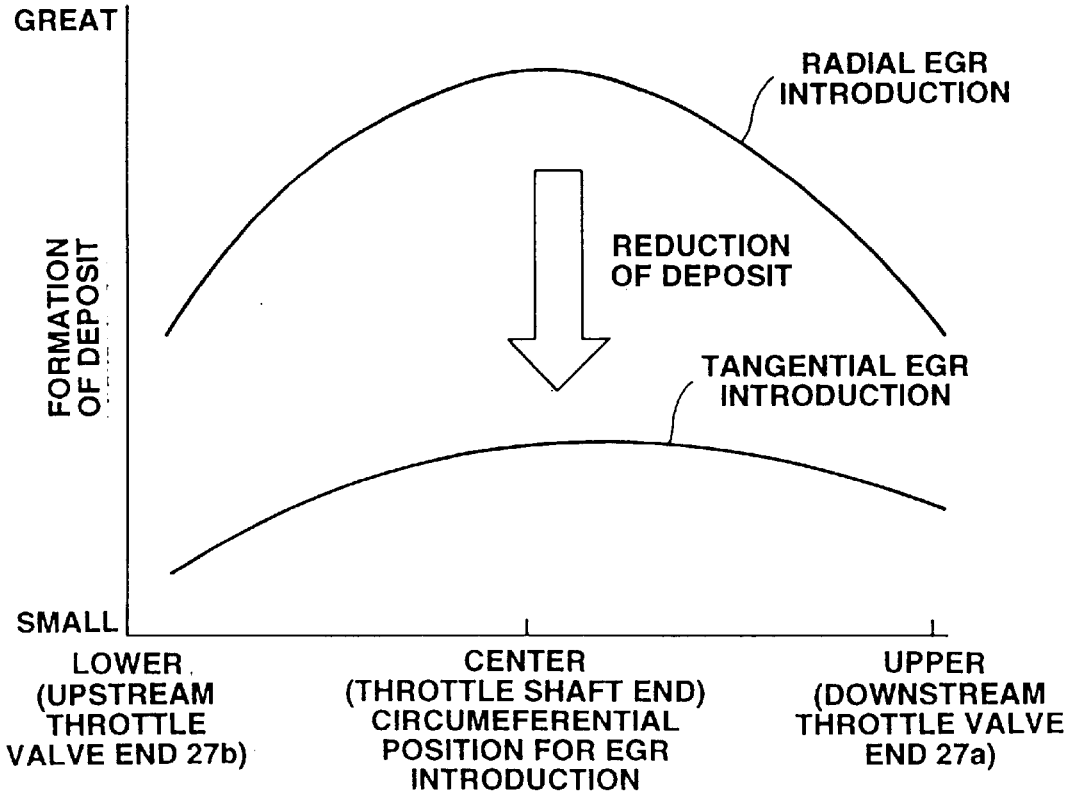
FIG. 40 is a graph for showing deposit formation in the radial EGR introduction mode and the tangential EGR introduction mode for comparison.

The tangential EGR gas introduction shown in FIG. 39B contributes greatly to the reduction of the deposit formation, as compared to the radial introduction shown in FIG. 39A. In the radial arrangement of FIG. 39A, the EGR gas is injected radially inwardly and readily brought into the central back flow region through a minimum distance. By contrast, the tangential introduction of FIG. 39B forces the EGR gas to flow circumferentially around the central back flow region, and the inside cylindrical surface of the inlet pipe section 23 guides the circumferential stream around the central back flow region. The tangential EGR introduction at any circumferential position significantly reduces the amount of the deposit formation on the throttle valve 27 as shown in FIG. 40.

The engine system according to the eighth embodiment of the present invention can make the EGR rates of the cylinders uniform even when the amount of EGR is great, and thereby improve the fuel consumption and exhaust performance. Furthermore, the engine system according to the eighth embodiment can ensure the accurate control of the intake air quantity by preventing deposits.

In the eighth embodiment, it is easy to orient the EGR introduction port 234 so that the EGR introduction port 234 opens downwards along the vertical direction. The tangential EGR introduction port 234 directed downwards can prevent accumulation of water in the EGR passage 231 by condensation and aggregation of moisture in the EGR gas after stoppage of the engine.

9th Embodiment

Figure 41:
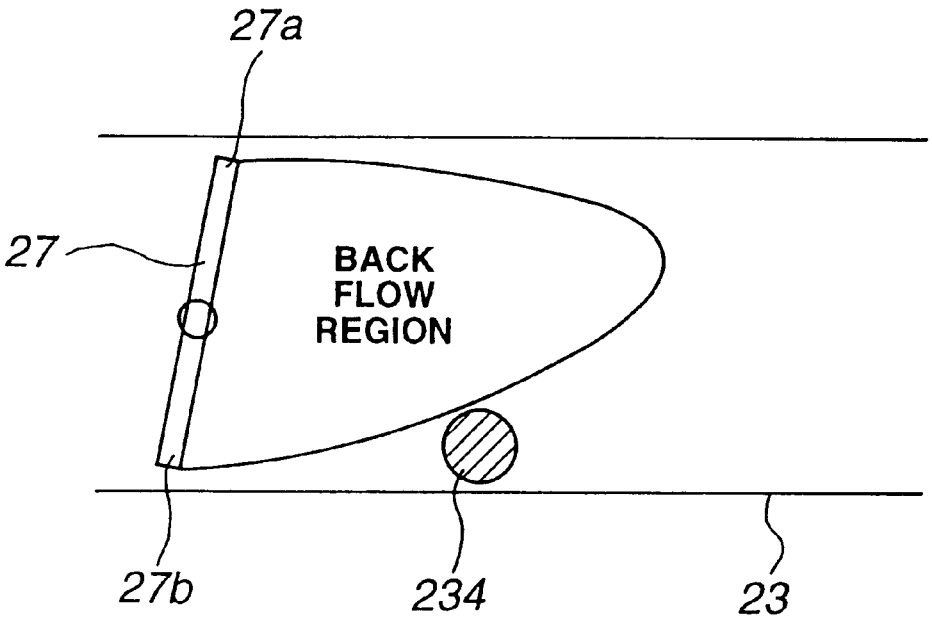
FIG. 41 is a schematic vertical longitudinal sectional view for showing an EGR introduction opening according to a ninth embodiment. (The term "vertical" means that the section is perpendicular to the swing axis of the throttle valve.)
Figure 42:
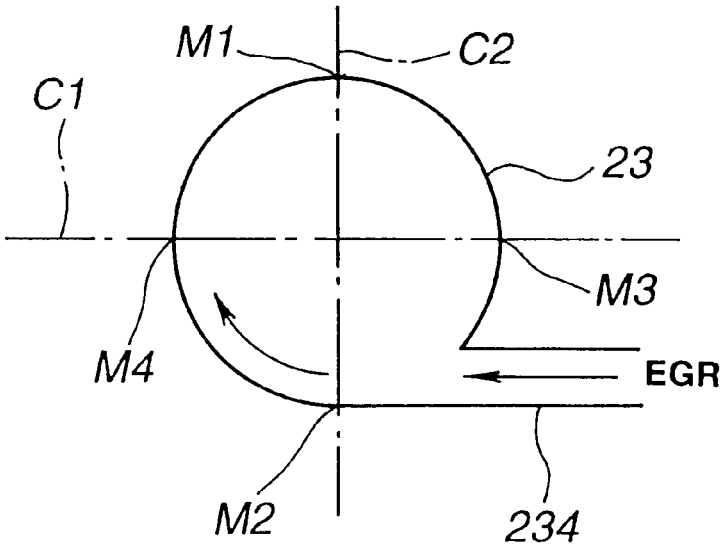
FIG. 42 is a schematic cross sectional view showing the position and orientation of the EGR introduction opening of FIG. 41.

FIGS. 41 and 42 show an EGR system according to a ninth embodiment of the present invention.

The EGR system comprises an EGR passage (external recirculation passage) 231 having a single EGR introduction port 234 opening into the inlet pipe section 23 at a single EGR introduction point as in the eighth embodiment. The EGR introduction port 234 opens from the tangential direction of the circular cross section of the inlet pipe section 23. In the ninth embodiment, the EGR introduction port 234 opens into the inlet pipe section 23 at the single EGR introduction point located in the rear of the position of the upstream side free swing end 27*b* of the throttle valve 27 in the closed position. Thus, the single EGR introduction point is located in the region where the main flow region spreads widest.

As shown in FIG. 41 as well as FIG. 6, the lower fresh main stream coming through the gap between the upstream swing end 27*b* of the throttle valve 27 and the inside wall of the intake passage tends to spread deeper in the inward radial direction, so that the back flow region tends to recede upward as viewed in FIGS. 6 and 41. The selection of the circumferential position of the single EGR introduction point in the midst of this lower main stream makes it possible to shift the axial position of the single EGR introduction point closer to the throttle valve 27 without increasing the amount of deposit on the throttle valve 27. This shift of the EGR introduction point along the axial or longitudinal direction of the intake air passage upstream toward the throttle valve 27 increases the stay time and travel distance of the EGR gas. Moreover, the involvement of the fresh main stream closely behind the throttle valve 27 acts to strengthen the spiral flow in the inlet pipe section 23.

The single tangential EGR injection at the circumferential position in the middle of the strong main stream according to the ninth embodiment is effective in mixing the EGR gas with the fresh intake air for uniform EGR distribution, and preventing passage of the EGR gas through the fresh main stream into the central back flow region.

FIG. 42 shows four circumferential positions M1~M4. In this example, the swing axis of the throttle valve 27 extends in the imaginary first center plane C1 (as explained with reference to FIG. 3), and the imaginary second center line C2 intersects the first center plane C1 at right angles along the longitudinal center line of the intake air passage. The downstream swing end 27*a* of the throttle valve 27 swings on the downstream side of the axis of the throttle valve 27 and on the first side of the first center pane C1 (that is the upper side as viewed in FIG. 42). The upstream swing end 27*b* of the throttle valve 27 swings on the upstream side of the axis of the throttle valve 27 and on the second side of the first center pane C1 (that is the lower side as viewed in FIG. 42). The first (or upper) circumferential position M1 is located just in the rear of the position of downstream swing end 27*a* of the fully closed throttle valve 27 on the first (upper side) of the first center plane C1. The second (or lower) circumferential position M2 is located just in the rear of the position of the upstream swing end 27*b* of the fully closed throttle valve 27 on the second (lower side) of the first center plane C1. The first and second circumferential positions M1 and M2 are diametrically opposite to each other on both sides of the first center plane C1, and lie on the second center plane C2. The third and fourth circumferential positions M3 and M4 are diametrically opposite on both sides of the second center plane C2 and located on the first center plane C1. The swing axis of the throttle valve 27 extends in parallel to the diameter between the third and fourth circumferential positions M3 and M4. In the example of FIG. 42, the EGR introduction point is located at the second (or lower) circumferential position M2 located downstream of the upstream swing end 27*b* of the throttle valve 27.

10th Embodiment

Figure 43:
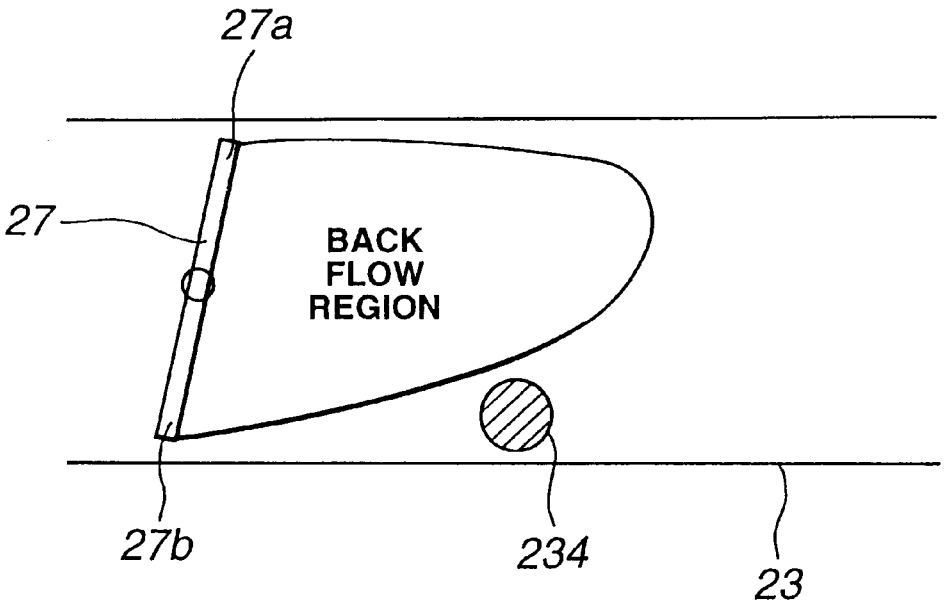
FIG. 43 is a schematic vertical longitudinal sectional view showing an EGR introduction opening according to a tenth embodiment.
Figure 44:
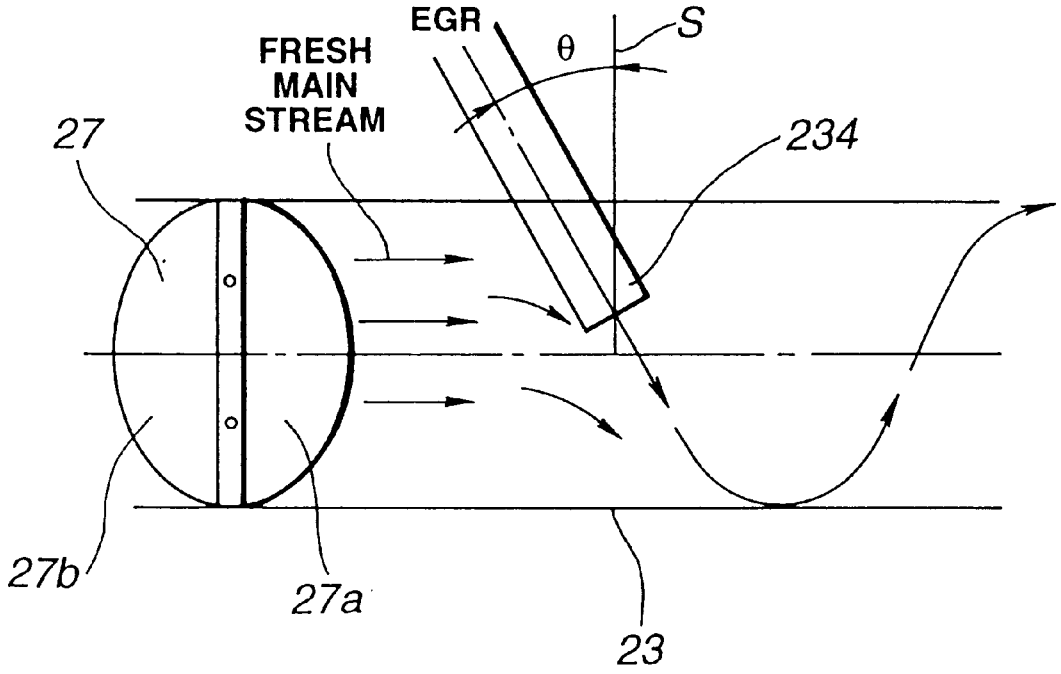
FIG. 44 is a schematic horizontal longitudinal sectional view showing the EGR introduction opening of FIG. 43.

FIGS. 43 and 44 show an EGR system according to a tenth embodiment. In the tenth embodiment, a single tangential introduction port 234 is inclined downstream so as to form an angle θ with respect to an imaginary cross sectional plane S to which the fresh intake air flow direction is perpendicular, in the same inclination direction as the EGR ports 34 and 35 shown in FIG. 2. The EGR port 234 extends from a base portion to an open end opening into the inlet pipe section 23. The open end of the EGR port 234 is remoter than the base portion from an imaginary cross sectional plane containing the swing axis of the throttle valve 27.

With this inclined EGR port 234 of the tenth embodiment, the EGR gas enters the main stream smoothly from an oblique direction with no component flowing against the main stream. Therefore, the inclined EGR port 234 according to the tenth embodiment can prevent the discharge speed of the EGR gas from being decreased too much by collision between the fresh main stream and the EGR stream, and strengthen the spiral flow.

In the example of FIGS. 34 and 35, the EGR introduction opening of the inclined port 234 is situated at the second circumferential position M2, as in the ninth embodiment. The inclined single tangential EGR injection at the circumferential position M2 is effective in mixing the EGR gas with the fresh intake air for uniform EGR distribution, and advantageous in preventing passage of the EGR gas through the fresh main stream into the central back flow region.

11th Embodiment

Figure 45:
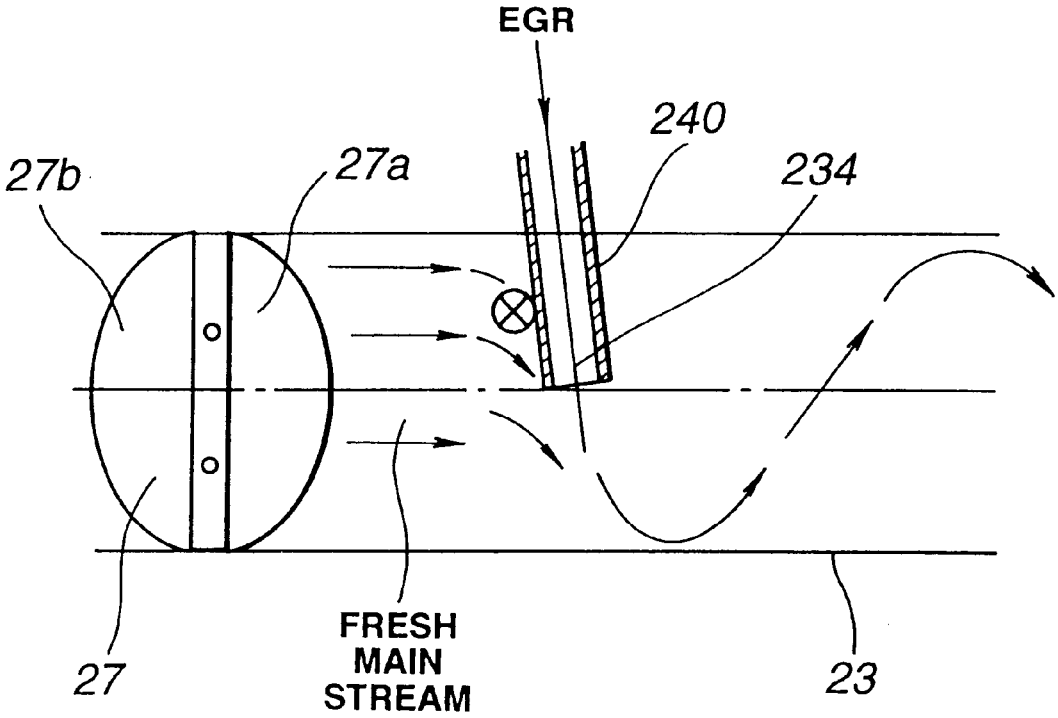
FIG. 45 is a schematic horizontal longitudinal sectional view showing an EGR introduction opening according to an eleventh embodiment.
Figure 46:
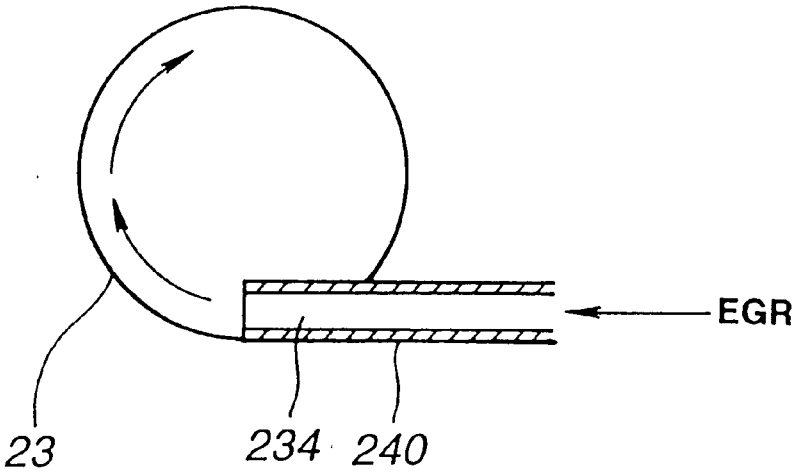
FIG. 46 is a schematic cross sectional view showing the EGR introduction opening of FIG. 45.

FIGS. 45 and 46 show an EGR system according to an eleventh embodiment. A single tangential EGR introduction port 234 comprises a guide case (or guide pipe) 240 defining the EGR introduction opening. The guide case 240 in the example shown in FIGS. 45 and 46 is cylindrical and projects into the inlet pipe section 23. The guide case 240 passes through a hole formed in the inlet pipe section 23, and terminates at the open end located near an imaginary center plane containing the longitudinal center line of the inlet pipe section 23.

The guide case 240 protects the EGR stream from being slowed down by collision of the fresh intake air, and guides the fresh main stream in a direction to promote the spiral flow. The guide case 240 facilitates the mixing of the EGR gas with the fresh intake air, and prevents the EGR gas stream from being bent radially inwards into the central back flow region by the impingement of the intake air.

12th Embodiment

Figure 47:
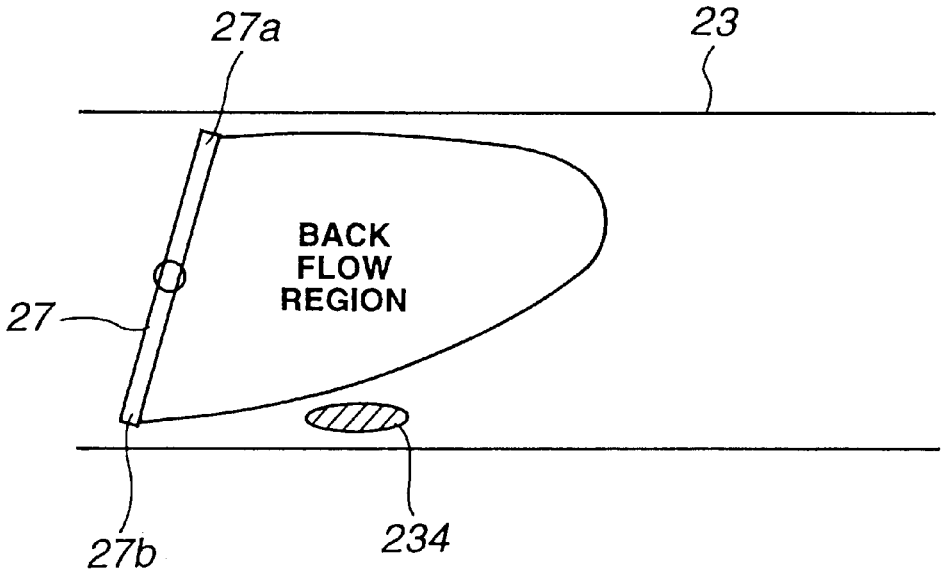
FIG. 47 is a schematic vertical longitudinal sectional view showing an EGR introduction opening according to a twelfth embodiment.

FIG. 47 shows an EGR system according to a twelfth embodiment. In this embodiment, the EGR introduction opening of a single tangential EGR introduction port 234 is elongated in cross section along the fresh intake air flow direction or the longitudinal (or axial) direction of the inlet pipe section 23. The cross section of the EGR port 234 is elliptical, and the EGR port 234 is thin in the radial dimension along the radial direction of the inlet pipe section 23. The EGR port 234 having the elongated section according to the twelfth embodiment makes it possible to shift the position of the EGR introduction opening upstream toward the throttle valve 27 in a narrow main stream region.

13th Embodiment

Figure 48:
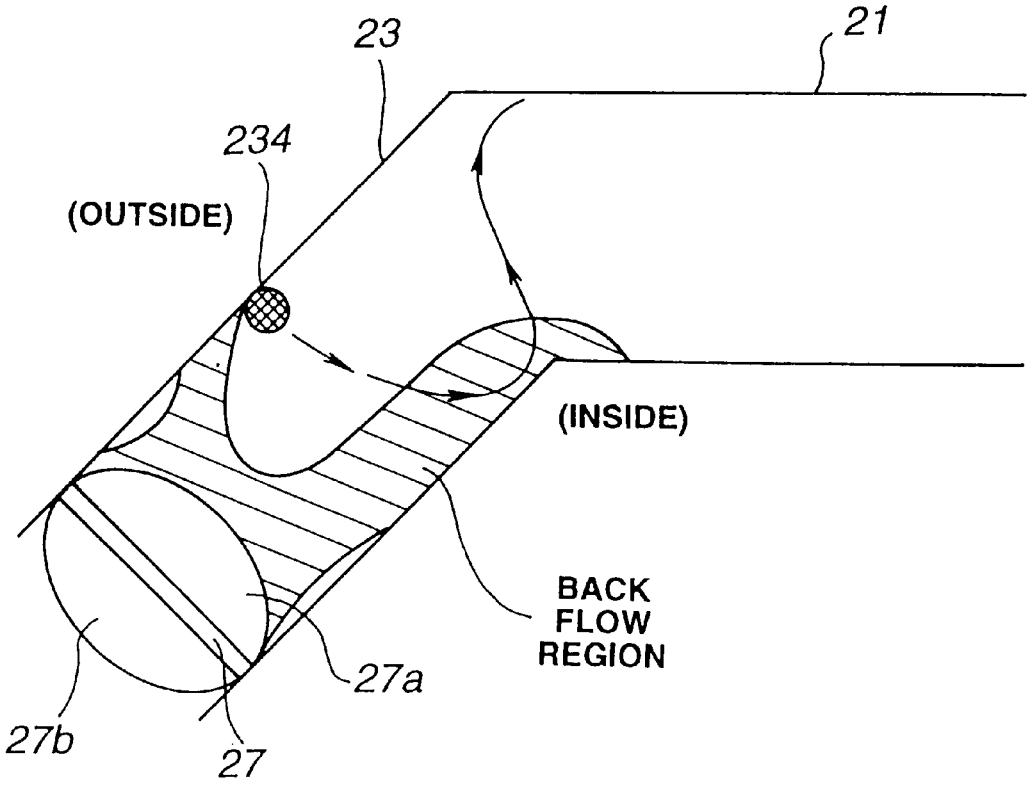
FIG. 48 is a schematic horizontal longitudinal sectional view showing an EGR introduction opening according to a thirteenth embodiment.

FIG. 48 shows an EGR system according to a thirteenth embodiment. In this embodiment, the intake air passage is inclined with respect to the longitudinal direction of the collector section 24 of the intake manifold 21 in an imaginary plane containing the swing axis of the throttle valve 27. In this example, the intake passage is defined by the throttle body 26 and the inlet pipe section 23 of the intake manifold 21, and a bend is formed between the inlet pipe section 23 and the collector section 24. In the imaginary plane containing the swing axis of the throttle valve 27, the intake passage extends along a first imaginary straight line perpendicular to the swing axis of the throttle valve 27, and the collector section 24 extends along a second imaginary straight line intersecting the first straight angle.

In the intake system having such a bend, the back flow region tends to grow larger on the inner side of the bend, and smaller on the outer side of the bend as shown in FIG. 48. Therefore, a single EGR introduction port 234 according to the thirteenth embodiment is opened into the inlet pipe section 23 at an EGR introduction point located on the outer side of the bend. The position of the EGR introduction point is adjusted along the longitudinal direction of the inlet pipe section 23 in accordance with the angle of the bend.

At the circumferential position of the EGR introduction point on the outer side of the bend, it is possible to shift the EGR introduction point of the EGR port 234 toward the throttle valve 27 along the longitudinal (or axial) direction of the inlet pipe section 23. Thus, the thirteenth embodiment can increase the longitudinal distance from the EGR introduction point to the most upstream branch 25 of the intake manifold 21 to prolong the spiral path for the mixture of the EGR gas with the intake air without increasing the amount of deposit on the throttle valve 27.

In the example shown in FIG. 48, the longitudinal (or axial) position of the EGR introduction opening of the EGR port 234 is located between the downstream end of the back flow region formed on the outer side of the bend, and the downstream end of the back flow region formed on the inner side of the bend when the throttle valve 27 is fully closed.

14th Embodiment

Figure 49:
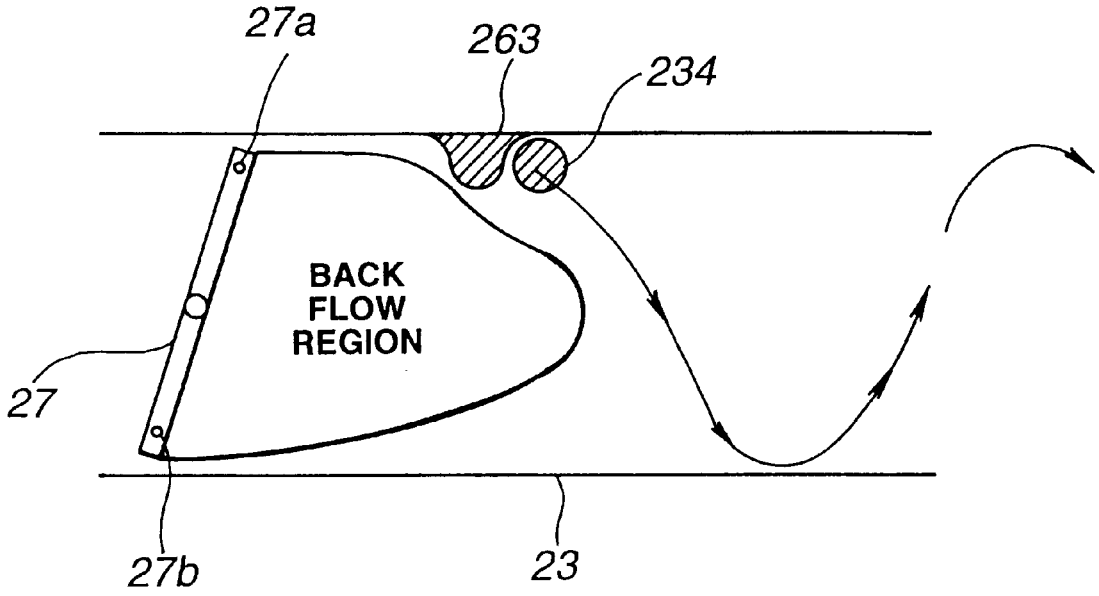
FIG. 49 is a schematic vertical longitudinal sectional view showing an EGR introduction opening and a deflecting rib according to a fourteenth embodiment.
Figure 50:
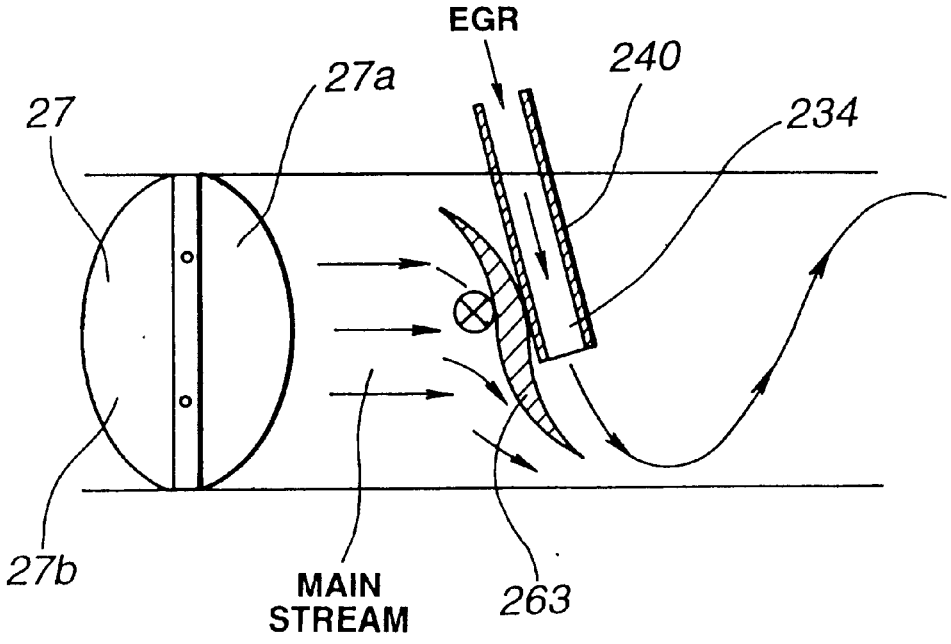
FIG. 50 is a schematic horizontal longitudinal sectional view showing the EGR introduction opening and deflecting rib of FIG. 49.

FIGS. 49 and 50 show an EGR system according to a fourteenth embodiment. A deflector 263 is formed on the upstream side of an EGR introduction port 234 to guide the main intake air stream along the inflow direction of the EGR gas discharged from the EGR port 234. In the example shown in FIGS. 49 and 50, the deflector is in the form of a deflecting rib 263 integrally formed in the inside wall surface of the inlet pipe section 23 by casting, and the EGR introduction port 234 comprises a guide pipe 240 as in the eleventh embodiment shown in FIGS. 45 and 46. The deflecting rib 263 extends closely along the guide pipe 240 generally in the circumferential direction of the inlet pipe section 23. In the illustrated example, the deflecting rib 263 extends circumferentially beyond the guide pipe 240 as shown in FIG. 50. Therefore, the deflecting rib 263 includes a first section extending alongside the guide pipe 240 and a second section projecting beyond the guide pipe 240 and protecting the EGR stream discharged from the guide pipe 240.

The deflecting rib 263 deflects the main intake air stream to the tangential inflow direction of the EGR gas, and thereby reinforces the spiral flow to facilitate the mixing of the EGR gas with the fresh intake air and to reduce the EGR nonuniformity among the cylinders even at high EGR rates. Moreover, the deflecting rib 263 alters the shape of the back flow region so that the back flow region becomes smaller in size near the EGR introduction opening of the EGR port 234, and helps reduce the deposit formation by preventing the intervention of the inflow EGR gas stream into the back flow region.

When the inlet pipe section 23 has no bend, the fresh intake stream grows wider and the back flow region recedes radially inwardly at the circumferential position M2 in the rear of the upstream free end 27*b* of the throttle valve 27. Therefore, the circumferential position M2 in the rear of the upstream free end 27*b* of the throttle valve 27 is advantageous in general. In some cases, however, there is need for locating the open end of the EGR port 234 at or near the circumferential position M1 just in the rear of the downstream free end 27*a* of the throttle valve 27 because of some limitation on the layout of the EGR passage 231, or because the circumferential position in the rear of the upstream free end 27*b* necessitates an undesired arrangement in which the EGR port 234 is opened upwards so as to form an undesired sump for collecting water. In such cases, the deflecting rib 263 is effective for surmounting the disadvantage of the circumferential position in the rear of the downstream free end 27*a,* and for offering the same effects in the uniform EGR distribution and deposit prevention.

15th Embodiment

Figure 51:
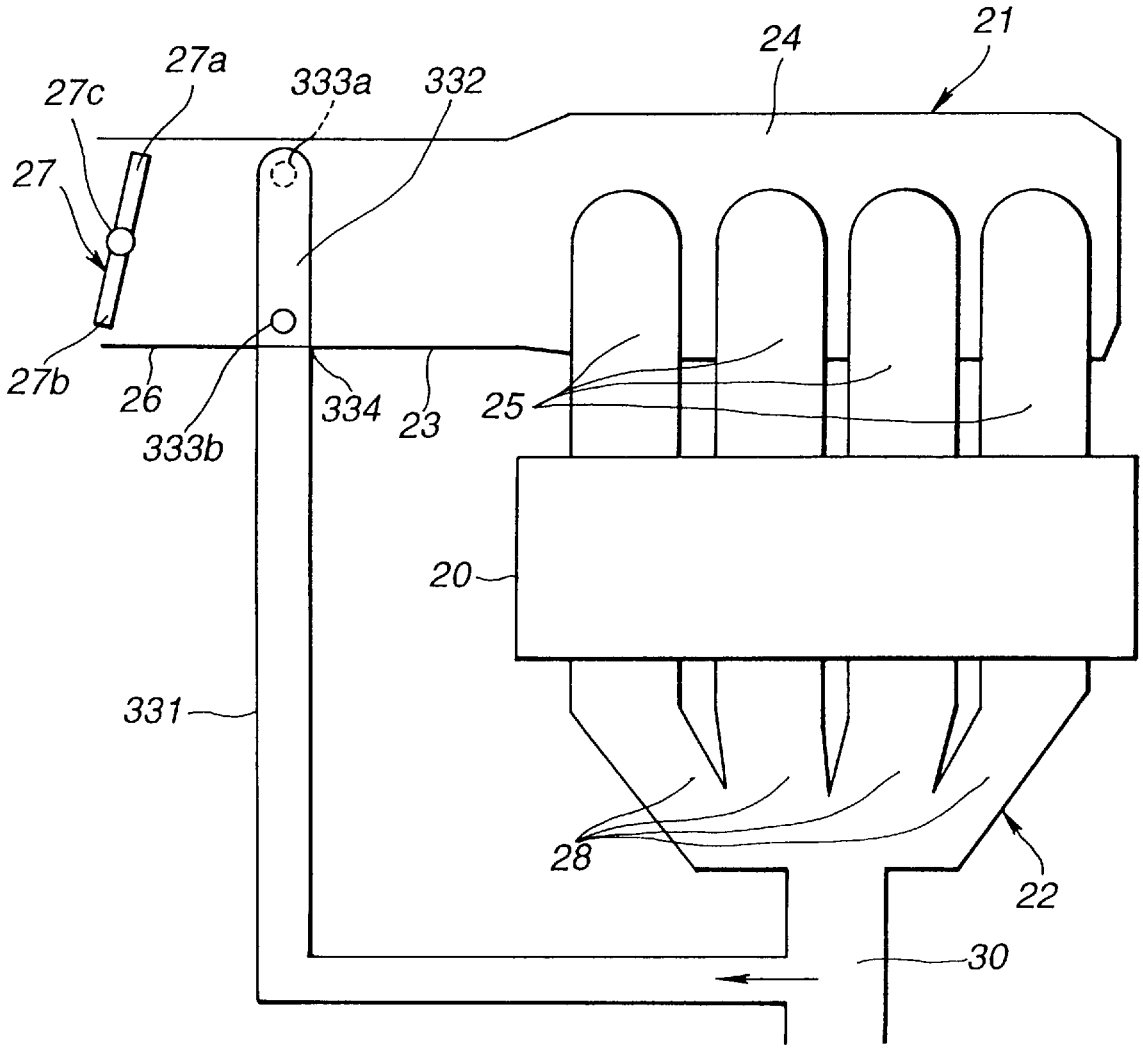
FIG. 51 is a schematic view showing an engine system according to a fifteenth embodiment.
Figure 52:
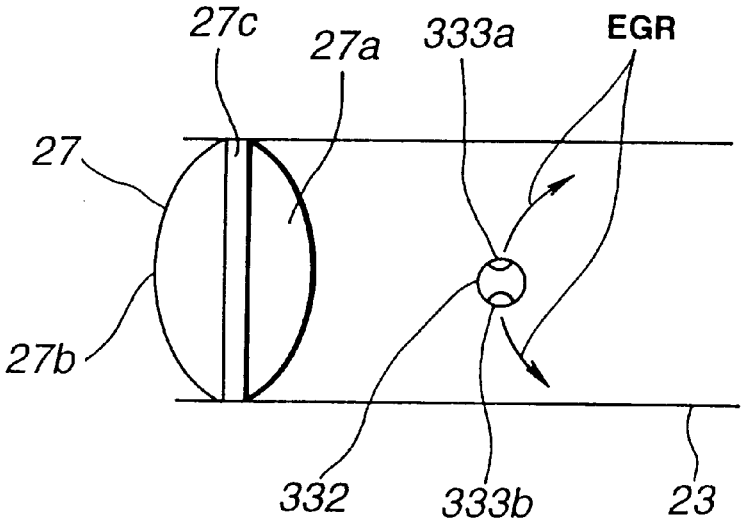
FIG. 52 is a schematic longitudinal sectional view showing EGR introduction openings of FIG. 51.
Figure 53:
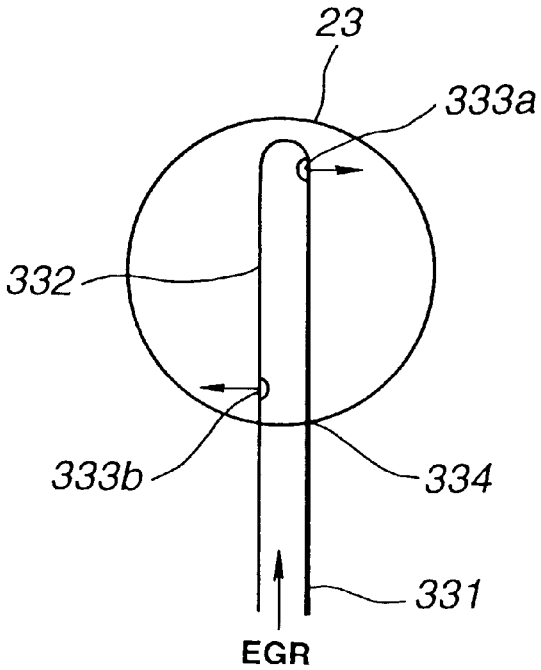
FIG. 53 is a schematic cross sectional view showing the EGR introduction openings of FIG. 51.

FIGS. 51, 52 and 53 show an engine system according to a fifteenth embodiment. The intake and exhaust systems shown in FIG. 51 are substantially identical to the systems shown in FIG. 1 and FIG. 34. As in the preceding embodiments, a throttle body 26 has therein a throttle valve 27 for controlling the quantity of intake air supplied to an engine 20. As in the preceding embodiments, the throttle valve 27 is swingable on a swing axis 27*c,* and the throttle valve 27 has a downstream side swing end (or free end) 27*a* which swings to the downstream side (i.e. the right side as viewed in FIG. 51 toward the engine) of the swing axis 27*c* and an upstream side swing end (or free end) 27*b* which swings to the upstream side (or the left side in FIG. 51) of the swing axis 27*c*.

In the fifteenth embodiment, the EGR system comprises an EGR introduction pipe 332 closed at a forward end (or downstream end). The EGR introduction pipe 332 is connected with an EGR passage 331 extending from the exhaust pipe 30. Alternatively, the EGR introduction pipe 332 may be integral with the EGR passage 331. The EGR introduction pipe 332 is inserted through a hole 334 formed in the inlet pipe section 23, into the inlet pipe section 23. In this example, the EGR introduction pipe 332 is a round pipe circular in cross section.

In this example, the EGR introduction pipe 332 extends radially into the inlet pipe section 23 along a diameter of a circular cross section of the inlet pipe section 23 from the second (or lower) circumferential position M2 in the rear of the upstream swing end 27*b* of the throttle valve 27 to the first (or upper) circumferential position M1 in the rear of the downstream swing end 27*a*. The hole 334 is located at the second (or lower) circumferential position M2 downstream of the upstream swing end 27*b* of the throttle valve 27, and the EGR introduction pipe 332 extends in the inlet pipe section 23 toward the first (or upper) circumferential position M1 downstream of the downstream swing end 27*a*. The closed forward end of the EGR introduction pipe 332 closely confronts the inside cylindrical surface of the inlet pipe section 23 at the first circumferential position M1.

As shown in FIG. 53, the EGR introduction pipe 332 is formed with a first EGR introduction opening 333*a* opening along a tangential direction of a circular cross section of the inlet pipe section 23 near the forward end of the EGR introduction pipe 332 in the inlet pipe section 23, and a second EGR introduction opening 333*b* opening along a tangential direction of the circular cross section of the inlet pipe section 23 near the hole 334 of the inlet pipe section 23 at the second (or lower) circumferential position M2. The first and second EGR introduction openings 333*a* and 333*b* open in opposite tangential directions at the diametrically opposite circumferential positions M1 and M2 which are separated from each other at an angular distance of 180° around the longitudinal center line of the inlet pipe section 23. The discharge directions of the first and second EGR introduction opening 333*a* and 333*b* are parallel but directed in the opposite directions in the cross flow manner, so that the inflow EGR streams from the first and second openings 333*a* and 33*b* tend to produce a circumferential flow which, in the example of FIG. 53, rotates in the clockwise direction around the longitudinal center line of the inlet pipe section 23. In this example, the EGR introduction pipe 332 is circular in cross section.

Figure 54:
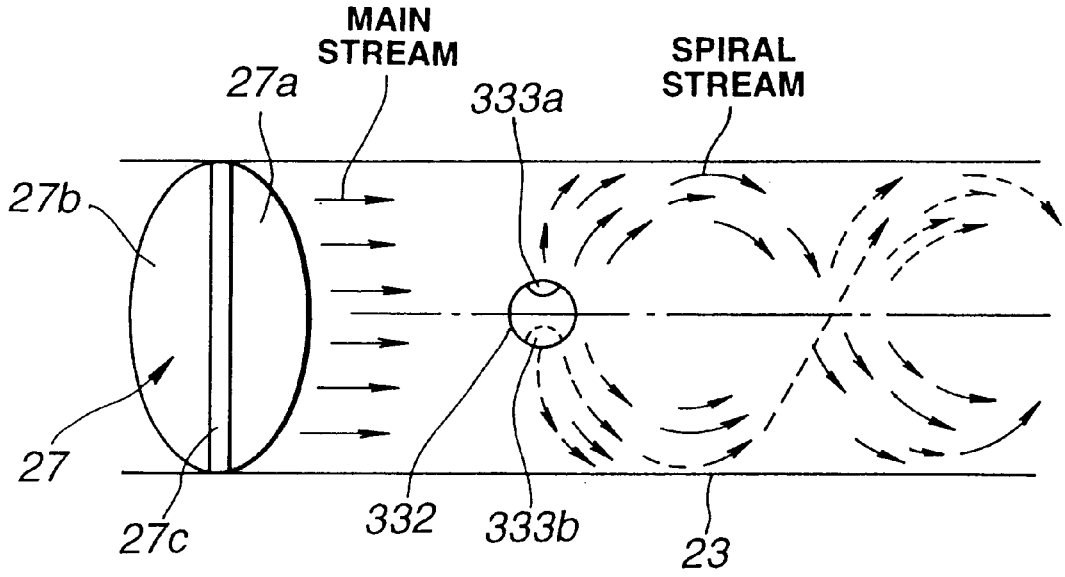
FIG. 54 is a schematic horizontal longitudinal sectional view for illustrating EGR streams produced by the EGR introduction openings of FIG. 51.
Figure 55:
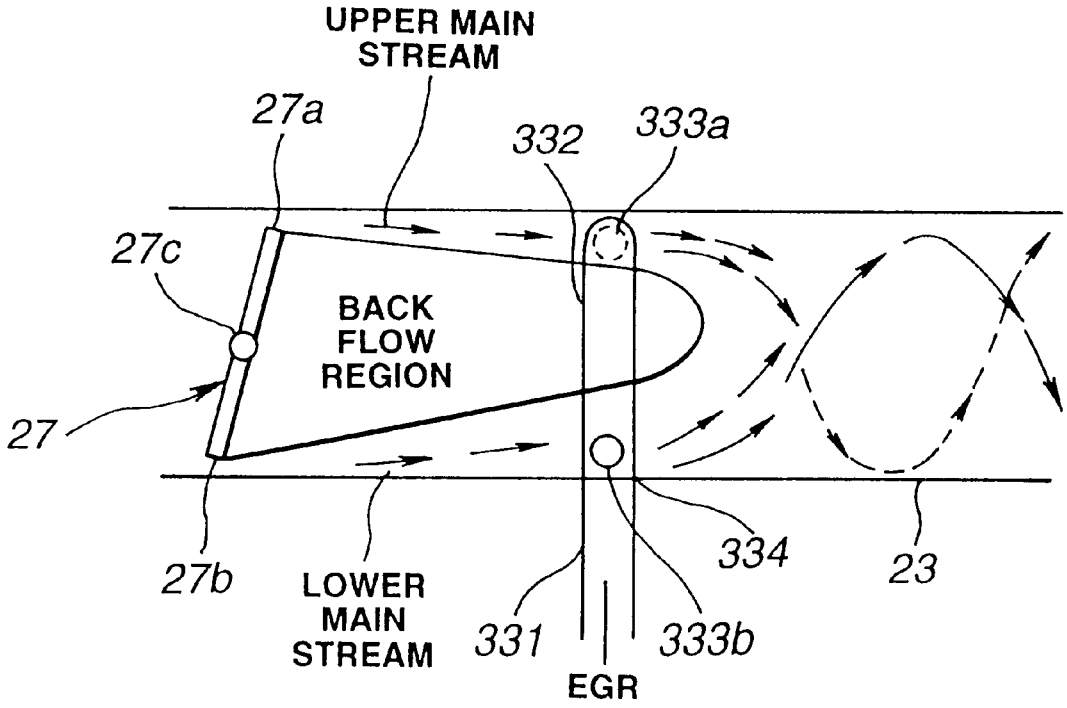
FIG. 55 is a schematic vertical longitudinal sectional view for illustrating EGR streams produced by the EGR introduction openings of FIG. 51.

As shown in FIGS. 54 and 55, the inflow EGR gas streams discharged from the openings 333*a* and 333*b* are pushed downstream by the upper and lower fresh main streams and produce a spiral flow along the inside cylindrical surface of the inlet pipe section 23.

Figure 56:
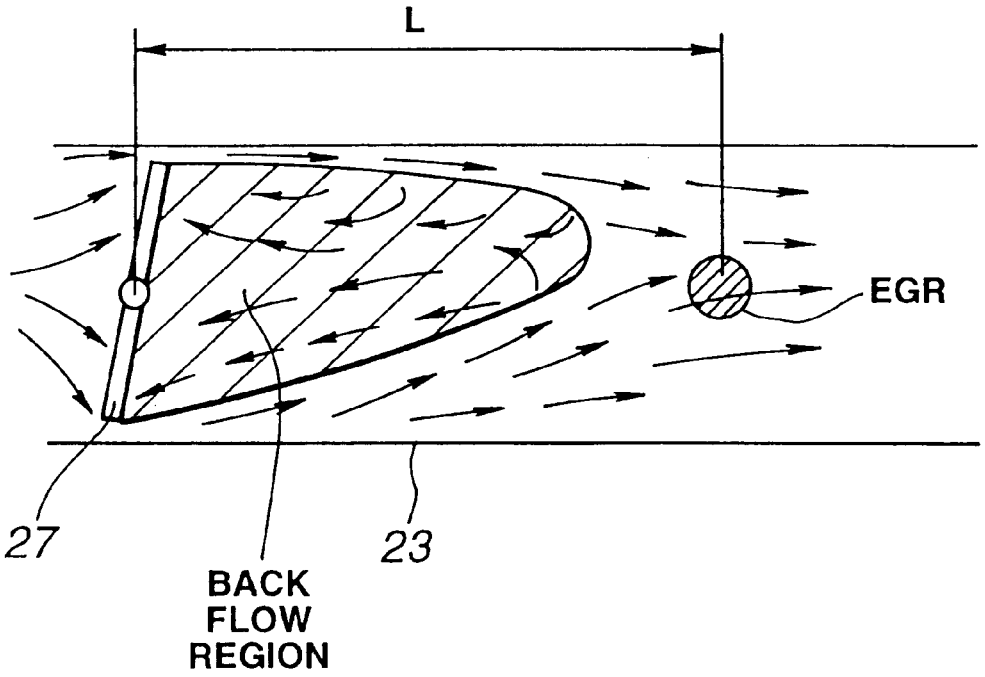
FIG. 56 is a schematic vertical longitudinal sectional view showing a back flow region formed behind the throttle valve.
Figure 57:
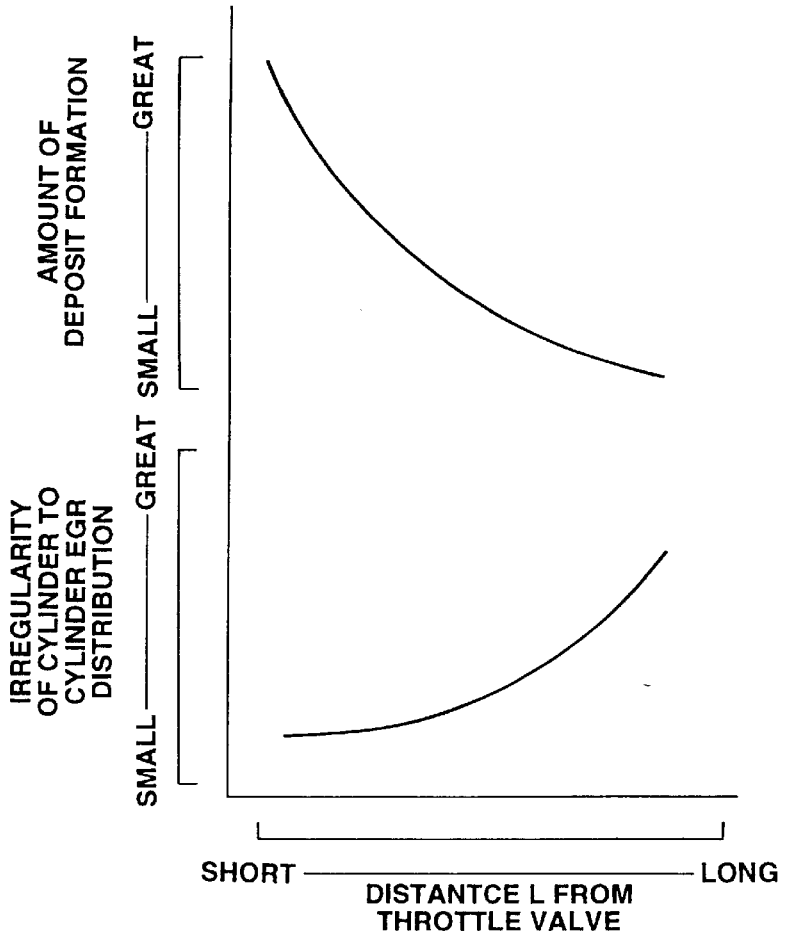
FIG. 57 is a graph showing dependence of EGR distribution and deposit formation on a distance of an EGR introduction point from the throttle valve.
Figure 58:
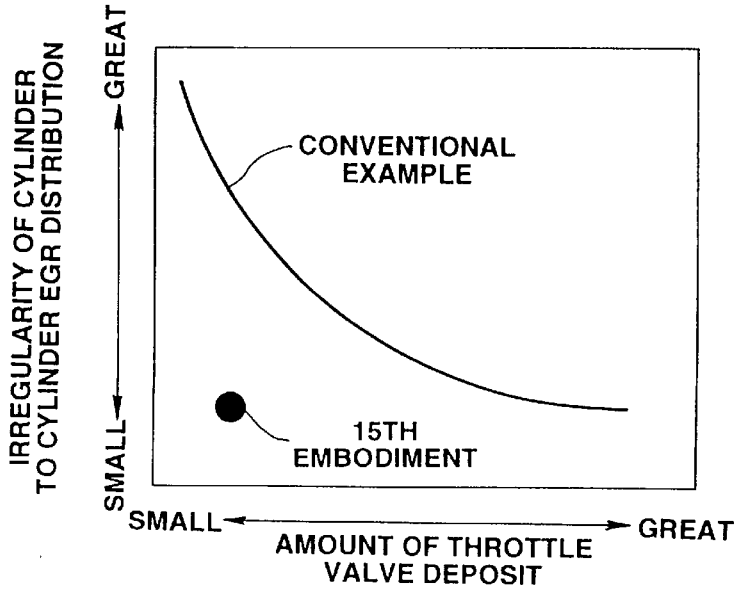
FIG. 58 is a graph showing effect of the fifteenth embodiment on the EGR distribution and deposit formation.

FIG. 57 illustrates influence on the inter-cylinder EGR distribution and deposit formation, of a distance L of an EGR introduction point from the position of the throttle valve 27 as shown in FIG. 56. When the distance L is short, the EGR gas is readily injected into the back flow region behind the throttle valve 27. The injection of the EGR gas into the back flow region promotes the mixing with the fresh intake air, but increases the amount of undesired deposit formation. An increase in the distance L is advantageous for prevention of deposit formation. However, the degree of irregularity of the cylinder to cylinder EGR distribution is increased as the distance L increases. The relationship between the deposit formation and EGR nonuniformity requires a tradeoff therebetween as shown in FIG. 57. The tangential EGR introduction according to the fifteenth embodiment can meet the two conflicting requirements, the deposit reduction and EGR uniformization as shown in FIG. 58, by producing the spiral flow around the central region. The EGR introduction pipe 332 formed with the first and second EGR introduction openings 333*a* and 333*b* facilitates the formation of the EGR introduction openings, and thereby reduces the required amount of work (man-hours) and manufacturing cost.

In the example of FIGS. 52 and 53, the EGR introduction pipe 332 extends into the inlet pipe section 23 from the second circumferential position M2 in the rear of the upstream swing end 27*b* to the first circumferential position M1 in the rear of the downstream swing end 27*a*. However, an opposite arrangement is optional in which the EGR introduction pipe 332 is inserted into the inlet pipe section 23 from the first circumferential position M1 in the rear of the downstream swing end 27*a* toward the second circumferential position M2 behind the upstream swing end 27*b*.

In the example of FIGS. 51~53, the opening directions of the first and second EGR introduction openings 333*a* and 333*b* are not inclined with respect to an imaginary cross sectional plane of the inlet pipe section 23, and both openings 333*a* and 333*b* open in the opposite tangential directions extending in the imaginary cross sectional plane.

16th Embodiment

Figure 59:
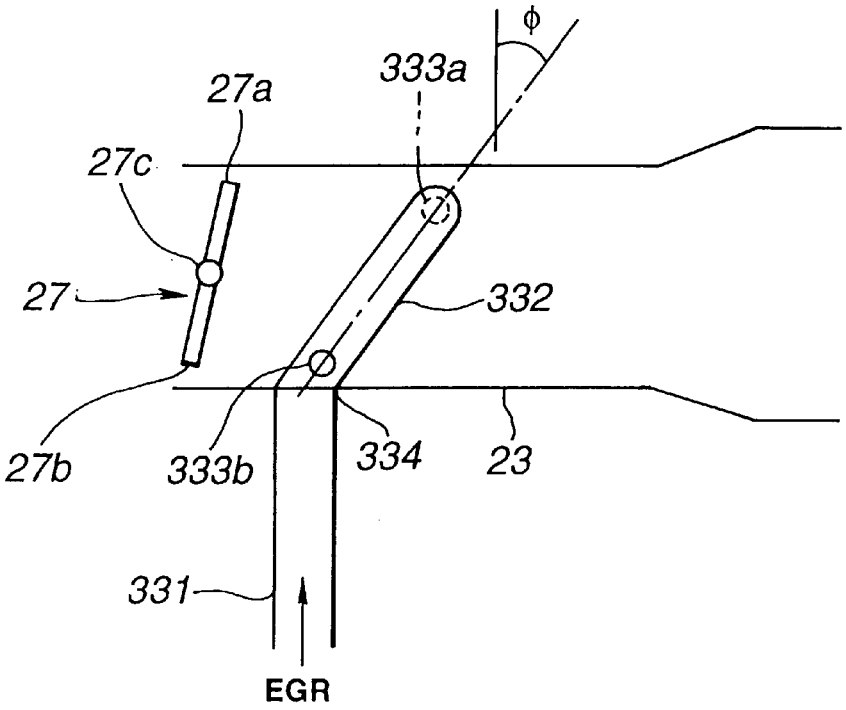
FIG. 59 is a schematic vertical longitudinal sectional view showing EGR introduction openings according to a sixteenth embodiment.
Figure 60:
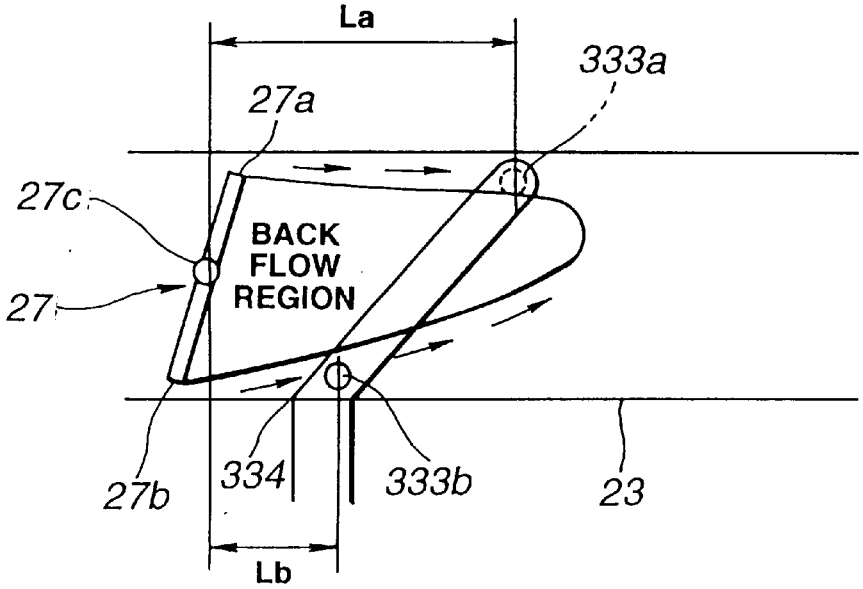
FIG. 60 is a schematic vertical longitudinal sectional view showing the positions of the EGR introduction openings of FIG. 59 relative to a back flow region.
Figure 61:
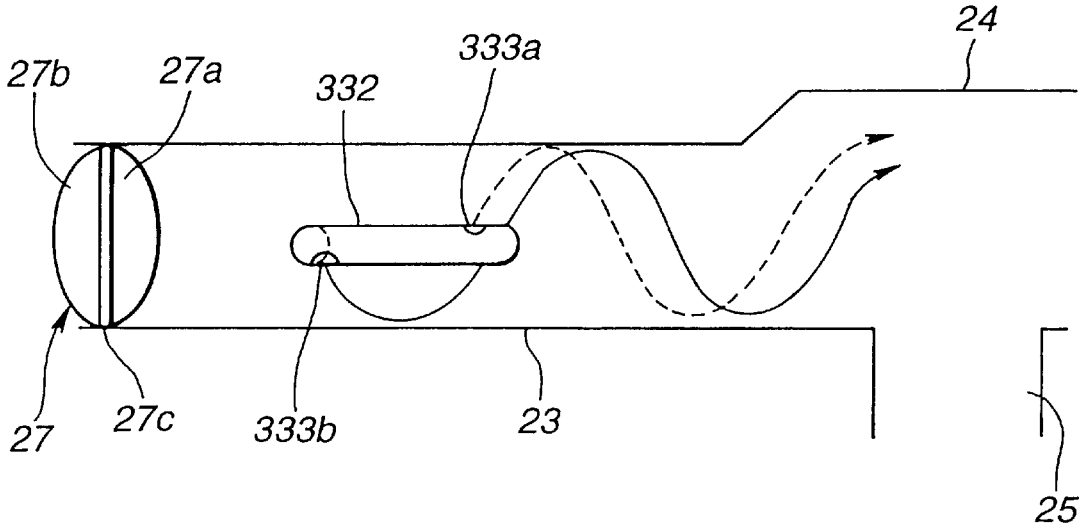
FIG. 61 is a schematic horizontal longitudinal sectional view showing the EGR introduction openings of FIG. 59.

FIGS. 59, 60 and 61 show an EGR system according to a sixteenth embodiment.

The EGR system according to the 16th embodiment comprises an EGR introduction pipe 332 which is inserted into the inlet pipe section 23 through a hole 334 of the inlet pipe section 23, closed at a forward end (or downstream end) and formed with first and second EGR introduction openings 333*a* and 333*b* opening in the opposite tangential directions at the radially spaced, diagonally opposite circumferential positions M1 and M2 as in the fifteenth embodiment. According to the 16th embodiment, the EGR introduction pipe 332 is inclined downstream so as to space the first and second EGR introduction openings 333*a* and 333*b* apart in the longitudinal or axial direction of the inlet pipe section 23 as well as in the radial direction in order to enhance the improvement of the EGR characteristic by the spiral flow.

As shown in FIG. 59, the EGR introduction pipe 332 is inclined with respect to a cross sectional plane of the inlet pipe section 23 so as to form an angle $\phi$. The EGR introduction pipe 332 extends obliquely in the inlet pipe section 23 along an inclined straight line from the second (or lower) circumferential position M2 in the rear of the upstream swing end 27*b* of the throttle valve 27 toward the first circumferential position M1 in the rear of the downstream swing end 27*a*. Therefore, the first EGR introduction opening 333*a* at the first (upper) circumferential position M1 is located downstream of the second EGR opening 333*b* at the second (lower) circumferential position M2 along the longitudinal direction of the inlet pipe section 23.

As shown in FIG. 60, the distance Lb from the position of the throttle shaft 27*c* to the position of the second EGR introduction opening 333*b* behind the upstream throttle end 27*b* is smaller than the distance La of the position of the first EGR introduction opening 333*a* from the position of the throttle shaft 27*c*. Therefore, as shown in FIG. 61, the longitudinal distance from the second EGR opening 333*b* to the most upstream intake manifold branch 25 is increased to the advantage for the uniform EGR gas concentration in the manifold collector section 24. The EGR opening 333*b* closer to the throttle valve 27 is located on the second (or lower) side of the throttle shaft 27*c* (that is, the second or lower side of the first center plane C1) on which the upstream swing end 27*b* of the throttle valve 27 swings toward the upstream side. The EGR opening 233*a* remoter from the throttle shaft 27*c* is on the first (or upper) side of the throttle shaft 27*c*. This arrangement is advantageous to the deposit reduction by prevention of interference with the back flow region shown in FIG. 60.

17th Embodiment

Figure 62:
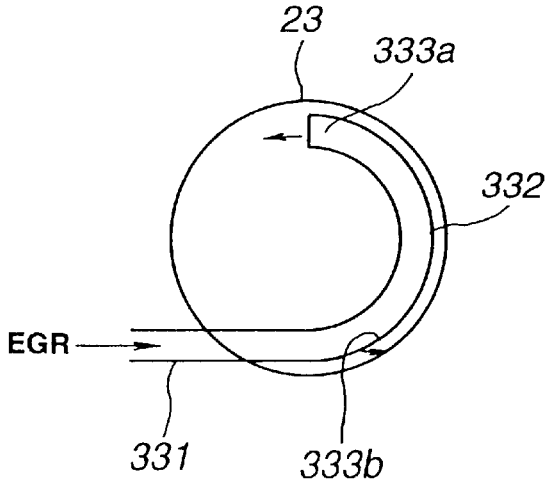
FIG. 62 is a cross sectional view showing EGR introduction openings according to a seventeenth embodiment.
Figure 63:
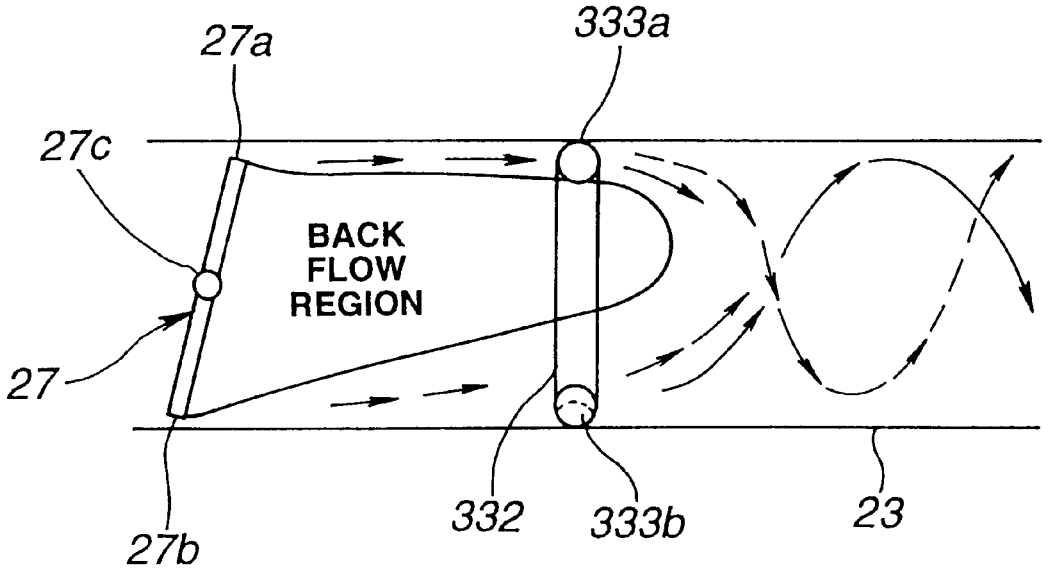
FIG. 63 is a schematic vertical longitudinal sectional view showing the EGR introduction openings of FIG. 62.

FIGS. 62 and 63 show an EGR system according to a seventeenth embodiment. In this embodiment, an EGR introduction pipe 332 for EGR introduction is curved in the shape of a letter J as shown in FIG. 62. The EGR introduction pipe 332 enters into the inlet pipe section 23 from a tangential direction tangential to a circular cross section of the inlet pipe section 23, and extends circumferentially along the inside cylindrical surface of the inlet pipe section 23.

The EGR introduction pipe 332 of FIG. 62 has a forward pipe end which opens in a tangential direction and defines a first EGR introduction opening 333*a*. The EGR introduction pipe 332 is formed with a second EGR introduction opening 233*b* opening in a tangential direction. The first and second EGR introduction openings 233*a* and 233*b* open in parallel but opposite tangential directions (in the cross flow manner) at diagonally opposite circumferential positions.

In the example of FIGS. 62 and 63, the second EGR opening 333*b* is formed in a cylindrical circumferential wall of the EGR introduction pipe 332 at the second (lower) circumferential position M2 in the rear of the upstream throttle end 27*b*. The first EGR opening 333*a* defined by the forward end of the EGR introduction pipe 332 is located at the first (upper) circumferential position M1 in the rear of the downstream throttle end 27*a*. The EGR introduction pipe 332 has a straight segment extending in one tangential direction through a hole formed in the inlet pipe section 23 and a semicircular segment having the first and second EGR openings 333*a* and 33*b* at both ends.

The thus-arranged EGR introduction openings 333*a* and 333*b* inject the EGR gas so as to form a circumferential flow around the central back flow region in the counterclockwise direction as viewed in FIG. 62, and the thus-injected EGR gas and the fresh main streams around the back flow region produce a spiral flow advancing downward.

Figure 64:
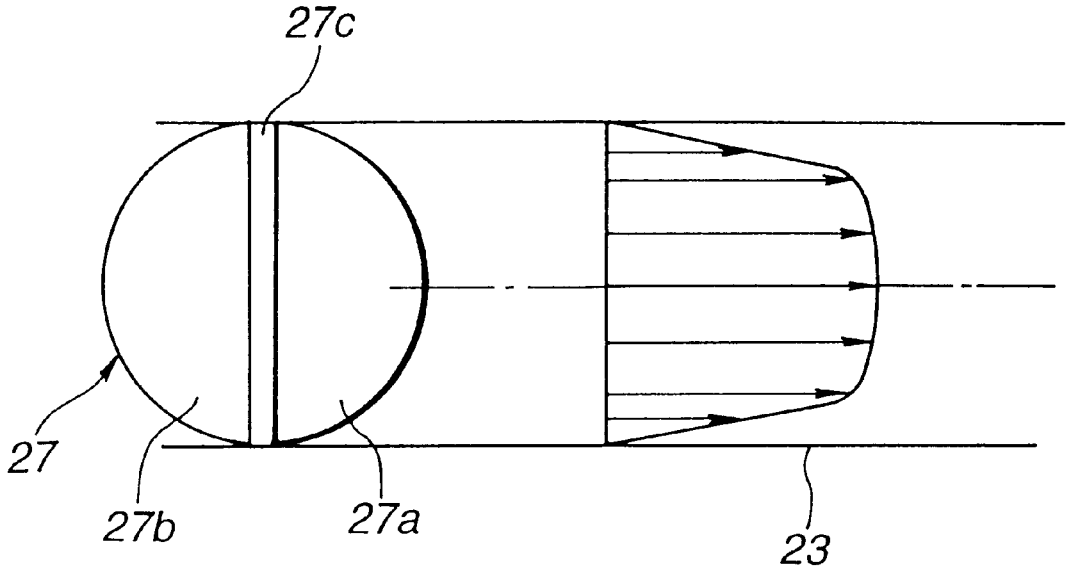
FIG. 64 is a schematic horizontal longitudinal sectional view for illustrating the flow velocity distribution in the intake passage.

When the throttle valve 27 is fully open, the flow velocity is higher in the central region and lower in the annular circumferential region near the inside cylindrical wall surface of the intake air passage, as shown in FIG. 64. The curved EGR introduction pipe 332 of FIGS. 62 and 63 extends in the lower speed circumferential region. The thus-arranged curved EGR introduction pipe 332 functions to reduce the flow resistance of the intake air and to improve the output torque in a high load engine operation.

18th Embodiment

Figure 65:
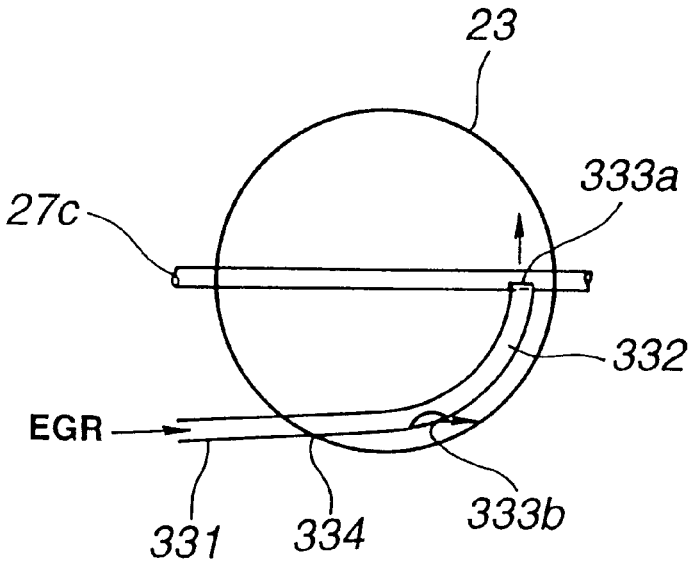
FIG. 65 is a schematic cross sectional view showing EGR introduction openings according to an eighteenth embodiment.
Figure 66:
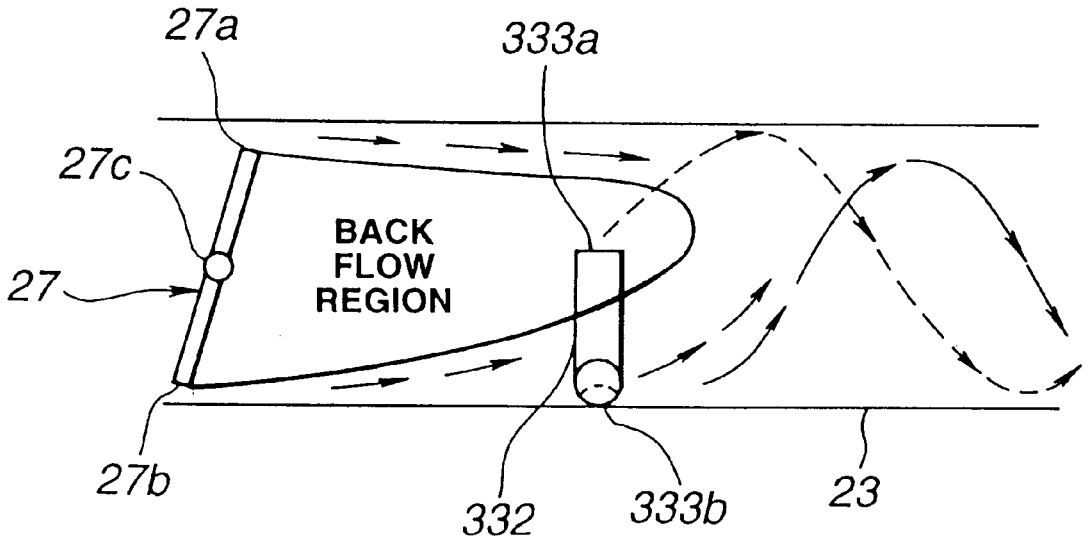
FIG. 66 is a schematic vertical longitudinal sectional view showing the EGR introduction openings of FIG. 65.

FIGS. 65 and 66 shows an EGR system according to an eighteenth embodiment. An EGR introduction pipe 332 for EGR gas introduction is curved and extends along the circumferential direction as in the 17th embodiment. However, the EGR introduction pipe 332 shown in FIG. 65 extends circumferentially only through about 90°. The EGR introduction pipe 332 has a straight segment extending tangentially through a hole formed in the inlet pipe section 23 and an arc segment extending circumferentially along the inside cylinder wall surface of the inlet pipe section 23. The EGR introduction pipe 332 has an open forward pipe end defining a first EGR introduction opening 333*a* and a second EGR introduction opening 333*b* formed at a connecting position between the straight segment and the arc segment. The angular distance between the first and second EGR openings 333*a* and 333*b* is about 90° around the center line of the inlet pipe section 23.

In the example of FIGS. 65 and 66, the first EGR introduction opening 333*a* defined by the open end of the EGR introduction pipe 332 is located substantially on the first (or horizontal) center plane C1 containing the axis of the throttle valve and the longitudinal center line of the intake passage. The second EGR introduction opening 333*b* is located at the second (lower) circumferential position downstream of the position of the upstream swing end 27*b* of the throttle valve 27. The second EGR introduction opening 333*b* opens in a rightward tangential direction as viewed in FIG. 65 whereas the first EGR introduction opening 333*a* opens in an upward tangential direction as viewed in FIG. 65. In the example of FIGS. 65 and 66, the opening area of the first EGR introduction opening 333*a* at the circumferential position downstream of one shaft end of the throttle valve shaft 27*c* is smaller than the opening area of the second EGR introduction opening 333*b*. The smaller EGR introduction opening 333*a* increases the injection speed of the EGR gas discharged in the tangential direction and thereby reduces the amount of EGR gas injected into the central back flow region. The shortened EGR introduction pipe 332 of FIGS. 65 and 66 is advantageous to the flow resistance in the intake passage.

19th Embodiment

Figure 67:
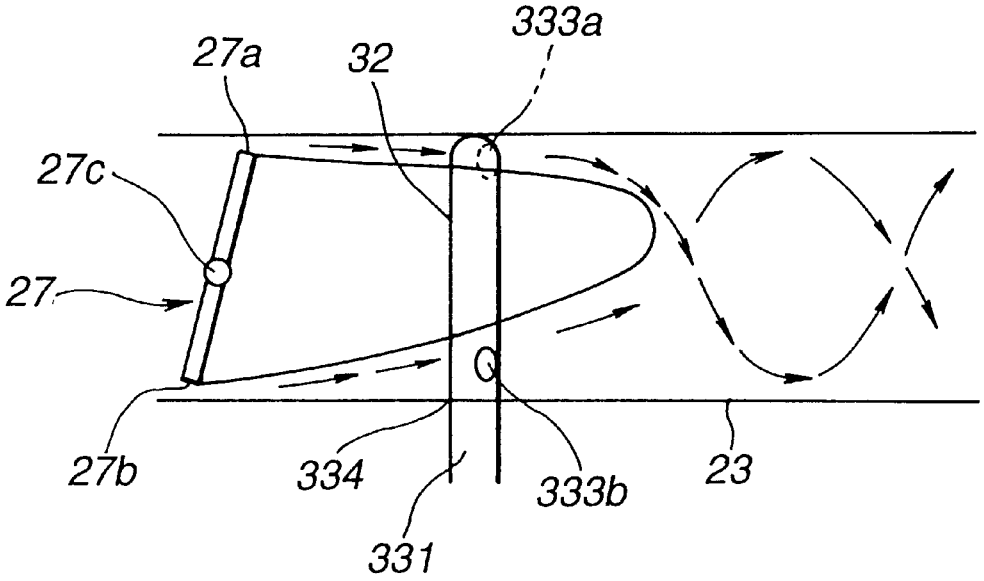
FIG. 67 is a schematic vertical longitudinal sectional view showing EGR introduction openings according to a nineteenth embodiment.
Figure 68:
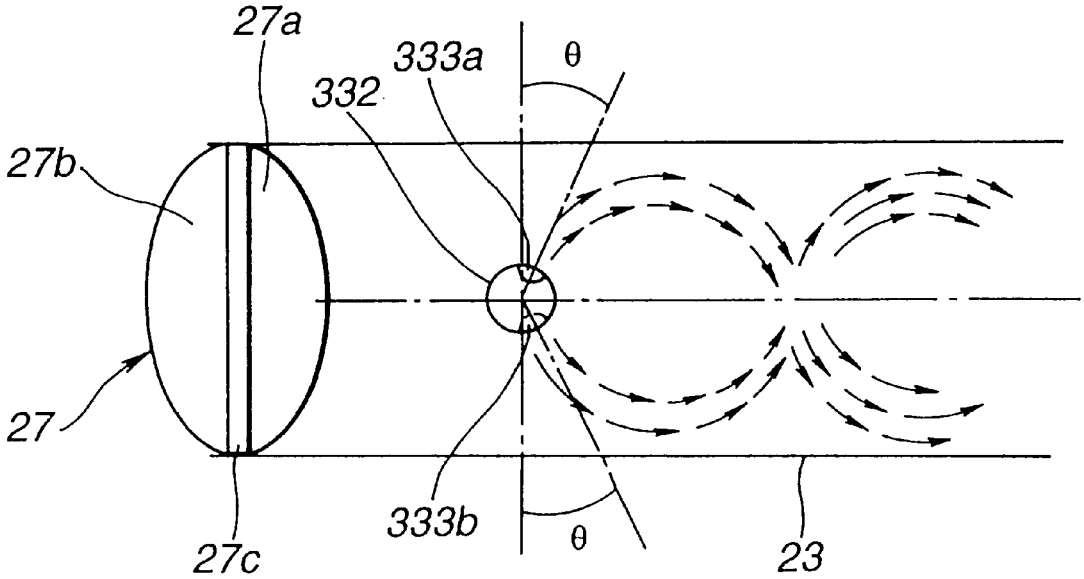
FIG. 68 is a schematic horizontal longitudinal sectional view showing the EGR introduction openings of FIG. 67.

FIGS. 67 and 68 show an EGR introduction pipe 332 for EGR introduction according to a nineteenth embodiment. The EGR introduction pipe 332 of the 19th embodiment is inserted diametrically into the inlet pipe section 23 and formed with first and second EGR introduction openings 333*a* and 333*b* like the EGR introduction pipe 332 shown in FIGS. 51~55 according to the 15th embodiment. According to the 19th embodiment, each of the first and second EGR introduction openings 333*a* and 333*b* opens in a direction inclined downstream so as to form an angle θ with respect to a cross sectional plane of the inlet pipe section 23 as shown in FIG. 68.

According to the 19th embodiment, the EGR introduction pipe 332 has the first and second EGR introduction openings 333*a* and 333*b* opened in the EGR introduction pipe 332 obliquely so as to facilitate a spiral flow. This arrangement can reduce the deposit formation by reducing the possibility of back ward flow of the EGR gas toward the throttle valve 27 and promote the mixing of the EGR gas with the fresh intake air by increasing the spiral flow and enabling the shift of the EGR introduction point upstream toward the throttle valve 27.

In the same manner, it is optional to incline the opening direction of at least one EGR introduction opening in each of the 15th through 18th embodiments to achieve the same effect.

20th Embodiment

Figure 69:
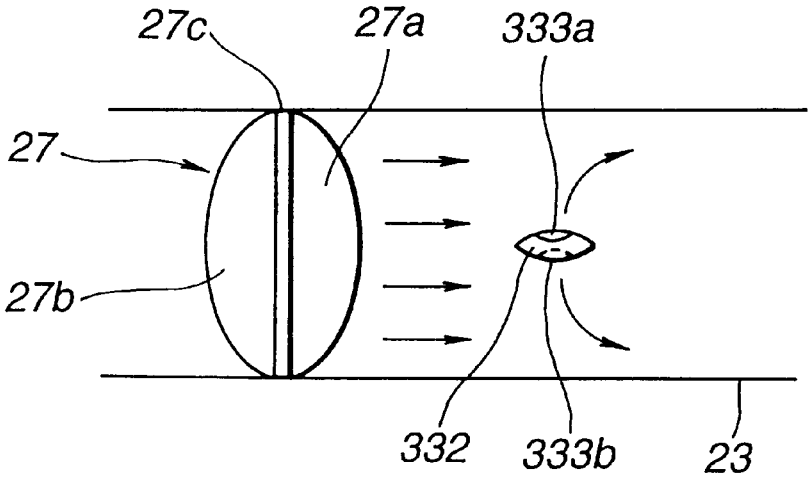
FIG. 69 is a schematic horizontal longitudinal sectional view showing EGR introduction openings according to a twentieth embodiment.
Figure 70:
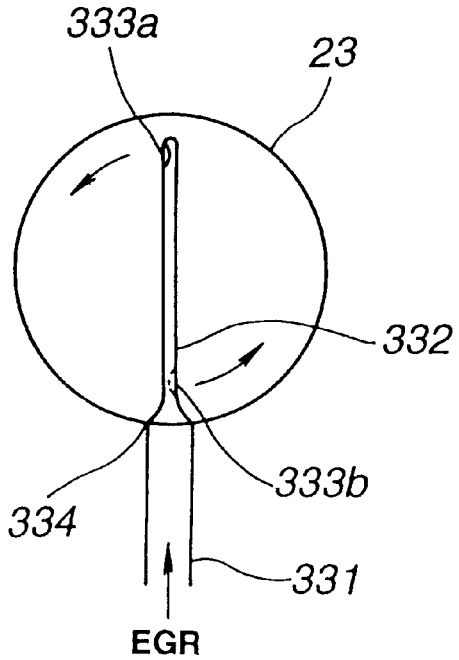
FIG. 70 is a cross sectional view showing an engine system according to a twenty-first embodiment.

FIGS. 69 and 70 shows an EGR introduction pipe 332 according to a twentieth embodiment. The EGR introduction pipe 332 is formed in a streamline shape to reduce the resistance to the fluid flow in the intake passage. The cross sectional shape of the EGR introduction pipe 332 is elongated along the longitudinal direction of the intake passage, as shown in FIG. 69. The cross sectional shape of the EGR introduction pipe 332 is tapered and sharpened toward each of upstream and downstream ends.

In the other respects, the EGR introduction pipe 332 shown in FIGS. 69 and 70 is substantially identical to the EGR introduction pipe 332 shown in FIGS. 51, 52 and 53. It is optional to employ an EGR introduction pipe 332 having a streamlined cross section in any of the 15th through 19th embodiments.

21st Embodiment

Figure 71:
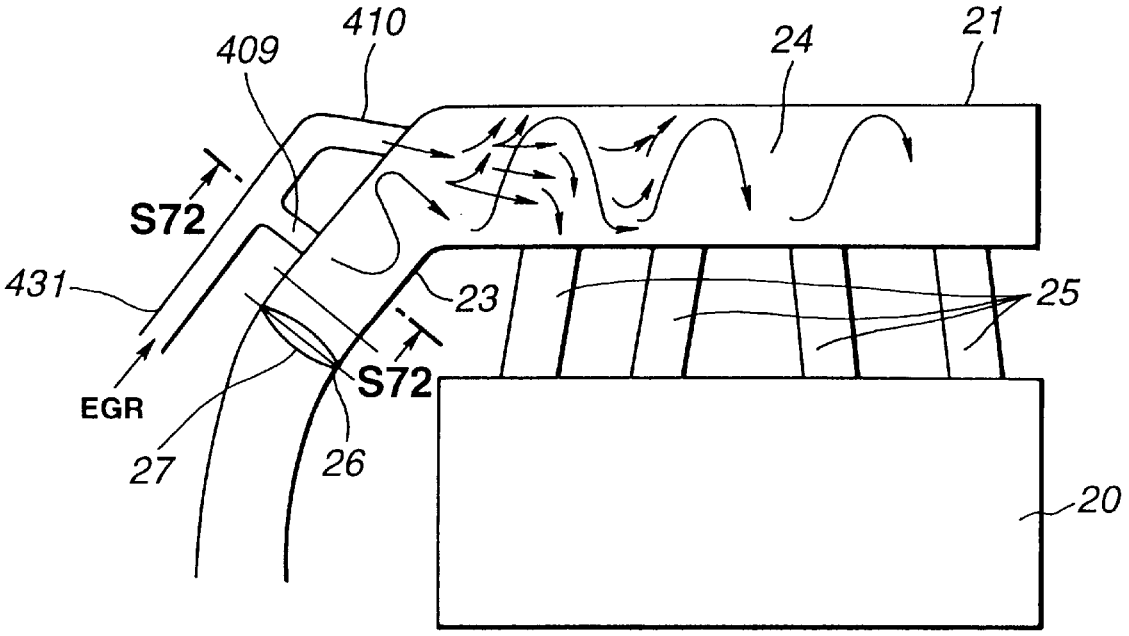
Figure 72:
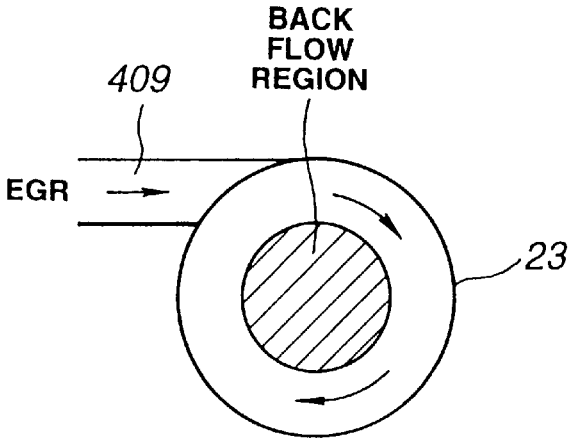
FIG. 72 is a schematic cross sectional view showing an upstream EGR introduction openings of the engine system of FIG. 71.

FIGS. 71 and 72 show an EGR system according to a twenty-first embodiment.

In this embodiment, an EGR passage 431 bifurcates into a first branch passage having a first EGR introduction port 409 and a second branch passage having a second EGR introduction port 410. The first EGR introduction port 409 opens tangentially into the inlet pipe section 23 at an upstream EGR introduction point downstream of the throttle valve 27 and upstream of the manifold collector section 24. The second EGR introduction port 410 opens toward the center of the collector section 24 at a downstream EGR introduction point downstream of the upstream EGR introduction point. In this example, the downstream EGR introduction port 410 opens toward a central region of a upstream end portion of the collector section 24 along a direction to produce an EGR stream toward the downstream end of the collector section 24.

The tangentially extending first (upstream) EGR introduction port 409 produces a spiral flow in the same manner as in the preceding embodiments to improve the homogeneous mixing and the deposit reduction. This spiral flow promotes the diffusion of the EGR gas introduced from the second EGR introduction port 410.

The EGR gas introduced from the first EGR port 409 tends to flow into the branches 25 in the upstream part and the EGR gas introduced from the second (downstream) EGR port 410 tends to flow into the branches 25 in the downstream part. The separation of the first and second EGR introduction points along the longitudinal direction of the intake air passage helps reduce the nonuniformity in the EGR distribution among the cylinders. The uniform EGR distribution is advantageous to the stability of the engine, the fuel economy and emission control.

The downstream EGR introduction port 410 remote from the throttle valve 27 is exempt from the influence of the back flow region and hence advantageous to the deposit reduction.

22nd Embodiment

Figure 73:
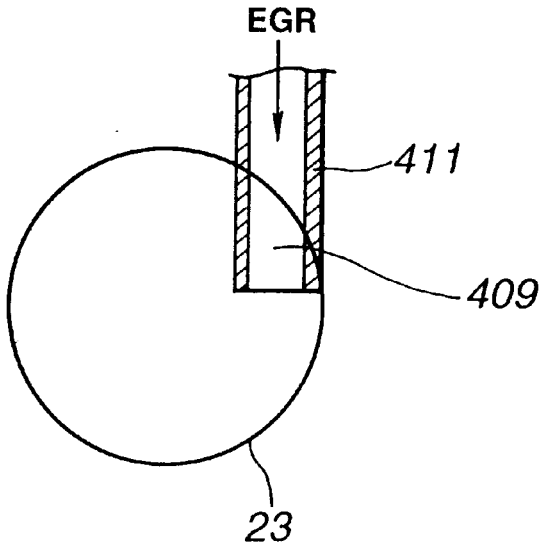
FIG. 73 is a schematic cross sectional view showing an upstream EGR introduction opening according to a twenty-second embodiment.
Figure 74:
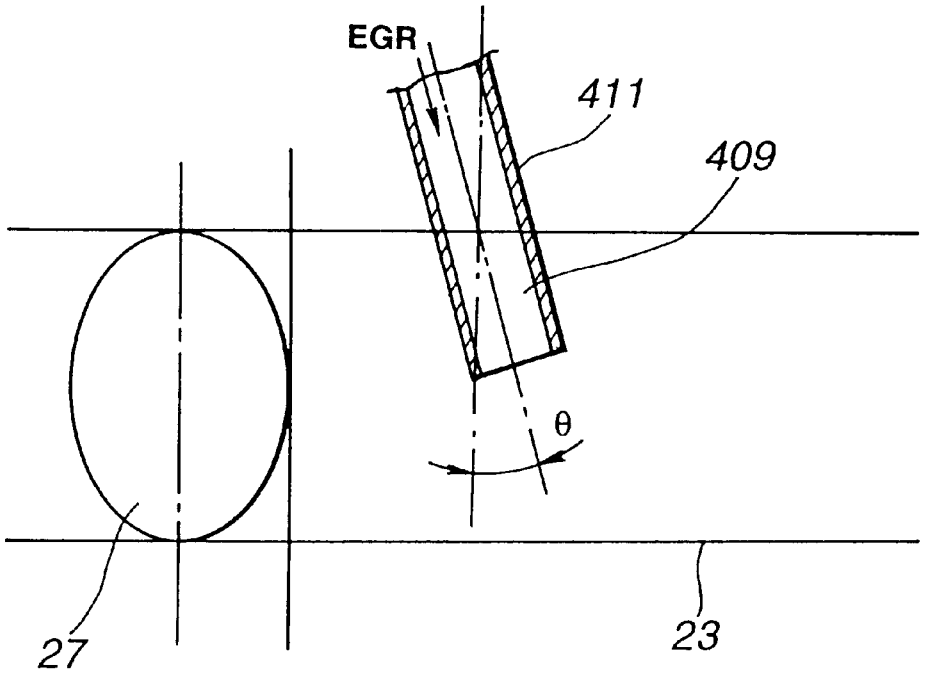
FIG. 74 is a schematic horizontal longitudinal sectional view showing the upstream EGR introduction opening of FIG. 73.

FIGS. 73 and 74 show an EGR system according to a twenty-second embodiment. The EGR system of this embodiment has upstream and downstream EGR introduction ports 409 and 410 as in the 21st embodiment. The upstream EGR introduction port 409 according to the 22nd embodiment has a guide pipe 411 projecting into the inlet pipe section 23. In the example shown in FIGS. 73 and 74, the guide pipe 411 is inclined downstream so as to form an angle θ with a cross sectional plane of the inlet pipe section 23 as shown in FIG. 74.

23rd Embodiment

Figure 75:
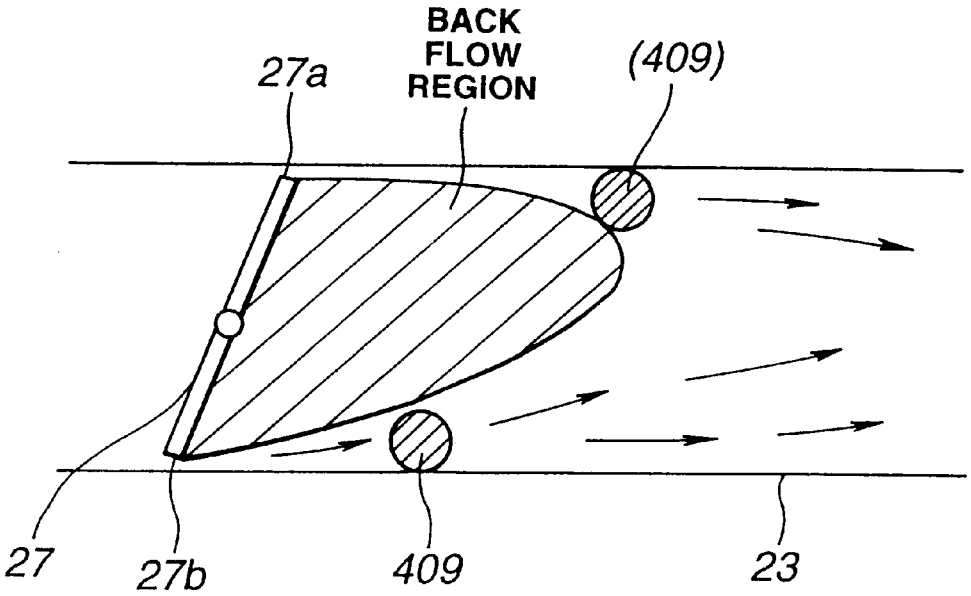
FIG. 75 is a schematic vertical longitudinal sectional view showing an upstream EGR introduction opening according to a twenty-third embodiment.
Figure 76:
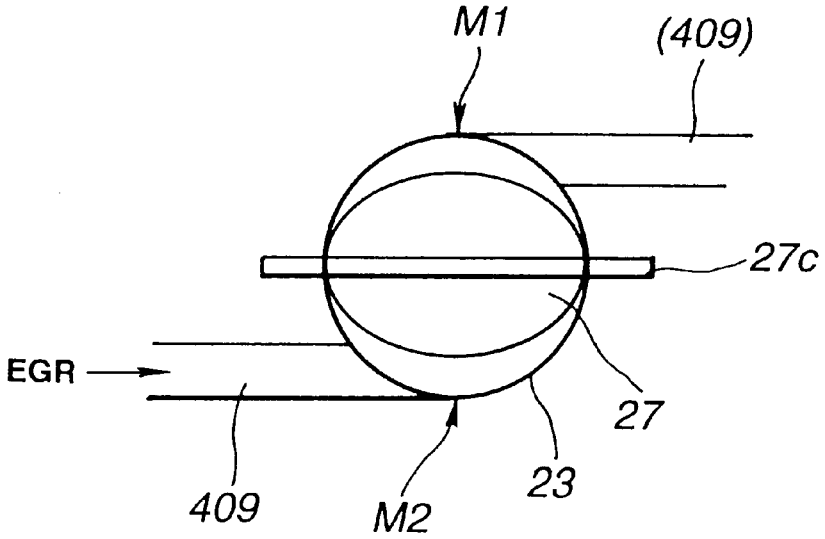
FIG. 76 is a schematic cross sectional view showing the upstream EGR introduction opening of FIG. 75.

FIGS. 75 and 76 show an EGR system according to a twenty-third embodiment. The EGR system of this embodiment has upstream and downstream EGR introduction ports 409 and 410 as in the 21st and 22nd embodiments. The upstream EGR introduction port 409 according to the 23rd embodiment is opened at one of the diagonally opposite circumferential positions M1 and M2 on the second imaginary center plane C2 to which the shaft 27*c* of the throttle valve 27 is perpendicular.

24th Embodiment

Figure 77:
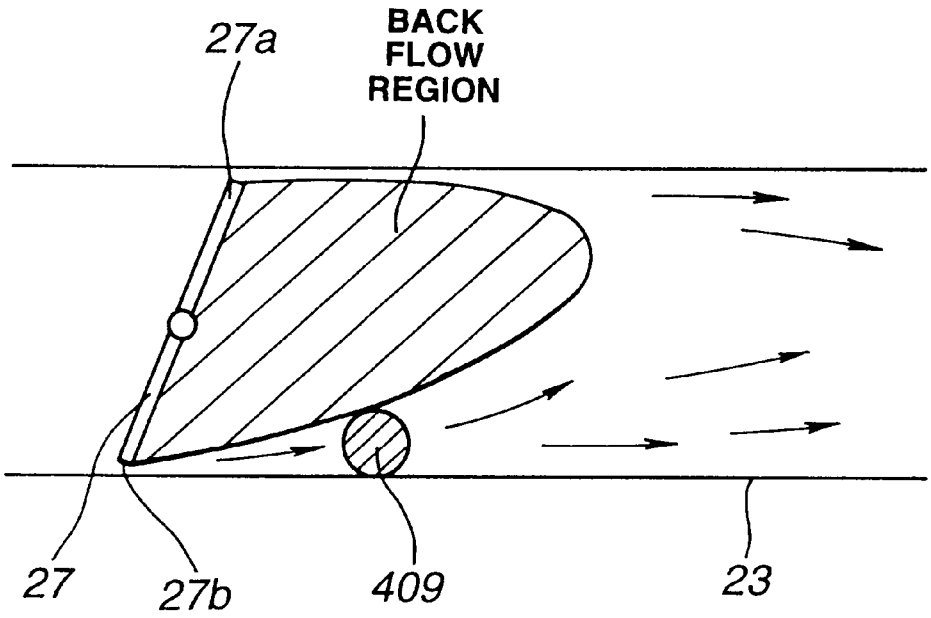
FIG. 77 is a schematic vertical longitudinal sectional view showing an upstream EGR introduction opening according to a twenty-fourth embodiment.
Figure 78:
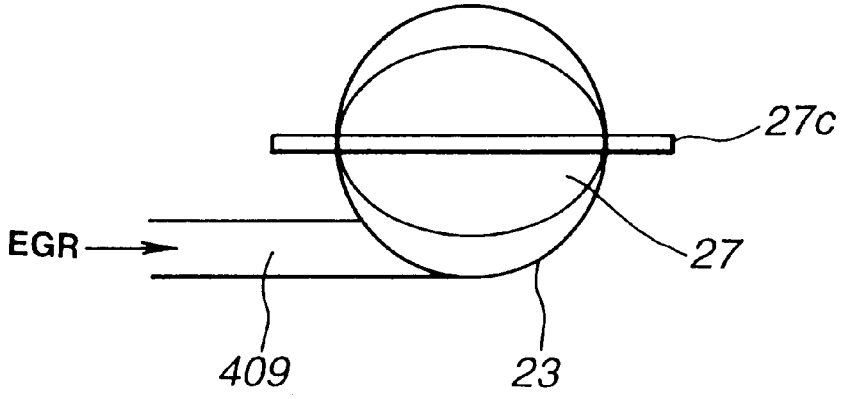
FIG. 78 is a schematic cross sectional view showing the upstream EGR introduction opening of FIG. 77.

FIGS. 77 and 78 show an EGR system according to a twenty-fourth embodiment. The EGR system of this embodiment has upstream and downstream EGR introduction ports 409 and 410 as in the 21st, 22nd and 23rd embodiments. The upstream EGR introduction port 409 according to the 24th embodiment is opened at the second (lower) circumferential position M2 downstream of the position of the upstream swing end 27*b* of the fully closed throttle valve 27.

25th Embodiment

Figure 79:
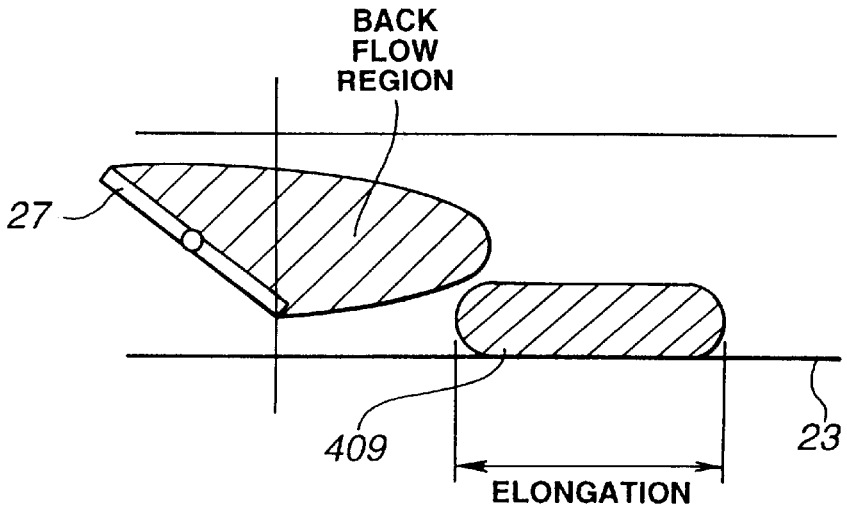
FIG. 79 is a schematic vertical longitudinal sectional view showing an upstream EGR introduction opening according to a twenty-fifth embodiment.

FIG. 79 shows show an EGR system according to a twenty-fifth embodiment. The EGR system of this embodiment has upstream and downstream EGR introduction ports 409 and 410 as in the 21st through 24th embodiments. As shown in FIG. 79, the upstream EGR introduction port 409 of the 25th embodiment has an EGR introduction opening which is elongated along the longitudinal direction of the intake passage. The EGR introduction opening defined by the open end of the upstream EGR introduction port 409 is located at a circumferential position downstream of one swing end of the throttle valve 27. The elongated EGR introduction opening reduces the undesired influence of the back flow region and enables the reduction of the distance from the throttle valve 27 to the EGR introduction point.

26th Embodiment

Figure 80:
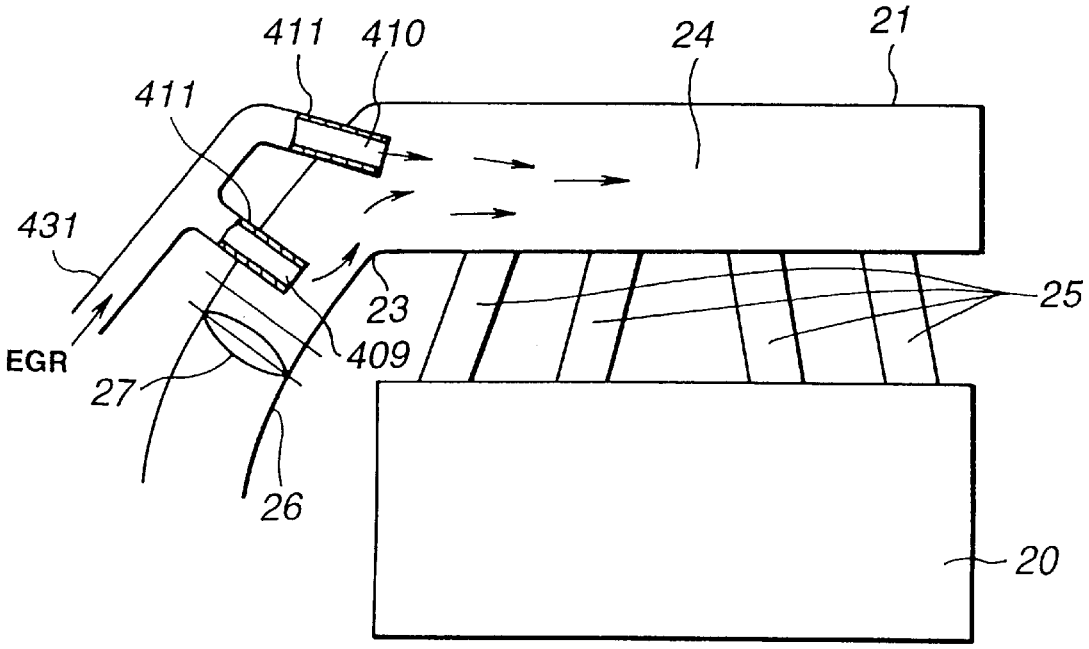
FIG. 80 is a schematic view showing an engine system according to a twenty-sixth embodiment.

FIG. 80 shows an EGR system according to a twenty-sixth embodiment. The EGR system of this embodiment has upstream and downstream EGR introduction ports 409 and 410 as in the 21st through 25th embodiments. In the 26th embodiment, as shown in FIG. 80, both the upstream and downstream EGR introduction ports 409 and 410 have a guide pipe 411. In the example of FIG. 80, the guide pipe 411 of the upstream port 409 projects in the inlet pipe section 23, to an upstream EGR introduction point near the second (vertical) center plane C2. The guide pipe 411 of the downstream port 410 extends approximately in a longitudinal direction of the manifold collector section 24 toward the downstream end of the collector section 24, and projects into the downstream end portion of the inlet pipe section 23, to a downstream EGR introduction point located near the central region of the upstream end portion of the collector section 24. In the example of FIG. 80, the guide pipe 411 of the downstream port 410 opens at the downstream EGR introduction point closer to, and slightly upstream of, the upstream end of the collector section 24, and facilitates the flow of the EGR gas from the downstream port 410 into the branches 25 in the upstream part.

27th Embodiment

Figure 81:
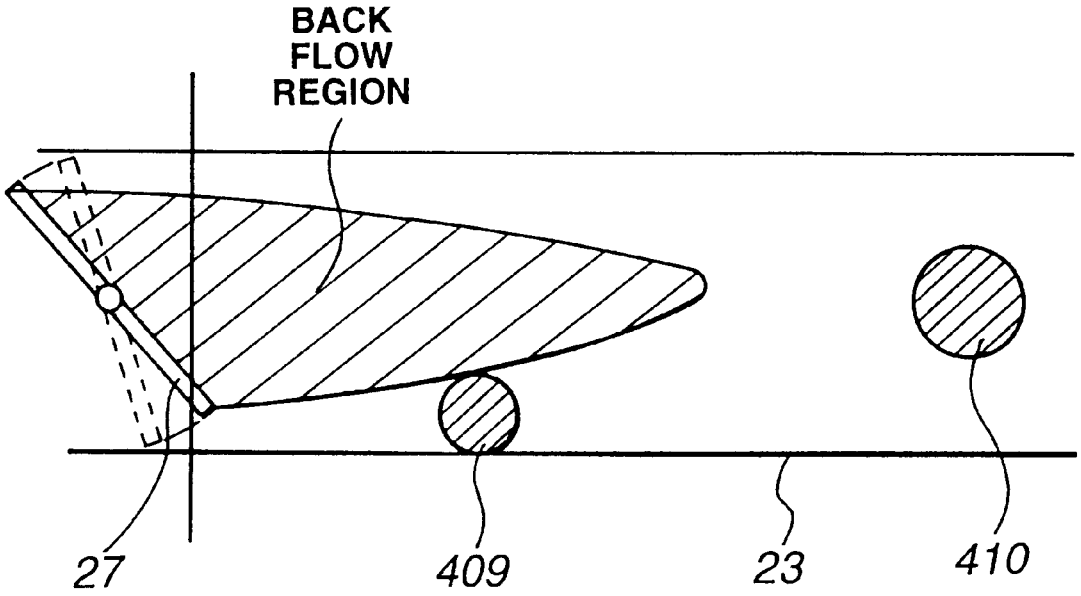
FIG. 81 is a schematic vertical longitudinal sectional view showing EGR introduction openings according to a twenty-seventh embodiment.

FIG. 81 shows an EGR system according to a twenty-seventh embodiment. The EGR system of this embodiment has upstream and downstream EGR introduction ports 409 and 410 as in the 21st through 26th embodiments. In the 27th embodiment, as shown in FIG. 81, the opening area of the upstream EGR introduction port 409 disposed closely behind the throttle valve 27 is smaller than the opening area of the downstream EGR introduction port 410. The upstream EGR introduction port 409 having the smaller EGR introduction opening functions to reduce the deposit formation on the throttle valve 27.

28th Embodiment

Figure 82:
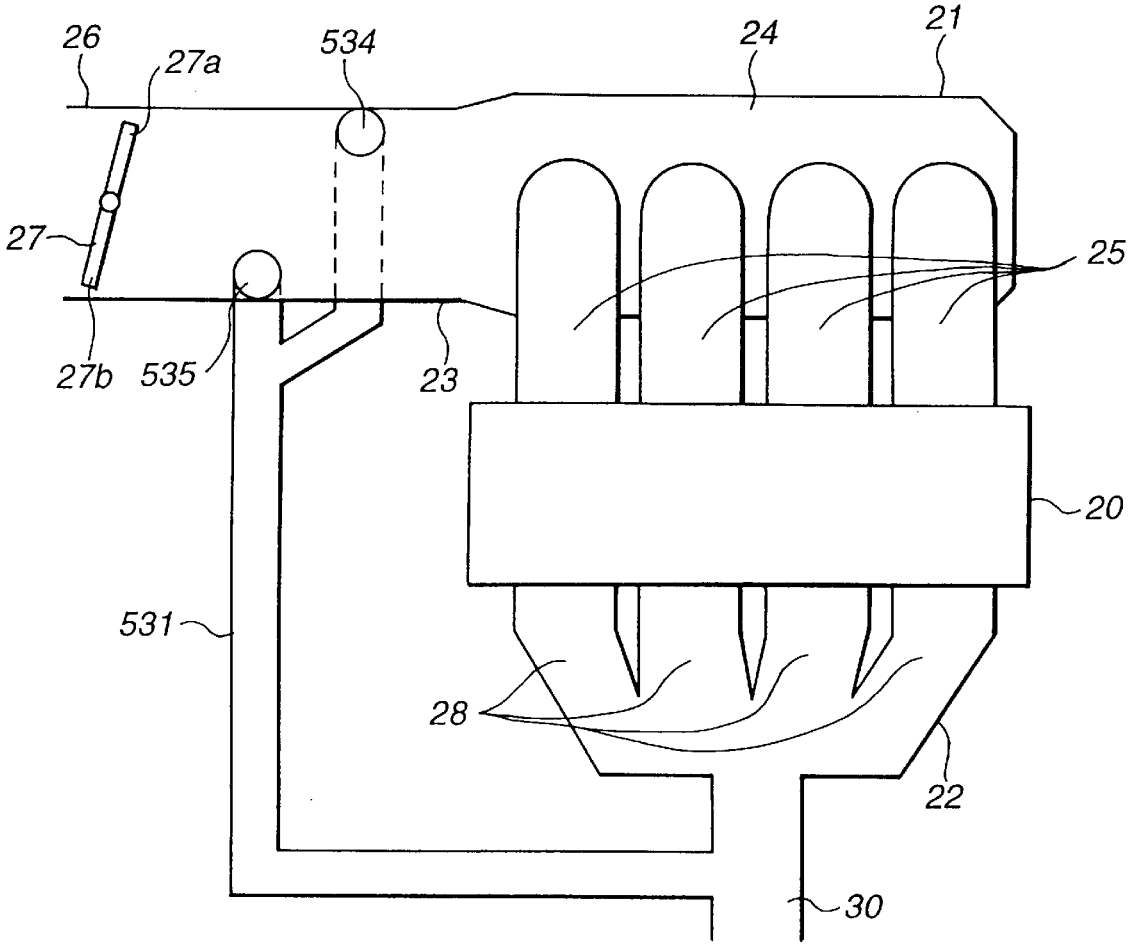
FIG. 82 is a schematic view showing an engine system according to a twenty-eighth embodiment.
Figure 83:
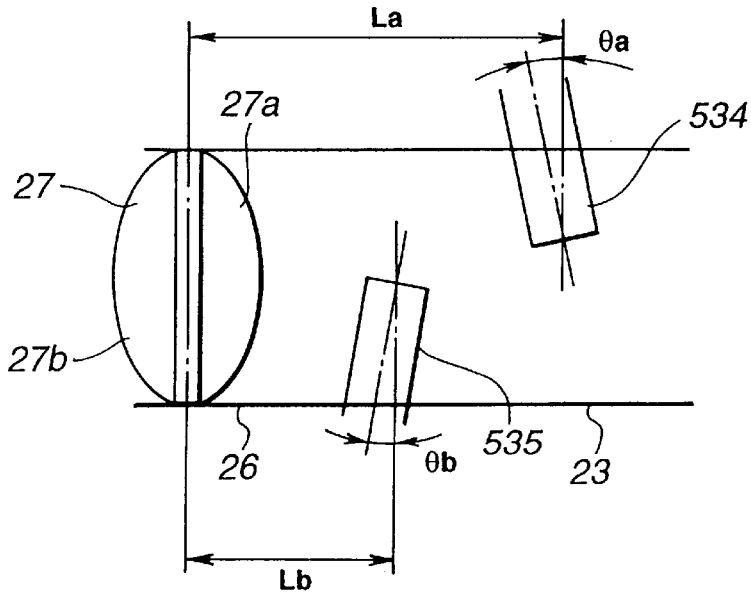
FIG. 83 is a schematic horizontal longitudinal sectional view showing EGR introduction openings of the engine system of FIG. 82.
Figure 84:
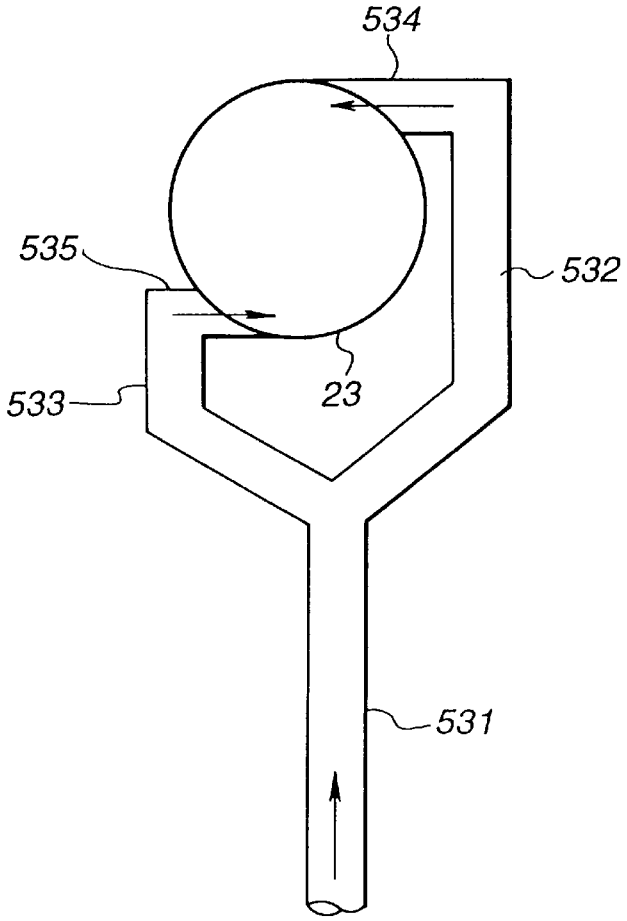
FIG. 84 is a schematic cross sectional view showing the EGR introduction openings of FIG. 83.

FIGS. 82~84 show an engine system according to a twenty-eighth embodiment. The intake and exhaust systems are substantially identical to the systems of the preceding embodiments. The EGR system shown in FIG. 82 has an EGR passage 531 bifurcates into first and second branch passages 532 and 533 as shown in FIG. 84. The first and second branch passages 532 and 533 have, respectively, first and second EGR introduction ports 534 and 535 which extend in parallel but opposite tangential directions and open into the inlet pipe section 23 at diametrically opposite circumferential positions in the same rotational direction (the counterclockwise direction as viewed in FIG. 84) around the longitudinal center line of the inlet pipe section 23. The EGR introduction opening of the first EGR port 534 is located downstream of the circumferential position of the downstream swing end 27*a* of the throttle valve 27, and the EGR introduction opening of the second EGR port 535 is located downstream of the circumferential position of the upstream swing end 27*b*. Each of the first and second EGR ports 534 and 535 is inclined downstream so as to form a predetermined angle (lead angle) with a cross sectional plane of the inlet pipe section 23.

In the 28th embodiment, the longitudinal (or axial) distance Lb from the position of the swing axis of the throttle valve 27 to the position of the EGR introduction opening of the second EGR port 535 in the rear of the upstream swing end 27*b* of the throttle valve 27 is smaller than the longitudinal (or axial) distance La from the position of the swing axis of the throttle valve 27 to the position of the EGR introduction opening of the first EGR port 534 in the rear of the downstream swing end 27*a* of the throttle valve 27, along the longitudinal (or axial) direction of the inlet pipe section 23, as shown in FIG. 83.

Figure 85:
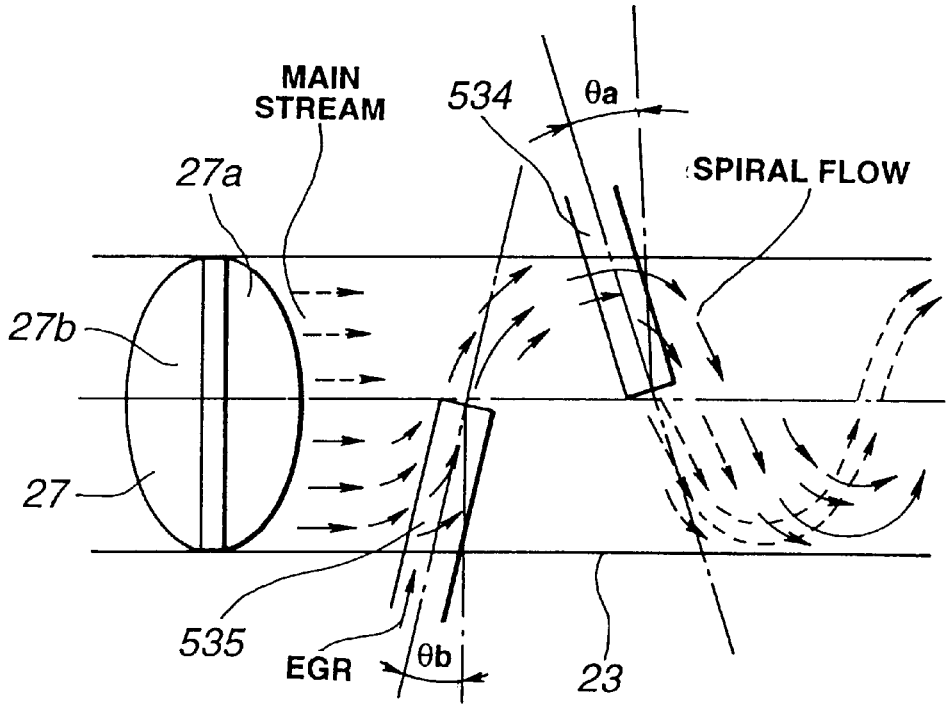
FIG. 85 is a schematic horizontal longitudinal sectional view showing EGR streams produced by the EGR introduction opening of FIG. 83.
Figure 86:
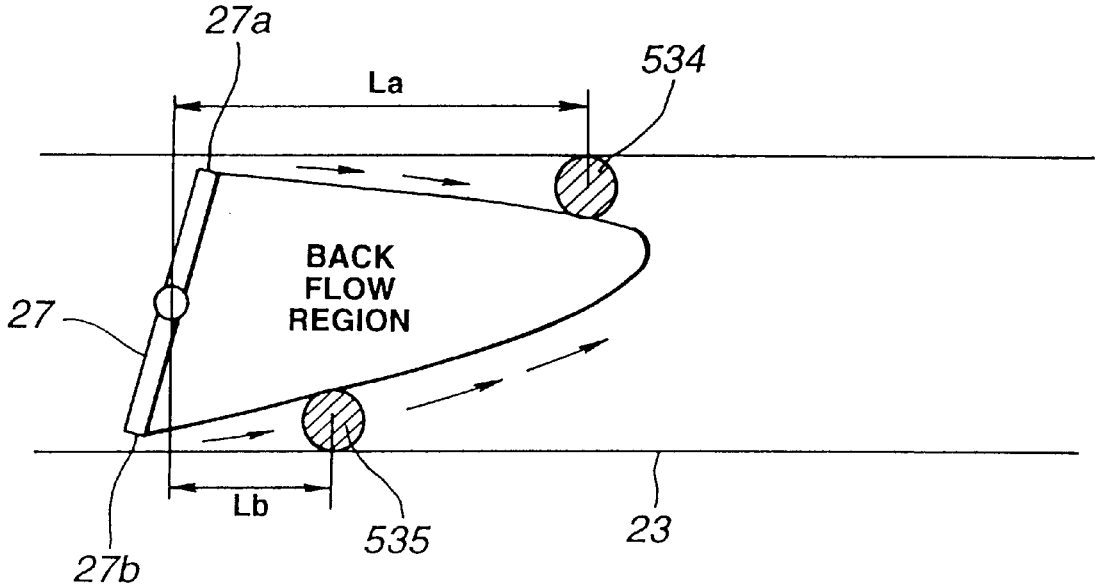
FIG. 86 is a schematic vertical longitudinal sectional view for showing the positions of the EGR introduction openings of FIG. 83.

The first and second EGR port 534 and 535 produce a spiral flow as shown in FIG. 85. The reduction of the distance Lb on the same side as the upstream swing end 27*b* is effective for uniform EGR distribution, and possible without increasing the interference with the back flow region as shown in FIG. 86 specifically when there is no bend between the inlet pipe section 23 and the manifold collector section 24.

29th Embodiment

Figure 87:
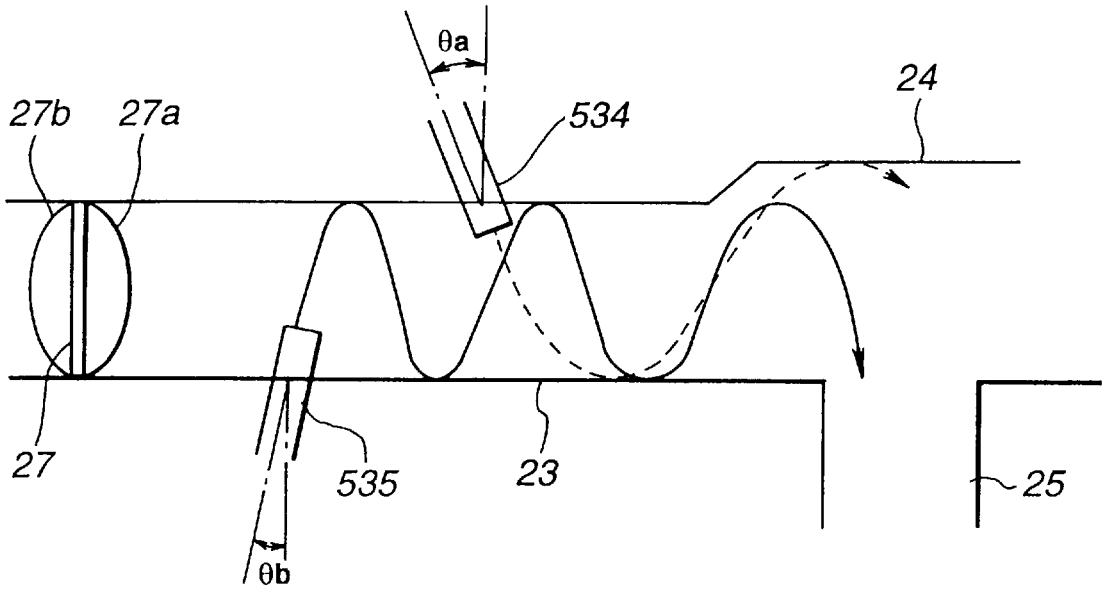
FIG. 87 is a schematic horizontal longitudinal sectional view showing EGR introduction openings according to a twenty-ninth embodiment.

FIG. 87 shows an EGR system according to a twenty-ninth embodiment. The EGR system of FIG. 87 has first and second EGR introduction ports 534 and 535 similar to the first and second EGR introduction ports according to the 28th embodiment. Unlike the 28th embodiment, the downstream inclination angels (or lead angles) of the first and second EGR introduction ports 534 and 535 according to the 29th embodiment are not equal. The downstream inclination angle (or lead angle) θb of the second EGR port 535 located downstream of the upstream swing end 27*b* of the throttle valve 27 is smaller than the downstream inclination angle θa of the first EGR port 535 downstream of the downstream swing end 27*a* of the throttle valve 27.

Therefore, the second EGR port 535 can produce a spiral flow having a smaller pitch (so that the spiral flow advances through a shorter distance along the longitudinal or axial direction of the intake passage, per revolution of the spiral) and thereby increase the travel distance of the EGR gas along the spiral path for uniform EGR distribution among the cylinders. After the travel through an angular distance of about 180° along the inside cylindrical surface of the inlet pipe section 23, part of the spiral flow from the EGR port 535 may traverse the back flow region. However, this partial traverse of the spiral flow is not so disadvantage to the deposit reduction because the travel half around the central zone can bring a considerable progress in mixing the EGR gas with the fresh intake air, and prevent direct influx of thick EGR gas into the back flow region.

In the example shown in FIG. 87, the first and second EGR ports 534 and 535 are differentiated in both the downstream inclination angle θ and the longitudinal distance L from the swing axis of the throttle valve 27.

30th Embodiment

Figure 88:
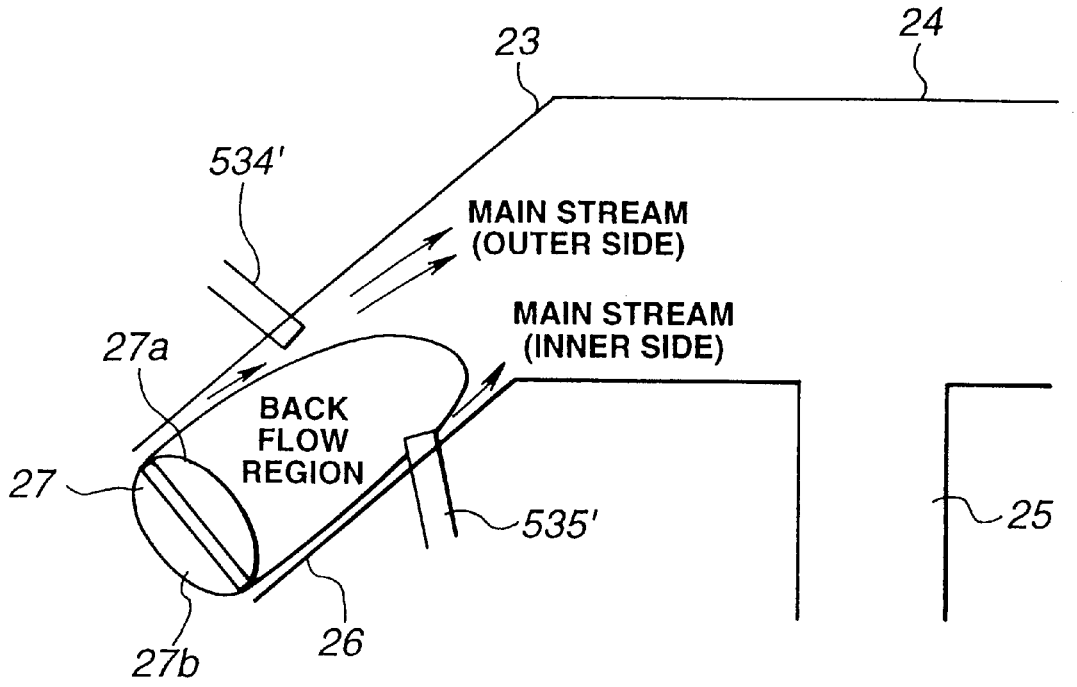
FIG. 88 is a schematic horizontal longitudinal sectional view for showing a bend in an intake system according to a thirtieth embodiment.
Figure 89:
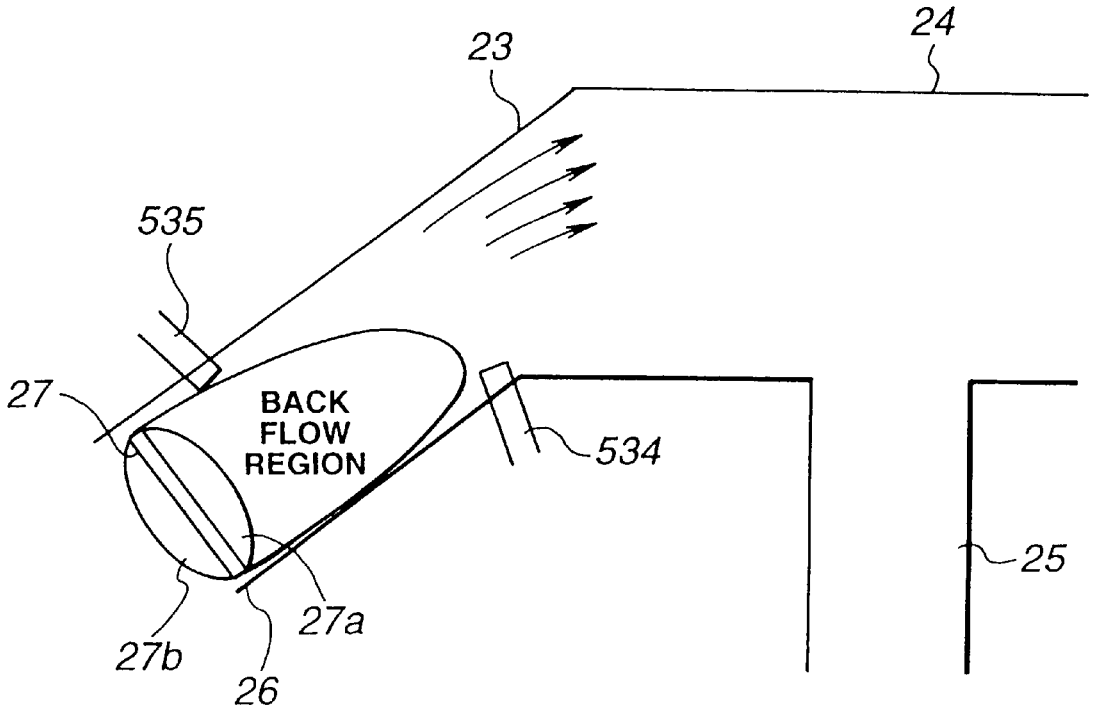
FIG. 89 is a schematic horizontal longitudinal sectional view showing EGR introduction openings according to the thirtieth embodiment.

FIG. 89 shows an EGR system according to a thirtieth embodiment. In this embodiment, there is a bend between the intake passage and the manifold collector section 24. As shown in FIG. 89, the longitudinal direction of the manifold collector section 24 is inclined with respect to the longitudinal direction of the intake passage defined by the manifold inlet pipe section 23 and the throttle body 26 in an imaginary plane containing the swing axis of the throttle valve 27. In such an intake system, the main stream is stronger on the outer side than on the inner side of the bend, and hence the back flow region becomes larger on the inner side and smaller on the outer side, as shown in FIG. 88.

In the example shown in FIG. 89, therefore, the EGR introduction opening of the first EGR introduction port 534 downstream of the downstream swing end 27*a* of the throttle valve 27 is located on and toward the inner side of the bend, and the EGR introduction opening of the second EGR introduction port 535 downstream of the upstream swing end 27*b* of the throttle valve 27 is located on and toward the outer side of the bend, by contrast to the opposite arrangement shown in FIG. 88 for comparison. In the example shown in FIG. 89, the position of the first EGR opening of the first EGR port 534 remains unchanged on the inner side where the back flow region is more influential. On the outer side of the bend where the back flow region is small, the position of the EGR introduction opening of the second EGR port 535 behind the upstream swing end 27*b* of the throttle valve 27 is shifted largely upstream toward the throttle valve 27 to increase the travel distance of the EGR gas. In the comparative example shown in FIG. 88, by contrast, it is difficult to shift the position of the EGR opening of the EGR port 534' behind the downstream swing end 27*a* of the throttle valve 27, upstream toward the throttle valve 27 without increasing the deposit because the back flow region is dominant in the rear of the downstream swing end 27*a* as shown in FIG. 86.

31st Embodiment

Figure 91:
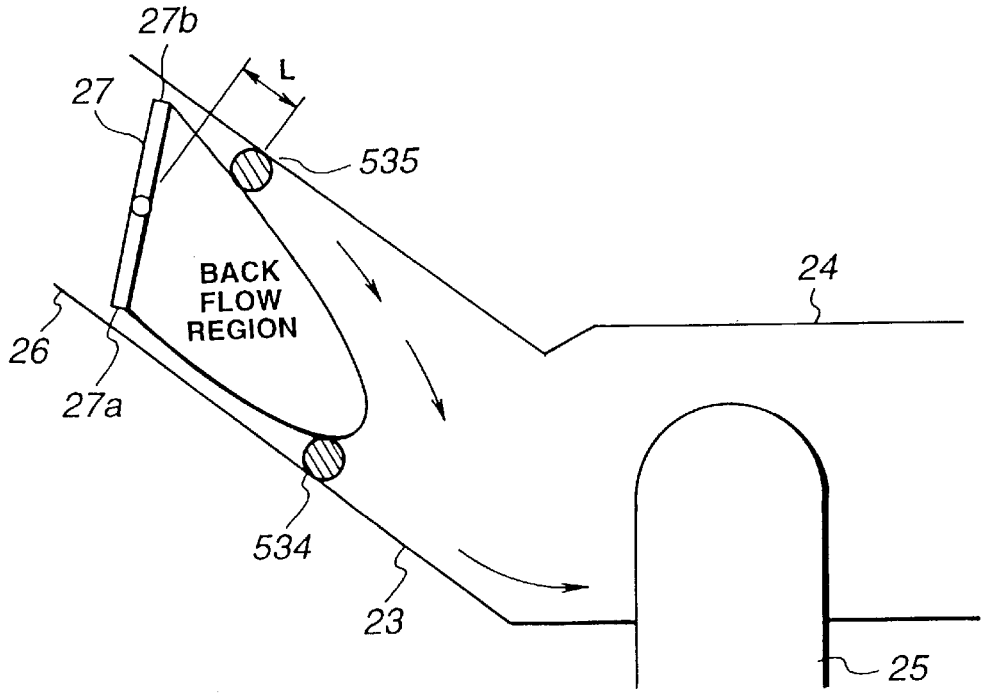
FIG. 91 is a schematic vertical longitudinal sectional view showing EGR introduction openings according to the thirty-first embodiment.

FIG. 91 shows an EGR system according to a thirty-first embodiment. In this embodiment, there is a bend between the intake passage and the manifold collector section 24, and the longitudinal direction of the manifold collector section 24 is inclined with respect to the longitudinal direction of the intake passage defined by the manifold inlet pipe section 23 and the throttle body 26 in an imaginary plane to which the swing axis of the throttle valve 27 is perpendicular. In such an intake system, a strong fresh main stream flows from the inner side of the bend toward the outer side of the bend, so that the back flow region grows larger on the outer side of the bend and becomes smaller on the inner side of the bend as shown in FIG. 91.

Figure 90:
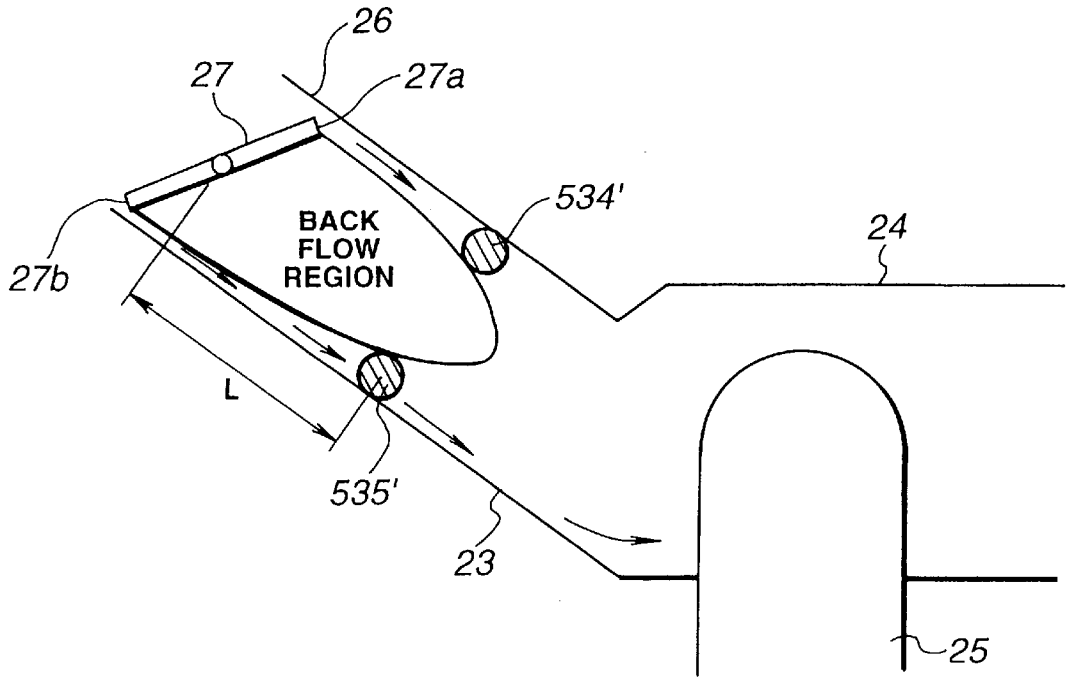
FIG. 90 is a schematic vertical longitudinal sectional view showing a bend in an intake system according to a thirty-first embodiment.

In the example shown in FIG. 91, therefore, the throttle valve 27 is so arranged that the downstream swing end 27*a* is located on the outer side and the upstream swing end 27*b* is located on the inner side of the bend, instead of the opposite arrangement shown in FIG. 90 for comparison. Therefore, the strong main stream from the upstream swing end 27*b* on the inner side flows toward the outer side of the bend, and thereby decreases the back flow region on the inner side behind the upstream swing end 27*b*. On the inner side of the bend where the back flow region is reduced, the position of the EGR introduction opening of the second EGR port 535 behind the upstream swing end 27*a* of the throttle valve 27 is shifted largely upstream toward the throttle valve 27 to decrease the longitudinal distance L from the throttle valve 27 to the EGR introduction point and to increase the travel distance of the EGR gas. In the comparative example shown in FIG. 90, by contrast, it is difficult to shift the position of the EGR opening of the EGR port 535 behind the upstream swing end 27*b* of the throttle valve 27, upstream toward the throttle valve 27 without increasing the deposit because the back flow region grows larger in the rear of the upstream swing end 27*b*.

32nd Embodiment

Figure 92:
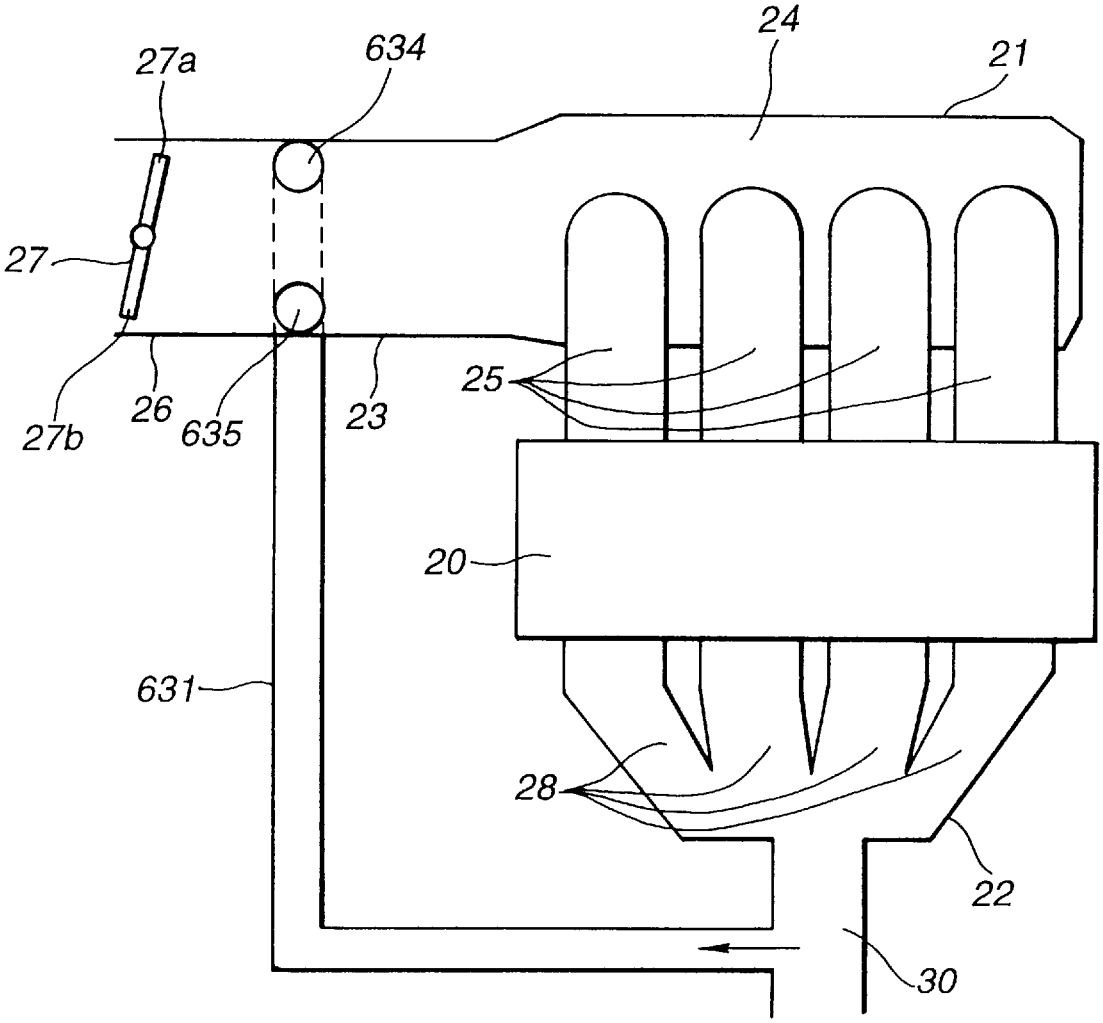
FIG. 92 is a schematic view showing an engine system according to a thirty-second embodiment.
Figure 93:
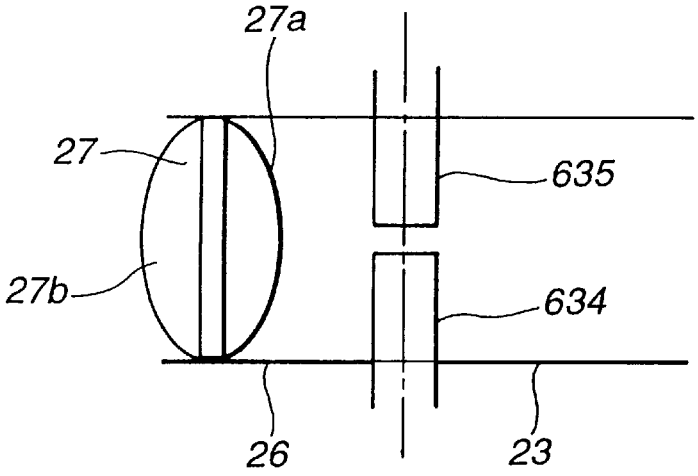
FIG. 93 is a schematic horizontal longitudinal sectional view of an intake passage for showing EGR introduction openings of the engine system of FIG. 92.
Figure 94:
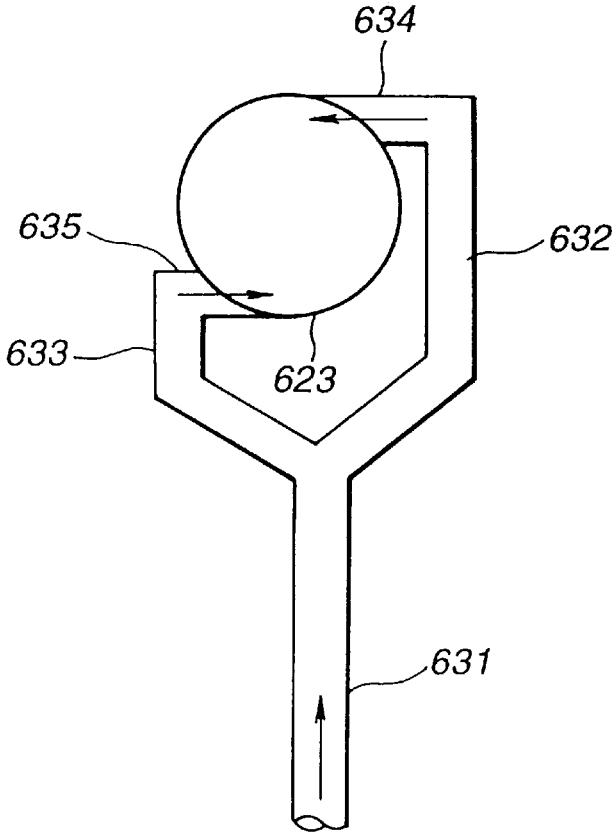
FIG. 94 is a schematic cross sectional view showing the EGR introduction openings of FIG. 93.

FIGS. 92~96 show an engine system according to a thirty-second embodiment. The engine system shown in FIG. 92 is substantially identical to the engine system shown in FIG. 1 except for the inclination angles of the EGR introduction ports. An EGR passage 631 bifurcates into a first branch passage 632 having a first EGR introduction port 634 and a second branch passages 633 having a second EGR introduction port 635. Each of the first and second EGR introduction ports 634 and 635 has an EGR introduction opening formed at the port end, and the first and second EGR introduction ports 634 and 635 are arranged, as shown in FIG. 94, in the same manner as FIG. 3. However, as shown in FIG. 93 (by contrast to FIG. 2), each of first and second EGR introduction ports 634 and 635 is not inclined, but extends in an imaginary sectional plane to which the longitudinal center line of the inlet pipe section 23 is perpendicular.

Figure 95:
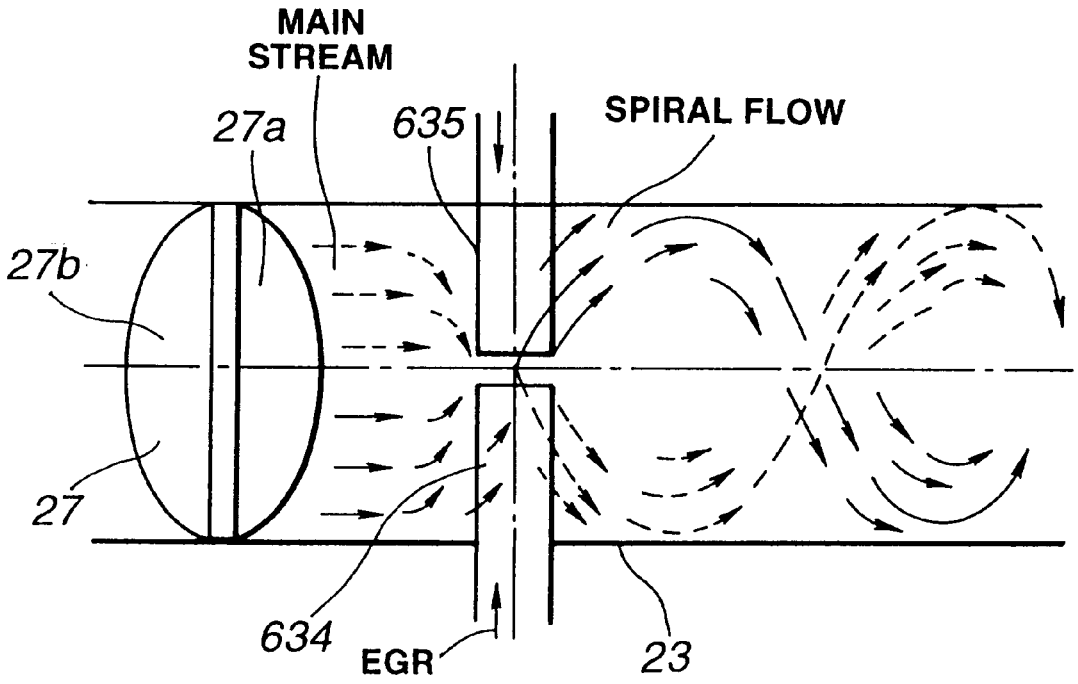
FIG. 95 is a schematic horizontal longitudinal sectional view for showing streams produced by the EGR introduction openings of FIG. 93.
Figure 96:
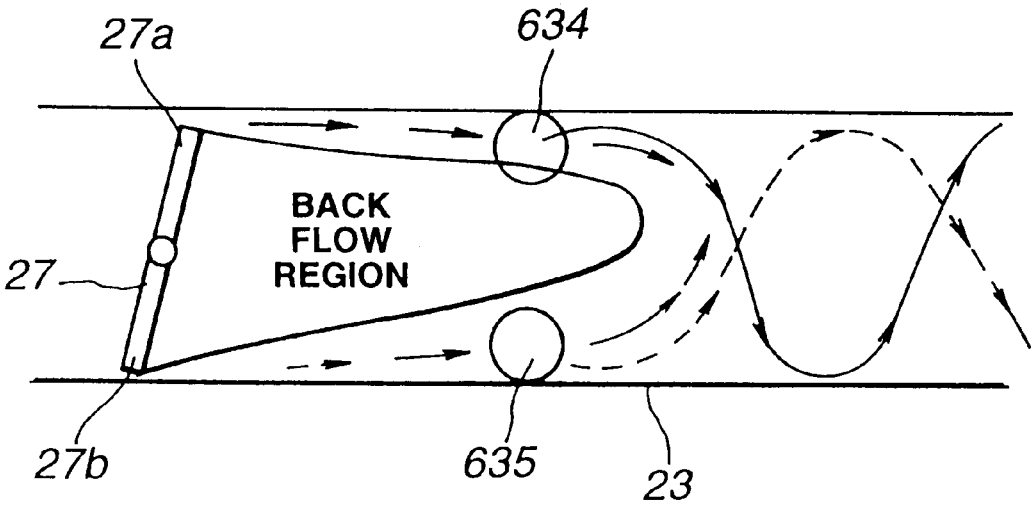
FIG. 96 is a schematic vertical longitudinal sectional view for showing the streams produced by the EGR introduction openings of FIG. 93.

The EGR gas introduced into the inlet pipe section 23 from each of the non-inclined EGR introduction ports 634 and 635 has only a velocity component along the tangential direction tangent to the circular cross section of the inlet pipe section 23. However, in the inlet pipe section 23, the EGR gas is pushed downstream by the fresh main stream (and thereby provided with a velocity component along the downstream direction of the fresh main stream). As a result, the EGR gas discharged from each EGR introduction port 634 or 635 produces a spiral flow as shown in FIGS. 95 and 96.

The first and second, non-inclined, tangential EGR introduction ports 634 and 635 can improve the EGR distribution and reduce deposit formation. Moreover, the non-inclined design facilitates manufacturing operations such as machining operation and assemblage. The non-inclined ports 634 and 635 can be formed only by processing along the longitudinal or axial direction of the inlet pipe section 23 and the normal direction perpendicular to the longitudinal direction of the inlet pipe section 23. The non-inclined ports can be formed by a two-axis (or two dimensional) machine, for example.

33rd Embodiment

Figure 97:
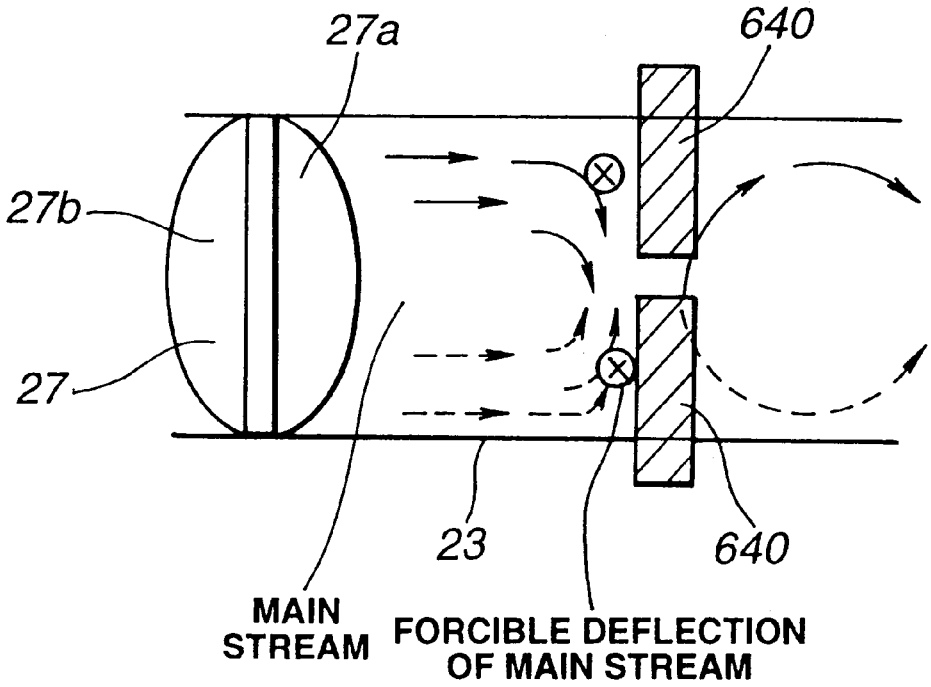
FIG. 97 is a schematic horizontal longitudinal sectional view showing EGR introduction openings according to a thirty-third embodiment.
Figure 98:
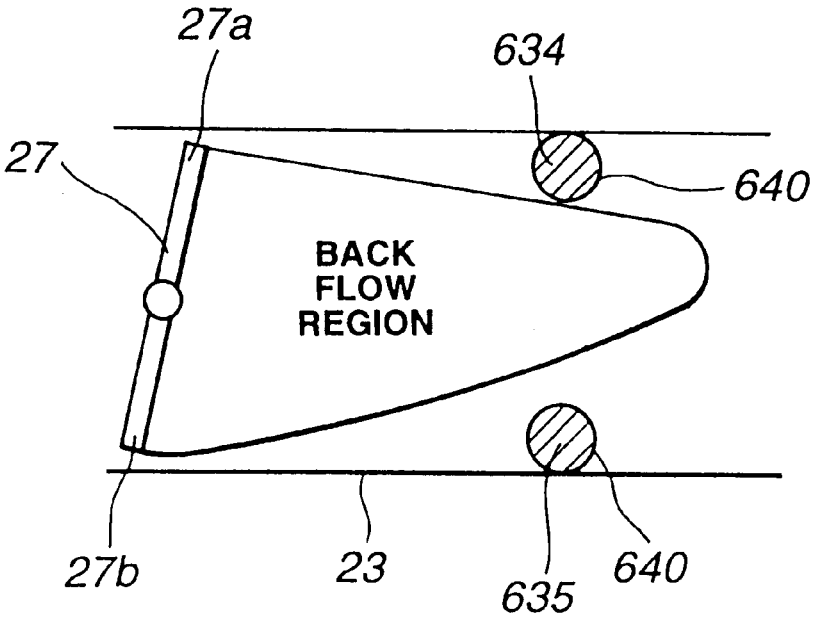
FIG. 98 is a schematic vertical longitudinal sectional view showing the EGR introduction openings of FIG. 97.
Figure 99:
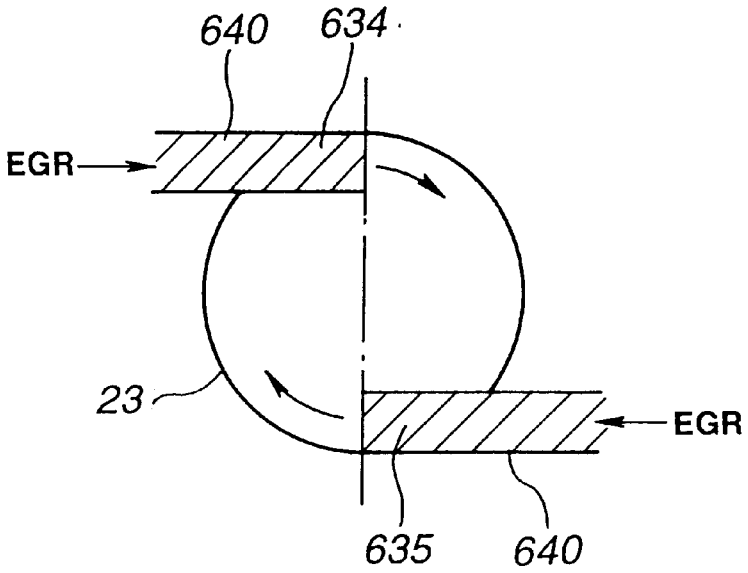
FIG. 99 is a schematic cross sectional view showing the EGR introduction openings of FIG. 97.

FIGS. 97~99 show an EGR system according to a thirty-third embodiment. The EGR system of this embodiment comprises first and second non-inclined EGR introduction ports 634 and 635 as in the 32nd embodiment. Each of the first and second non-inclined EGR ports 634 and 635 comprises a guide case 640 projecting into the inlet pipe section 23 and defining the EGR introduction opening as in the second embodiment shown in FIGS. 22~24.

34th Embodiment

Figure 100:
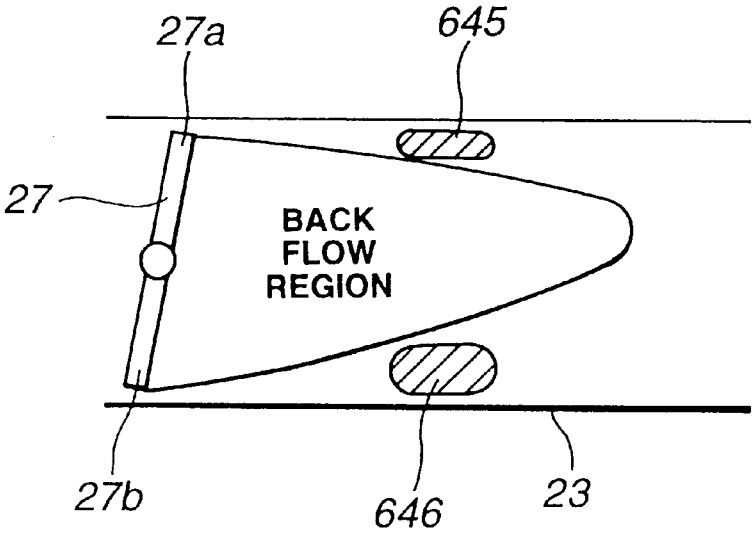
FIG. 100 is a schematic vertical longitudinal sectional view showing EGR introduction openings according to a thirty-fourth embodiment.
Figure 101:
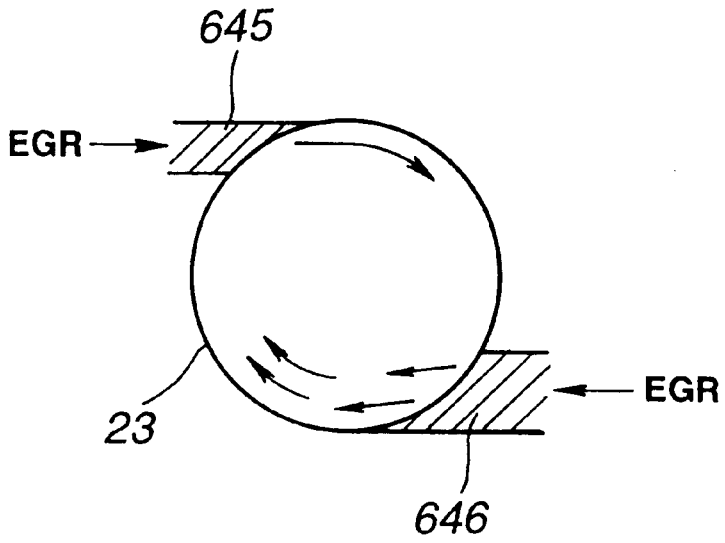
FIG. 101 is a schematic cross sectional view showing the EGR introduction openings of FIG. 100.

FIGS. 100 and 101 show an EGR system according to a thirty-fourth embodiment. The EGR system of this embodiment comprises first and second non-inclined EGR introduction ports 645 and 646 as in the 32nd and 33rd embodiments, and the cross sectional shape of each non-inclined EGR introduction port 645 or 646 is elongated along the longitudinal direction of the inlet pipe section 23 as in the third embodiment shown in FIGS. 25 and 26. In the example shown in FIGS. 100 and 101, the opening size of the EGR introduction opening formed at the end of the second EGR introduction port 646 in the rear of the upstream swing end 27*b* of the throttle valve 27 is greater than the opening size of the EGR introduction opening of the first EGR introduction port 645 in the rear of the downstream swing end 27*a* of the throttle valve 27, as in the example of FIGS. 25 and 26.

35th Embodiment

Figure 102:
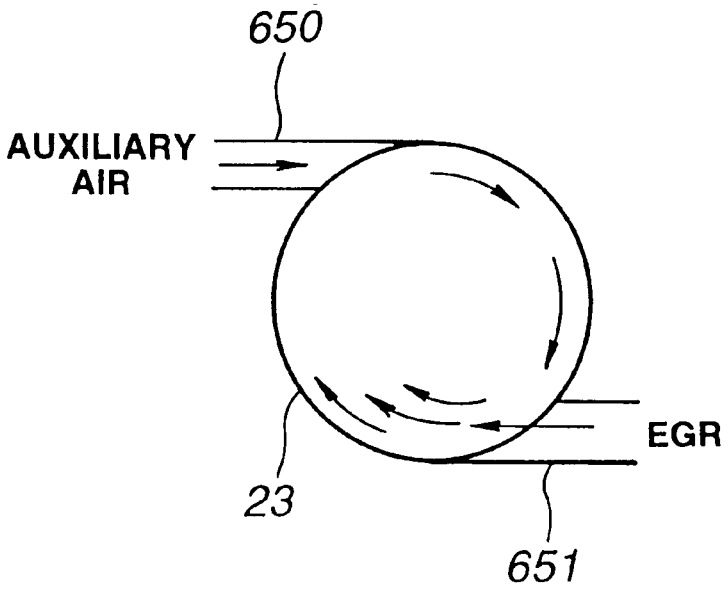
FIG. 102 is a schematic cross sectional view showing EGR introduction opening and auxiliary air introduction opening according to a thirty-fifth embodiment.

FIG. 102 shows a combination of EGR system and intake system according to a thirty-fifth embodiment. The system shown in FIG. 102 comprises first and second non-inclined tangential gas introduction ports 650 and 651 as in the 32nd through 34th embodiments. In the 35th embodiment, moreover, the EGR gas is introduced from the second introduction port 651 having the EGR introduction opening located just in the rear of the upstream swing end 27*b* of the throttle valve 27 whereas an auxiliary air is introduced from the first introduction port 650 having a gas introduction opening located just in the rear of the downstream swing end 27*a* of the throttle valve 27, as in the fourth embodiment shown in FIG. 27. The non-inclined EGR introduction port 651 is connected with the exhaust system, while the non-inclined auxiliary air introduction port 650 is connected with an upstream portion of the intake system located near an air cleaner on the upstream side of the throttle valve 27.

36th Embodiment

Figure 103:
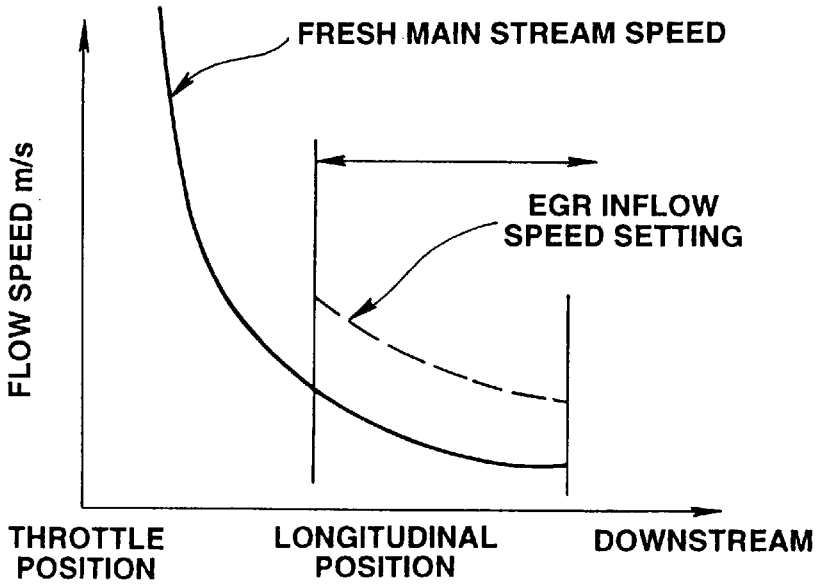
FIG. 103 is a graph for illustrating a thirty-sixth embodiment.

FIG. 103 is a graph for illustrating a thirty-sixth embodiment. The EGR system of this embodiment comprises first and second non-inclined tangential gas introduction ports as in the 32nd through 35th embodiments. In this embodiment, the first and second ports are EGR introduction ports, and the opening size (or opening area) of each of first and second non-inclined tangential EGR introduction ports is determined in accordance with the maximum speed of the fresh intake air passing through the throttle valve 27, the distance between the axis of the throttle valve 27 and the opening of the gas introduction port, and the EGR gas discharge speed (the speed of the EGR gas flowing into the inlet pipe section 23) modified by the shape of the opening of the introduction port, as in the sixth embodiment.

As shown in FIG. 103, the speed of a fresh main stream decreases as the distance from the throttle valve 27 in the downstream direction increases. The opening sizes and shapes of the first and second EGR introduction ports are so determined as to hold the discharge speed of the EGR gas from each introduction port always sufficiently higher than the speed of the main stream near the opening of the introduction port. The setting of the EGR inflow speed is higher than the fresh main stream speed, as shown in FIG. 103.

Therefore, each of the introduction ports discharges the EGR gas into the inlet pipe section 23 at such a sufficient velocity to produce a strong spiral flow as shown in FIG. 30, instead of losing its speed by collision with the main stream as shown in FIG. 31. The EGR gas flows along the spiral path without turning inside toward the central region of the inlet pipe section 23, and stays away from the back flow region without causing deposits. The higher speed EGR flow can prevent deposits and mix the EGR gas efficiently.

37th Embodiment

Figure 104:
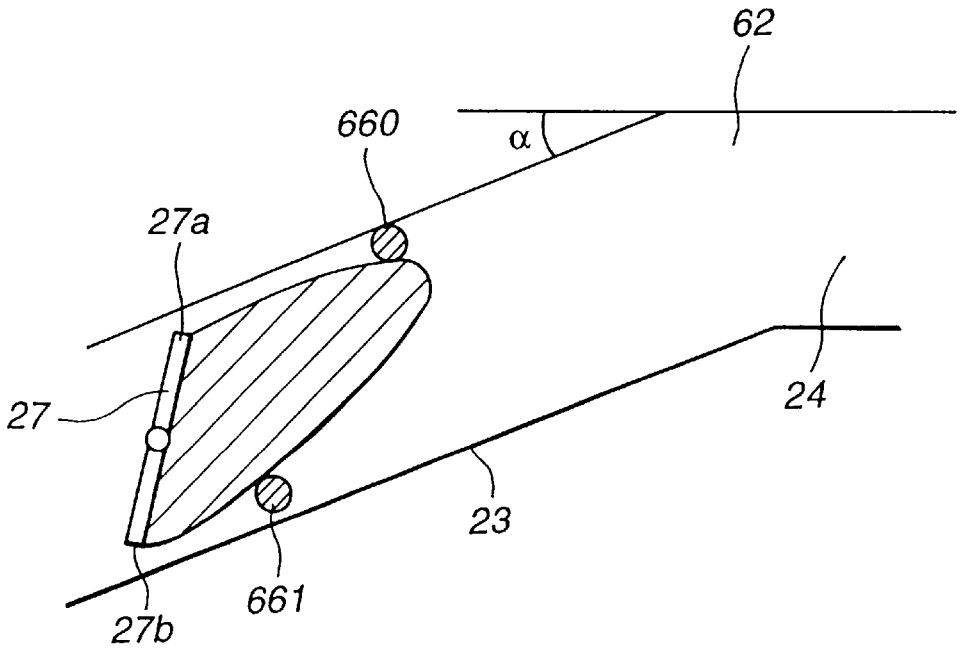
FIG. 104 is a schematic vertical sectional view showing EGR introduction openings according to a thirty-seventh embodiment.

FIG. 104 shows a part of an engine system according to a thirty-seventh embodiment of the present invention. The EGR system of this embodiment comprises first and second non-inclined tangential gas introduction ports 660 and 661 as in the 32nd through 36th embodiments. The intake passage defined by the inlet pipe section 23 and the throttle body 26 is inclined with respect to the longitudinal direction of the collector section 24 to form a bend 62 of an angle $\alpha$ in an imaginary plane to which the axis of the throttle valve 27 is perpendicular, as in the example shown in FIG. 32. In the 37th embodiment, the positions of the EGR introduction openings of the first and second non-inclined tangential EGR introduction ports 660 and 661 are adjusted in accordance with the bend angle $\alpha$ substantially in the same manner as the seventh embodiment shown in FIG. 32.

In the example shown in FIG. 104, the upstream swing end 27*b* of the throttle valve 27 is located on the inner side of the bend 62, and the longitudinal distance of the EGR introduction opening of the second non-inclined EGR introduction port 661 from the swing axis of the throttle valve is smaller than that of the first non-inclined EGR introduction port 660.

FIGS. 1~33 and the explanations of the first through seventh embodiments remain substantially unchanged from the original U.S. application Ser. No. 09/076,489, now abandoned. An original claim 43 of this CIP Application is identical to the original claim 1 of the parent application Ser. No. 09/076,489, now abandoned.

The EGR introduction port according to the first through seventh embodiments is inclined with respect to a cross sectional plane of the intake passage. However, it is possible to employ at least one non-inclined EGR introduction port (or opening) as in some other embodiments, (specifically in the thirty-second through thirty-seventh embodiments shown in FIGS. 92~104). Moreover, the EGR system may be arranged to include only one EGR introduction port (or opening) as specifically disclosed in the eighth through fourteenth embodiments of FIGS. 34~50.

What is claimed is:

1. An exhaust gas recirculation system for an engine, comprising:

an exhaust system for carrying exhaust gas away from the engine;

an intake system comprising a pipe arrangement for distributing intake air to cylinders of the engine, the pipe arrangement comprising a collector section, a plurality of branches leading from the collector section, respectively, to the cylinders of the engine, and an intake passage section for introducing the intake air into the collector section, the intake system further comprising a throttle valve disposed in the intake passage section at an intermediate position dividing the intake passage section into an upstream intake passage subsection on an upstream side of the throttle valve and a downstream intake passage subsection extending from the throttle valve to the collector section; and an EGR system for returning part of the exhaust gas as EGR gas from the exhaust system into the downstream passage subsection of the intake system, the EGR system comprising an EGR gas introduction port having an EGR gas introduction opening for directing an inflow EGR gas stream into the downstream passage subsection, the EGR gas introduction opening being located downstream of a first free end of the throttle valve in a closed position, the EGR gas introduction port extending along a tangential direction tangential to a curved inside wall surface of the downstream passage subsection.

2. The exhaust gas recirculation system as claimed in claim 1 wherein an inflow direction of the EGR gas introduction port is inclined downstream so as to form a predetermined angle with respect to a direction of a fresh intake air stream in the downstream passage subsection.

3. The exhaust gas recirculation system as claimed in claim 1 wherein an inflow direction of the EGR gas introduction port extends in an imaginary cross sectional plane of the downstream passage subsection.

4. An engine system comprising:

an engine;

an exhaust system for carrying exhaust gas away from the engine;

an intake system for supplying intake air to the engine, the intake system comprising a throttle valve disposed in an intake passage which comprises an upstream intake passage section on an upstream side of the throttle valve and a downstream intake passage section on a downstream side of the throttle valve; and an EGR system for returning part of the exhaust gas as EGR gas from the exhaust system into the downstream intake passage section of the intake system, the EGR system comprising an EGR introduction opening which opens into the downstream intake passage section in a predetermined EGR introducing direction to direct an inflow EGR gas stream circumferentially along a curved inside wall surface of the downstream passage section around a central region of the downstream intake passage section.

5. The engine system as claimed in claim 4 wherein the EGR introduction opening faces in the EGR introducing direction which extends through a circumferential annular region surrounding the central region in the downstream intake passage section without intersecting the central region which is a region in which a back flow region extends behind the throttle valve when the throttle valve is fully closed, and the EGR introduction opening is located, longitudinally along a longitudinal direction of the intake passage, between the throttle valve and a downstream end of the back flow region formed on the downstream side of the throttle valve when the throttle valve is fully closed.

6. The engine system as claimed in claim 4 wherein the EGR introduction opening is elongated along a longitudinal direction of the downstream intake passage section.

7. The engine system as claimed in claim 4 wherein the EGR introduction opening opens in the EGR introducing direction which is tangential to the curved inside wall surface of the downstream intake passage section.

8. The engine system as claimed in claim 7 wherein the curved inside wall surface of the downstream passage section is a cylindrical inside surface and the EGR introduction opening opens in the EGR introducing direction tangential to the cylindrical inside surface of the downstream intake passage section; and wherein the downstream intake passage section has a circular cross section, and the EGR introduction opening opens along the EGR introducing direction tangential to the circular cross section of the downstream intake passage section.

9. The engine system as claimed in claim 7 wherein the EGR introducing direction is parallel to an imaginary cross sectional plane of the downstream intake passage section.

10. The engine system as claimed in claim 7 wherein an opening area of the EGR introduction opening is determined in accordance with a maximum speed of a fresh intake air stream passing through the throttle valve, a distance from a swing axis of the throttle valve to the EGR introduction opening and a speed of an EGR gas inflow stream modified by an opening shape of the EGR introduction opening.

11. The engine system as claimed in claim 7 wherein the EGR introducing direction is an inclined direction which is inclined with respect to an imaginary cross sectional plane of the downstream intake passage section and which is intermediate between a non-inclined direction parallel to the imaginary cross sectional plane of the downstream intake passage section and a downstream longitudinal direction of the downstream intake passage section.

12. The engine system as claimed in claim 11 wherein the EGR introducing direction is a direction tangent to an imaginary helix around the longitudinal center line of the downstream intake passage section, an inclination angle between the EGR introducing direction and the imaginary cross sectional plane of the downstream intake passage section is equal to a lead angle of the helix, and a lead of the helix is smaller than a distance between the EGR introduction point and an inlet of any of the branches of the intake pipe system.

13. The engine system as claimed in claim 7 wherein the EGR system comprises an EGR introduction port extending in the EGR introducing direction, and having an open end defining the EGR introduction opening.

14. The engine system as claimed in claim 13 wherein the EGR introduction port comprises a guide case projecting along the EGR introducing direction into the downstream intake passage section, and defining the open end of the EGR introduction port.

15. The engine system as claimed in claim 7 wherein the EGR system comprises an EGR introduction pipe defining the EGR introduction opening for introducing the EGR gas into the downstream intake passage section, the EGR introduction pipe projects into the downstream intake passage section through a hole formed in a circumferential wall of the downstream intake passage section, and the EGR introduction pipe comprises a base side pipe section formed with the EGR introducing opening and a tip side pipe section which defines a tip end of the EGR introduction pipe and which is formed with another EGR introduction opening.

16. The engine system as claimed in claim 15 wherein the EGR introduction opening of the tip side pipe section is opened in the tip end of the EGR introduction pipe, and the EGR introduction pipe extends circumferentially in the downstream intake passage section along the curved inside wall surface of the downstream intake passage section.

17. The engine system as claimed in claim 15 wherein at least one of the EGR introduction openings is opened in an inclined direction tangential to an imaginary circular helix around a longitudinal center line of the downstream intake passage section to produce a spiral flow advancing downstream in the downstream passage section.

18. The engine system as claimed in claim 15 wherein the EGR introduction pipe has a streamlined outside contour to reduce a resistance to a fluid flow in the downstream intake passage section.

19. The engine system as claimed in claim 15 wherein the EGR introduction openings formed in the base side pipe section and tip side pipe section of the EGR introduction pipe are located at diametrically opposite positions around a longitudinal center line of the downstream intake passage section, and directed in parallel but opposite directions.

20. The engine system as claimed in claim 19 wherein the EGR introduction opening formed in the tip side pipe section is opened to a first EGR introduction point located behind a downstream swing end of the throttle valve which swings toward a downstream side of a swing axis of the throttle valve, and the EGR introduction opening formed in the base side pipe section is opened to a second EGR introduction point located behind an upstream swing end of the throttle valve which swings toward an upstream side of the swing axis of the throttle valve; and wherein a longitudinal distance of the EGR introduction opening formed in the base side pipe section from the swing axis of the throttle valve along a longitudinal center line of the downstream intake passage section is smaller than a longitudinal distance of the EGR introduction opening formed in the tip side pipe section from the swing axis of the throttle valve along the longitudinal center line of the downstream intake passage section.

21. The engine system as claimed in claim 19 wherein the tip end of the EGR introduction pipe is closed, and the EGR introduction opening of the tip side pipe section is formed in a circumferential pipe wall of the tip side pipe section.

22. The engine system as claimed in claim 7 wherein said EGR introduction opening is a first EGR introduction opening, said EGR introducing direction of the first EGR introduction opening is a first EGR introducing direction, and the EGR system further comprises a second EGR introduction opening which opens into the downstream intake passage section in a second predetermined EGR introducing direction to direct an inflow EGR gas stream circumferentially along the curved inside wall surface of the downstream passage section around the central region of the downstream intake passage section.

23. The engine system as claimed in claim 22 wherein the first EGR introduction opening is aimed at a first EGR introduction point lying behind the first swing end of the throttle valve which swings toward a downstream side of a swing axis of the throttle valve, the second EGR introduction opening is aimed at a second EGR introduction point lying behind the second swing end of the throttle valve which swings toward an upstream side of the swing axis of the throttle valve, the first and second EGR introduction points are located at diametrically opposite positions around a longitudinal center line of the downstream passage section, and the first and second EGR introduction openings are directed in an equal rotational direction around the longitudinal center line so that the first and second EGR introducing directions are substantially parallel but opposite to each other.

24. The engine system as claimed in claim 23 wherein a cross sectional area of the second EGR introduction opening is greater than a cross sectional area of the first EGR introduction opening.

25. The engine system as claimed in claim 23 wherein a distance of the second EGR opening from the throttle valve is smaller than a distance of the first EGR opening from the throttle valve.

26. The engine system as claimed in claim 23 wherein each of the first and second EGR introducing directions is inclined toward a downstream side to produce a spiral flow advancing downstream in the downstream passage section, and an inclination angle formed between the second EGR introducing direction and a cross sectional plane of the downstream passage section is smaller than an inclination angle formed between the first EGR introducing direction and a cross sectional plane of the downstream passage section.

27. The engine system as claimed in claim 23 wherein the EGR system comprises an EGR introduction pipe which is formed with the first and second EGR introduction openings and which extends, inside the downstream passage section, between a position of the first EGR introduction opening and a position of the second EGR introduction opening.

28. The engine system as claimed in claim 27 wherein the EGR introduction pipe projects into the downstream intake passage section through a hole formed in a circumferential wall of the downstream intake passage section and extends, inside the downstream intake passage section, in one of a diametrical direction of the downstream intake passage section, a circumferential direction around a longitudinal center line of the downstream intake passage section, and an oblique direction such that a projecting end of the EGR introduction pipe is located downstream of the hole formed in the circumferential wall of the downstream intake passage section.

29. The engine system as claimed in claim 7 wherein the engine comprises a plurality of cylinders, the intake system comprises an intake pipe system for distributing intake air to the cylinders of the engine, the intake pipe system comprises a collector section connected with a downstream end of the intake passage, a passage defining section defining the intake passage for conveying the intake air to the collector section, and a plurality of branches leading from the collector section, respectively, to the cylinders of the engine, the downstream intake passage section of the intake passage extends from the throttle valve to the collector section, and the EGR system comprises an EGR passage for conveying the EGR gas from the exhaust system to the EGR introduction opening.

30. The engine system as claimed in claim 29 wherein the EGR introduction opening is located at a first circumferential position lying at a middle of a fresh main stream flowing through a gap of a first swing end of the throttle valve and the curved inside wall surface of the downstream passage section; wherein the EGR introduction opening is opened to an EGR introduction point lying on an imaginary normal straight line which intersects an imaginary longitudinal center line of the downstream passage section and which is perpendicular to an imaginary parallel straight line extending, in parallel to a swing axis of the throttle valve, in an imaginary first center surface that is a ruled surface generated by translational motion of the swing axis of the throttle valve along the longitudinal center line of the downstream passage section; and wherein the EGR system comprises an EGR introduction port defining the EGR introduction opening which is opened in one of a tip side end of the EGR introduction port and a circumferential wall of the EGR introduction port.

31. The engine system as claimed in claim 29 wherein a longitudinal center line of the downstream intake passage section is straight, the EGR system comprises a first EGR introduction port lying between an imaginary first center plane containing both a swing axis of the throttle valve and the longitudinal center line of the downstream intake passage section, and a first imaginary tangent plane which is parallel to the first center plane and tangent to the inside wall surface of the downstream intake passage section which is a cylindrical surface, and the first EGR introduction port extends along the first tangent plane and having an open end defining the EGR introduction opening facing to a first EGR introduction point lying on an imaginary second center plane intersecting the first center plane at right angles along the center line of the downstream intake passage section.

32. The engine system as claimed in claim 31 wherein the EGR system further comprises a second gas introduction port for directing an inflow gas stream into the downstream intake passage section of the intake system, the first and second introduction ports being located on opposite sides of the first imaginary center plane, the first and second introduction ports being located, respectively, on first and second sides of the second imaginary center plane, the first introduction port extending from the first side of the second center plane and opening toward the second side of the second center plane, the second introduction port extending from the second side of the second center plane and opening toward the first side of the second center plane.

33. The engine system as claimed in claim 29 wherein a longitudinal direction of the downstream intake passage section and a longitudinal direction of the collector section intersect each other in a predetermined imaginary plane so as to form a bend between the downstream intake passage section and the collector section, the predetermined imaginary plane contains a swing axis of the throttle valve, and the EGR introduction opening is positioned on an outer side of the bend.

34. The engine system as claimed in claim 33 wherein the EGR introduction opening is an upstream EGR introduction opening which is opened to an upstream EGR introduction point located behind an upstream swing end of the throttle valve, the EGR system further comprises a downstream EGR introduction opening which is positioned on an inner side of the bend and which is opened to a downstream EGR introduction point located behind a downstream swing end of the throttle valve, and a distance of the upstream EGR opening from the swing axis of the throttle valve along the longitudinal direction of the downstream intake passage section is smaller than a distance of the downstream EGR introduction opening from the swing axis of the throttle valve along the longitudinal direction of the downstream intake passage subsection.

35. The engine system as claimed in claim 29 wherein a longitudinal direction of the downstream intake passage section and a longitudinal direction of the collector section intersect each other in a predetermined imaginary plane so as to form a bend between the downstream intake passage section and the collector section, the predetermined imaginary plane is perpendicular to a swing axis of the throttle valve, and the EGR introduction opening is positioned on an inner side of the bend.

36. The engine system as claimed in claim 35 wherein the EGR introduction opening is an upstream EGR introduction opening which is opened to an upstream EGR introduction point located behind an upstream swing end of the throttle valve, the EGR system further comprises a downstream EGR introduction opening which is positioned on an outer side of the bend and which is opened to a downstream EGR introduction point located behind a downstream swing end of the throttle valve, and a distance of the upstream EGR opening from the swing axis of the throttle valve along the longitudinal direction of the downstream intake passage section is smaller than a distance of the downstream EGR introduction opening from the swing axis of the throttle valve along the longitudinal direction of the downstream intake passage subsection.

37. The engine system as claimed in claim 29 wherein said EGR introduction opening is an upstream EGR introduction opening, the EGR system further comprises a downstream EGR introduction opening which opens toward a central region of the collector section.

38. The engine system as claimed in claim 37 wherein the EGR system comprises an upstream EGR introduction port extending in the EGR introducing direction and having an end formed with the upstream EGR introduction opening, and a downstream EGR introduction port extending in a direction to direct the EGR gas from an upstream end of the collector section toward a downstream end of the collector section and having an end formed with the downstream EGR opening which is opened to the upstream end of the collector section.

39. The engine system as claimed in claim 37 wherein a cross sectional area of the upstream EGR introduction opening is greater than a cross sectional area of the downstream EGR introduction opening.

40. The engine system as claimed in claim 29 wherein the EGR introduction opening is opened to an EGR introduction point located behind a first swing end of the throttle valve.

41. The engine system as claimed in claim 40 wherein the first swing end of the throttle valve is an upstream swing end of the throttle valve which swings toward an upstream side of a swing axis of the throttle valve.

42. The engine system as claimed in claim 41 wherein the EGR system further comprises an auxiliary air introduction opening for introducing an auxiliary intake air into the downstream intake passage section, the auxiliary air introduction opening opens to an auxiliary air introduction point lying in the downstream passage section, and auxiliary air introduction point is located behind a second swing end of the throttle valve which swings toward a downstream side of the swing axis of the throttle valve.

43. The engine system as claimed in claim 40 wherein the first swing end of the throttle valve is a downstream swing end of the throttle valve which swings toward a downstream side of a swing axis of the throttle valve.

44. The engine system as claimed in claim 43 wherein the downstream passage section comprises a deflecting rib which projects from the curved inside wall surface of the downstream passage section, and which extends between the downstream swing end of the throttle valve and the EGR introduction opening.

* * * * *